US006598954B1

(12) United States Patent
Moffat et al.

(10) Patent No.: US 6,598,954 B1
(45) Date of Patent: Jul. 29, 2003

(54) APPARATUS AND PROCESS BALLISTIC AEROSOL MARKING

(75) Inventors: Karen A. Moffat, Brantford (CA); Jaan Noolandi, Mississauga (CA); Armin R. Volkel, Palo Alto (CA); Maria N. V. McDougall, Burlington (CA); David N. MacKinnon, Mississauga (CA); James R. Combes, Burlington (CA); Edward G. Zwartz, Mississauga (CA)

(73) Assignee: Xerox Corporation, Stamford, CT (US)

( * ) Notice: Subject to any disclaimer, the term of this patent is extended or adjusted under 35 U.S.C. 154(b) by 40 days.

(21) Appl. No.: 10/040,485

(22) Filed: Jan. 9, 2002

(51) Int. Cl.[7] ..... B41J 2/015; B41J 2/135

(52) U.S. Cl. ..... 347/21; 347/45

(58) Field of Search ..... 347/20, 21, 112, 347/55, 45; 399/252–295

(56) References Cited

U.S. PATENT DOCUMENTS

| | | | | | |
|---|---|---|---|---|---|
| 4,812,860 | A | * | 3/1989 | Sheridan et al. | 347/125 |
| 5,363,124 | A | * | 11/1994 | Arway | 347/74 |
| 6,116,718 | A | | 9/2000 | Peeters et al. | 347/21 |
| 6,136,442 | A | | 10/2000 | Wong | 428/412 |
| 6,265,050 | B1 | | 7/2001 | Wong et al. | 428/209 |
| 6,290,342 | B1 | | 9/2001 | Vo et al. | 347/85 |
| 6,291,088 | B1 | | 9/2001 | Wong et al. | 428/698 |
| 6,302,513 | B1 | | 10/2001 | Moffat et al. | 347/20 |
| 6,309,042 | B1 | | 10/2001 | Veregin et al. | 347/21 |
| 6,328,409 | B1 | | 12/2001 | Peeters et al. | 347/21 |

FOREIGN PATENT DOCUMENTS

WO WO 94/16896 * 8/1994

OTHER PUBLICATIONS

Copending U.S. patent application Ser. No. 09/863,032 (D/99525D), filed May 22, 2001, entitled "Marking Material and Ballistic Aerosol Marking Process for the Use Thereof," by Maria N.V. McDougall et al.

Copending U.S. patent application Ser. No. 09/723,778 (D/A0568), filed Nov. 28, 2000, entitled "Ballistic Aerosol Marking Process Employing Marking Material Comprising Vinyl Resin and Poly(3,4–Ethylenedioxythiophene)," by Karen A. Moffat et al.

Copending U.S. patent application Ser. No. 09/723,577 (D/A0568Q), filed Nov. 28, 2000, entitled "Ballistic Aerosol Marking Process Employing Marking Material Comprising Vinyl Resin and Poly(3,4–Ethylenedioxypyrrole)," by Karen A. Moffat et al.

(List continued on next page.)

*Primary Examiner*—Judy Nguyen
*Assistant Examiner*—Michael S Brooke
(74) *Attorney, Agent, or Firm*—Judith I. Byorick

(57) ABSTRACT

Disclosed is an apparatus for depositing a particulate marking material onto a substrate, comprising (a) a printhead having defined therein at least one channel, each channel having an inner surface and an exit orifice with a width no larger than about 250 microns, the inner surface of each channel having thereon a conductive polymer coating; (b) a propellant source connected to each channel such that propellant provided by the propellant source can flow through each channel to form propellant streams therein, the propellant streams having kinetic energy, each channel directing the propellant stream through the exit orifice toward the substrate; and (c) a marking material reservoir having an inner surface, the inner surface having thereon the conductive polymer coating, the reservoir containing particles of a particulate marking material, the reservoir being communicatively connected to each channel such that the particulate marking material from the reservoir can be controllably introduced into the propellant stream in each channel so that the kinetic energy of the propellant stream can cause the particulate marking material to impact the substrate.

15 Claims, 10 Drawing Sheets

OTHER PUBLICATIONS

Copending U.S. patent application Ser. No. 09/724,458 (D/A0689), filed Nov. 28, 2000, entitled "Toner Compositions Comprising Polythiophenes)," by Karen A. Moffat et al.

Copending U.S. patent application Ser. No. 09/723,839 (D/A0689Q), filed Nov. 28, 2000, entitled "Toner Compositions Comprising Polypyrroles)," by Karen A. Moffat et al.

Copending U.S. patent application Ser. No. 09/723,787 (D/A0979), filed Nov. 28, 2000, entitled "Ballistic Aerosol Marking Process Employing Marking Material Comprising Polyster Resin and Poly(3,4–Ethylenedioxythiophene)," by Rina Carlini et al.

Copending U.S. patent application Ser. No. 09/723,834 (D/A0980), filed Nov. 28, 2000, entitled "Ballistic Aerosol Marking Process Employing Marking Material Comprising Polyster Resin and Poly(3,4–Ethylenedioxypyrrole)," by Karen A. Moffat et al.

Copending U.S. patent application Ser. No. 09/724,064 (D/A0981), filed Nov. 28, 2000, entitled "Toner Compositions Comprising Polyester Resin and Poly(3,4–Ethylenedioxythiophene)," by Karen A. Moffat et al.

Copending U.S. patent application Ser. No. 09/723,851 (D/A0982), filed Nov. 28, 2000, entitled "Toner Compositions Comprising Vinyl Resin and Poly (3,4–Ethylenedioxypyrrole)," by Karen A. Moffat et al.

Copending U.S. patent application Ser. No. 09/723,907 (D/A0983), filed Nov. 28, 2000, entitled "Toner Compositions Comprising Polyester Resin And Poly (3,4–Ethylenedioxypyrrole)," by Karen A. Moffat et al.

Copending U.S. patent application Ser. No. 09/724,013 (D/A0984), filed Nov. 28, 2000, entitled "Toner Compositions Comprising Vinyl Resin and Poly (3,4–Ethylenedioxythiophene)," by Karen A. Moffat et al.

Copending U.S. patent application Ser. No. 09/723,654 (D/A0A20), filed Nov. 28, 2000, entitled "Process For Controlling Triboelectric Charging," by Karen A. Moffat et al.

Copending U.S. patent application Ser. No. 09/723,911 (D/A0A23), filed Nov. 28, 2000, "Toner Compositions Comprising Polyester Resin And Polypyrrole," by James R. Combes et al.

Copending U.S. patent application Ser. No. 09/163,893 (D/98314), filed Sep. 30, 1998, entitled "Ballistic Aerosol Marking Apparatus For Marking A Substrate," By Eric Peeters et al.

Copending U.S. patent application Ser. No. 09/164,124 (D/98314/Q1), filed Sep. 30, 1998, entitled "Method Of Marking A Substrate Employing A Ballisitic Aerosolmarking Apparatus," by Eric Peeters et al.

Copending U.S. patent application Ser. No. 09/164,250 (D/98314Q2), filed Sep. 30, 1998, entitled "Ballistic Aerosol Marking Aparatus For Treating A Substrate," by Eric Peeters et al.

Copending U.S. patent application Ser. No. 09/163,808 (D/98314Q3), filed Sep. 30, 1998, entitled "Method Of Treating A Substrate Employing A Ballistic Aerosol Marking Apparatus," by Eric Peeters et al.

Copending U.S. patent application Ser. No. 09/163,765 (D/98314Q4), filed Sep. 30, 1998, entitled "Cartridge For Use In A Ballistic Aerosol Marking Apparatus," by Eric Peeters et al.

Copending U.S. patent application Ser. No. 09/163,924 (D/98562Q1), filed Sep. 30, 1998, entitled "Method For Marking With A Liquid Material Using A Ballistic Aerosol Marking Apparatus," by Eric Peeters et al.

Copending U.S. patent application Ser. No. 09/164,104 (D/98564), filed Sep. 30, 1998, entitled "Kinetic Fusing Of A Marking Material," by Jaan Noolandi et al.

Copending U.S. patent application Ser. No. 09/163,799 (D/98565Q1), filed Sep. 30, 1998, entitled "Method Of Marking A Print Head For Use In A Ballistic Aerosol Marking Apparatus," by Eric Peeters et al.

* cited by examiner

APPARATUS AND PROCESS BALLISTIC AEROSOL MARKING

CROSS REFERENCES TO RELATED APPLICATIONS

Application U.S. Ser. No. 09/863,032, now U.S. Pat. No. 6,521,297, filed May 22, 2001, entitled "Marking Material and Ballistic Aerosol Marking Process for the Use Thereof," with the named inventors Maria N. V. McDougall, Richard P. N. Veregin, and Karen A. Moffat, the disclosure of which is totally incorporated herein by reference, discloses a marking material comprising (a) toner particles which comprise a resin and a colorant, said particles having an average particle diameter of no more than about 7 microns and a particle size distribution of GSD equal to no more than about 1.25, wherein said toner particles are prepared by an emulsion aggregation process, and (b) hydrophobic conductive metal oxide particles situated on the toner particles. Also disclosed is a process for depositing marking material onto a substrate which comprises (a) providing a propellant to a head structure, said head structure having a channel therein, said channel having an exit orifice with a width no larger than about 250 microns through which the propellant can flow, said propellant flowing through the channel to form thereby a propellant stream having kinetic energy, said channel directing the propellant stream toward the substrate, and (b) controllably introducing a particulate marking material into the propellant stream in the channel, wherein the kinetic energy of the propellant particle stream causes the particulate marking material to impact the substrate, and wherein the particulate marking material comprises (a) toner particles which comprise a resin and a colorant, said particles having an average particle diameter of no more than about 7 microns and a particle size distribution of GSD equal to no more than about 1.25, wherein said toner particles are prepared by an emulsion aggregation process, and (b) hydrophobic conductive metal oxide particles situated on the toner particles.

Application U.S. Ser. No. 09/723,778, now U.S. Pat. No. 6,383,561, filed Nov. 28, 2000, entitled "Ballistic Aerosol Marking Process Employing Marking Material Comprising Vinyl Resin and Poly(3,4-ethylenedioxythiophene)," with the named inventors Karen A. Moffat and Maria N. V. McDougall, the disclosure of which is totally incorporated herein by reference, discloses a process for depositing marking material onto a substrate which comprises (a) providing a propellant to a head structure, said head structure having at least one channel therein, said channel having an exit orifice with a width no larger than about 250 microns through which the propellant can flow, said propellant flowing through the channel to form thereby a propellant stream having kinetic energy, said channel directing the propellant stream toward the substrate, and (b) controllably introducing a particulate marking material into the propellant stream in the channel, wherein the kinetic energy of the propellant particle stream causes the particulate marking material to impact the substrate, and wherein the particulate marking material comprises toner particles which comprise a vinyl resin, an optional colorant, and poly(3,4-ethylenedioxythiophene), said toner particles having an average particle diameter of no more than about 10 microns and a particle size distribution of GSD equal to no more than about 1.25, wherein said toner particles are prepared by an emulsion aggregation process, said toner particles having an average bulk conductivity of at least about $10^{-11}$ Siemens per centimeter.

Application U.S. Ser. No. 09/723,577, now U.S. Pat. No. 6,467,871, filed Nov. 28, 2000, entitled "Ballistic Aerosol Marking Process Employing Marking Material Comprising Vinyl Resin and Poly(3,4-ethylenedioxypyrrole)," with the named inventors Karen A. Moffat, Rina Carlini, Maria N. V. McDougall, and Paul J. Gerroir, the disclosure of which is totally incorporated herein by reference, discloses a process for depositing marking material onto a substrate which comprises (a) providing a propellant to a head structure, said head structure having at least one channel therein, said channel having an exit orifice with a width no larger than about 250 microns through which the propellant can flow, said propellant flowing through the channel to form thereby a propellant stream having kinetic energy, said channel directing the propellant stream toward the substrate, and (b) controllably introducing a particulate marking material into the propellant stream in the channel, wherein the kinetic energy of the propellant particle stream causes the particulate marking material to impact the substrate, and wherein the particulate marking material comprises toner particles which comprise a vinyl resin, an optional colorant, and poly(3,4-ethylenedioxypyrrole), said toner particles having an average particle diameter of no more than about 10 microns and a particle size distribution of GSD equal to no more than about 1.25, wherein said toner particles are prepared by an emulsion aggregation process, said toner particles having an average bulk conductivity of at least about $10^{-11}$ Siemens per centimeter.

Application U.S. Ser. No. 09/724,458, now U.S. Pat. No. 6,503,678, filed Nov. 28, 2000, entitled "Toner Compositions Comprising Polythiophenes," with the named inventors Karen A. Moffat, Maria N. V. McDougall, Rina Carlini, Dan A. Hays, Jack T. Lestrange, and Paul J. Gerroir, the disclosure of which is totally incorporated herein by reference, discloses a toner comprising particles of a resin and an optional colorant, said toner particles having coated thereon a polythiophene. Another embodiment is directed to a process which comprises (a) generating an electrostatic latent image on an imaging member, and (b) developing the latent image by contacting the imaging member with charged toner particles comprising a resin and an optional colorant, said toner particles having coated thereon a polythiophene.

Application U.S. Ser. No. 09/723,839, now U.S. Pat. No. 6,492,082 filed Nov. 28, 2000, entitled "Toner Compositions Comprising Polypyrroles," with the named inventors Karen A. Moffat, Maria N. V. McDougall, Rina Carlini, Dan A. Hays, Jack T. Lestrange, and James R. Combes, the disclosure of which is totally incorporated herein by reference, discloses a toner comprising particles of a resin and an optional colorant, said toner particles having coated thereon a polypyrrole. Another embodiment is directed to a process which comprises (a) generating an electrostatic latent image on an imaging member, and (b) developing the latent image by contacting the imaging member with charged toner particles comprising a resin and an optional colorant, said toner particles having coated thereon a polypyrrole.

Application U.S. Ser. No. 09/723,787, now U.S. Pat. No. 6,439,711 filed Nov. 28, 2000, entitled "Ballistic Aerosol Marking Process Employing Marking Material Comprising Polyester Resin and Poly(3,4-ethylenedioxythiophene)," with the named inventors Rina Carlini, Karen A. Moffat, Maria N. V. McDougall, and Danielle C. Boils-Boissier, the disclosure of which is totally incorporated herein by reference, discloses a process for depositing marking material onto a substrate which comprises (a) providing a propellant to a head structure, said head structure having at least one channel therein, said channel having an exit orifice with a width no larger than about 250 microns through which the propellant can flow, said propellant flowing through the channel to form thereby a propellant stream having kinetic energy, said channel directing the propellant stream toward the substrate, and (b) controllably introducing a particulate marking material into the propellant stream in the channel, wherein the kinetic energy of the propellant particle stream causes the particulate marking material to impact the substrate, and wherein the particulate marking material comprises toner particles which comprise a polyester resin, an optional colorant, and poly(3,4-ethylenedioxythiophene), said toner particles having an average particle diameter of no more than about 10 microns and a particle size distribution of GSD equal to no more than about 1.25, wherein said toner particles are prepared by an emulsion aggregation process, said toner particles having an average bulk conductivity of at least about $10^{-11}$ Siemens per centimeter.

Application U.S. Ser. No. 09/723,834, now U.S. Pat. No. 6,387,422 filed Nov. 28, 2000, entitled "Ballistic Aerosol Marking Process Employing Marking Material Comprising Polyester Resin and Poly(3,4-ethylenedioxypyrrole)," with the named inventors Karen A. Moffat, Rina Carlini, and Maria N. V. McDougall, the disclosure of which is totally incorporated herein by reference, discloses a process for depositing marking material onto a substrate which comprises (a) providing a propellant to a head structure, said head structure having at least one channel therein, said channel having an exit orifice with a width no larger than about 250 microns through which the propellant can flow, said propellant flowing through the channel to form thereby a propellant stream having kinetic energy, said channel directing the propellant stream toward the substrate, and (b) controllably introducing a particulate marking material into the propellant stream in the channel, wherein the kinetic energy of the propellant particle stream causes the particulate marking material to impact the substrate, and wherein the particulate marking material comprises toner particles which comprise a polyester resin, an optional colorant, and poly(3,4-ethylenedioxypyrrole), said toner particles having an average particle diameter of no more than about 10 microns and a particle size distribution of GSD equal to no more than about 1.25, wherein said toner particles are prepared by an emulsion aggregation process, said toner particles having an average bulk conductivity of at least about $10^{-11}$ Siemens per centimeter.

Copending application U.S. Ser. No. 09/724,064, filed Nov. 28, 2000, entitled "Toner Compositions Comprising Polyester Resin and Poly(3,4-ethylenedioxythiophene)," with the named inventors Karen A. Moffat, Rina Carlini, Maria N. V. McDougall, Dan A. Hays, and Jack T. Lestrange, the disclosure of which is totally incorporated herein by reference, discloses a toner comprising particles of a polyester resin, an optional colorant, and poly(3,4-ethylenedioxythiophene), wherein said toner particles are prepared by an emulsion aggregation process. Another embodiment is directed to a process which comprises (a) generating an electrostatic latent image on an imaging member, and (b) developing the latent image by contacting the imaging member with charged toner particles comprising a polyester resin, an optional colorant, and poly(3,4-ethylenedioxythiophene), wherein said toner particles are prepared by an emulsion aggregation process.

Application U.S. Ser. No. 09/723,851, now U.S. Pat. No. 6,485,874 filed Nov. 28, 2000, entitled "Toner Compositions Comprising Vinyl Resin and Poly(3,4-ethylenedioxypyrrole)," with the named inventors Karen A. Moffat, Maria N. V. McDougall, Rina Carlini, Dan A. Hays, Jack T. Lestrange, and Paul J. Gerroir, the disclosure of which is totally incorporated herein by reference, discloses a toner comprising particles of a vinyl resin, an optional colorant, and poly(3,4-ethylenedioxypyrrole), wherein said toner particles are prepared by an emulsion aggregation process. Another embodiment is directed to a process which comprises (a) generating an electrostatic latent image on an imaging member, and (b) developing the latent image by contacting the imaging member with charged toner particles comprising a vinyl resin, an optional colorant, and poly(3,4-ethylenedioxypyrrole), wherein said toner particles are prepared by an emulsion aggregation process.

Application U.S. Ser. No. 09/723,907, now U.S. Pat. No. 6,387,581 filed Nov. 28, 2000, entitled "Toner Compositions Comprising Polyester Resin and Poly(3,4-ethylenedioxypyrrole)," with the named inventors Karen A. Moffat, Rina Carlini, Maria N. V. McDougall, Dan A. Hays, and Jack T. Lestrange, the disclosure of which is totally incorporated herein by reference, discloses a toner comprising particles of a polyester resin, an optional colorant, and poly(3,4-ethylenedioxypyrrole), wherein said toner particles are prepared by an emulsion aggregation process. Another embodiment is directed to a process which comprises (a) generating an electrostatic latent image on an imaging member, and (b) developing the latent image by contacting the imaging member with charged toner particles comprising a polyester resin, an optional colorant, and poly(3,4-ethylenedioxypyrrole), wherein said toner particles are prepared by an emulsion aggregation process.

Application U.S. Ser. No. 09/724,013, filed Nov. 28, 2000, entitled "Toner Compositions Comprising Vinyl Resin and Poly(3,4-ethylenedioxythiophene)," with the named inventors Karen A. Moffat, Maria N. V. McDougall, Rina Carlini, Dan A. Hays, Jack T. Lestrange, and Paul J. Gerroir, the disclosure of which is totally incorporated herein by reference, discloses a toner comprising particles of a vinyl resin, an optional colorant, and poly(3,4-ethylenedioxythiophene), wherein said toner particles are prepared by an emulsion aggregation process. Another embodiment is directed to a process which comprises (a) generating an electrostatic latent image on an imaging member, and (b) developing the latent image by contacting the imaging member with charged toner particles comprising a vinyl resin, an optional colorant, and poly(3,4-ethylenedioxythiophene), wherein said toner particles are prepared by an emulsion aggregation process.

Application U.S. Ser. No. 09/723,654, now U.S. Pat. No. 6,365,318 filed Nov. 28, 2000, entitled "Process for Controlling Triboelectric Charging," with the named inventors Karen A. Moffat, Maria N. V. McDougall, and James R. Combes, the disclosure of which is totally incorporated herein by reference, discloses a process which comprises (a) dispersing into a solvent (i) toner particles comprising a resin and an optional colorant, and (ii) monomers selected from pyrroles, thiophenes, or mixtures thereof; and (b) causing, by exposure of the monomers to an oxidant, oxidative polymerization of the monomers onto the toner particles, wherein subsequent to polymerization, the toner particles are capable of being charged to a negative or positive polarity, and wherein the polarity is determined by the oxidant selected.

Copending application U.S. Ser. No. 09/723,911, filed Nov. 28, 2000, entitled "Toner Compositions Comprising Polyester Resin and Polypyrrole," with the named inventors James R. Combes, Karen A. Moffat, and Maria N. V. McDougall, the disclosure of which is totally incorporated herein by reference, discloses a toner comprising particles of a polyester resin, an optional colorant, and polypyrrole, wherein said toner particles are prepared by an emulsion aggregation process. Another embodiment is directed to a process which comprises (a) generating an electrostatic latent image on an imaging member, and (b) developing the latent image by contacting the imaging member with charged toner particles comprising a polyester resin, an optional colorant, and polypyrrole, wherein said toner particles are prepared by an emulsion aggregation process.

BACKGROUND OF THE INVENTION

The present invention is directed to marking apparatus and processes. More specifically, the present invention is directed to a ballistic aerosol marking apparatus and process for generating images. One embodiment of the present invention is directed to an apparatus for depositing a particulate marking material onto a substrate, comprising (a) a printhead having defined therein at least one channel, each channel having an inner surface and an exit orifice with a width no larger than about 250 microns, the inner surface of each channel having thereon a conductive polymer coating; (b) a propellant source connected to each channel such that propellant provided by the propellant source can flow through each channel to form propellant streams therein, said propellant streams having kinetic energy, each channel directing the propellant stream through the exit orifice toward the substrate; and (c) a marking material reservoir having an inner surface, said inner surface having thereon the conductive polymer coating, said reservoir containing particles of a particulate marking material, said reservoir being communicatively connected to each channel such that the particulate marking material from the reservoir can be controllably introduced into the propellant stream in each channel so that the kinetic energy of the propellant stream can cause the particulate marking material to impact the substrate. Another embodiment of the present invention is directed to a process for depositing marking material onto a substrate which comprises (a) providing a propellant to a printhead, said printhead having defined therein at least one channel, each channel having an inner surface and an exit orifice with a width no larger than about 250 microns through which the propellant can flow, said propellant flowing through each channel, thereby forming a propellant stream having kinetic energy, each channel directing the propellant stream toward the substrate, the inner surface of each channel having thereon a conductive polymer coating; and (b) controllably introducing a particulate marking material into the propellant stream in each channel, wherein the kinetic energy of the propellant stream causes the particulate marking material to impact the substrate.

Ink jet is currently a common printing technology. There are a variety of types of ink jet printing, including thermal ink jet printing, piezoelectric ink jet printing, and the like. In ink jet printing processes, liquid ink droplets are ejected from an orifice located at one terminus of a channel. In a thermal ink jet printer, for example, a droplet is ejected by the explosive formation of a vapor bubble within an ink bearing channel. The vapor bubble is formed by means of a heater, in the form of a resistor, located on one surface of the channel.

Several disadvantages can be associated with known ink jet systems. For a 300 spot-per-inch (spi) thermal ink jet system, the exit orifice from which an ink droplet is ejected is typically on the order of about 64 microns in width, with a channel-to-channel spacing (pitch) of typically about 84 microns; for a 600 dpi system, width is typically about 35 microns and pitch is typically about 42 microns. A limit on the size of the exit orifice is imposed by the viscosity of the fluid ink used by these systems. It is possible to lower the viscosity of the ink by diluting it with increasing amounts of liquid (such as water) with an aim to reducing the exit orifice width. The increased liquid content of the ink, however, results in increased wicking, paper wrinkle, and slower drying time of the ejected ink droplet, which negatively affects resolution, image quality (such as minimum spot size, intercolor mixing, spot shape), and the like. The effect of this orifice width limitation is to limit resolution of thermal ink jet printing, for example to well below 900 spi, because spot size is a function of the width of the exit orifice, and resolution is a function of spot size.

Another disadvantage of known ink jet technologies is the difficulty of producing grayscale printing. It is very difficult for an ink jet system to produce varying size spots on a printed substrate. If one lowers the propulsive force (heat in a thermal ink jet system) so as to eject less ink in an attempt to produce a smaller dot, or likewise increases the propulsive force to eject more ink and thereby to produce a larger dot, the trajectory of the ejected droplet is affected. The altered trajectory in turn renders precise dot placement difficult or impossible, and not only makes monochrome grayscale printing problematic, it makes multiple color grayscale ink jet printing impracticable. In addition, preferred grayscale printing is obtained not by varying the dot size, as is the case for thermal ink jet, but by varying the dot density while keeping a constant dot size.

Still another disadvantage of common ink jet systems is rate of marking obtained. Approximately 80 percent of the time required to print a spot is taken by waiting for the ink jet channel to refill with ink by capillary action. To a certain degree, a more dilute ink flows faster, but raises the problem of wicking, substrate wrinkle, drying time, and the like, discussed above.

One problem common to ejection printing systems is that the channels may become clogged. Systems such as thermal ink jet which employ aqueous ink colorants are often sensitive to this problem, and routinely employ non-printing cycles for channel cleaning during operation. This clearing is required, since ink typically sits in an ejector waiting to be ejected during operation, and while sitting may begin to dry and lead to clogging.

Ballistic aerosol marking processes overcome many of these disadvantages. Ballistic aerosol marking is a process for applying a marking material to a substrate, directly or indirectly. In particular, the ballistic aerosol marking system includes a propellant which travels through a channel, and a marking material that is controllably (i.e., modifiable in use) introduced, or metered, into the channel such that energy from the propellant propels the marking material to the substrate. The propellant is usually a dry gas that can continuously flow through the channel while the marking apparatus is in an operative configuration (i.e., in a power-on or similar state ready to mark). Examples of suitable propellants include carbon dioxide gas, nitrogen gas, clean dry ambient air, gaseous products of a chemical reaction, or the like; preferably, non-toxic propellants are employed, although in certain embodiments, such as devices enclosed in a special chamber or the like, a broader range of propellants can be tolerated. The system is referred to as "ballistic aerosol marking" in the sense that marking is achieved by in essence launching a non-colloidal, solid or semi-solid particulate, or alternatively a liquid, marking material at a substrate. The shape of the channel can result in a collimated (or focused) flight of the propellant and marking material onto the substrate.

The propellant can be introduced at a propellant port into the channel to form a propellant stream. A marking material can then be introduced into the propellant stream from one or more marking material inlet ports. The propellant can enter the channel at a high velocity. Alternatively, the propellant can be introduced into the channel at a high pressure, and the channel can include a constriction (for example, de Laval or similar converging/diverging type nozzle) for converting the high pressure of the propellant to high velocity. In such a situation, the propellant is introduced at a port located at a proximal end of the channel (the converging region), and the marking material ports are provided near the distal end of the channel (at or further down-stream of the diverging region), allowing for introduction of marking material into the propellant stream.

In the situation where multiple ports are provided, each port can provide for a different color (for example, cyan, magenta, yellow, and black), pre-marking treatment material (such as a marking material adherent), post-marking treatment material (such as a substrate surface finish material, for example, matte or gloss coating, or the like), marking material not otherwise visible to the unaided eye (for example, magnetic particle-bearing material, ultraviolet-fluorescent material, or the like) or other marking material to be applied to the substrate. Examples of materials suitable for pre-marking treatment and post-marking treatment include polyester resins (either linear or branched); poly (styrenic) homopolymers; poly(acrylate) and poly (methacrylate) homopolymers and mixtures thereof; random copolymers of styrenic monomers with acrylate, methacrylate, or butadiene monomers and mixtures thereof; polyvinyl acetals; poly(vinyl alcohol)s; vinyl alcohol-vinyl acetal copolymers; polycarbonates; mixtures thereof; and the like. The marking material is imparted with kinetic energy from the propellant stream, and ejected from the channel at an exit orifice located at the distal end of the channel in a direction toward a substrate.

One or more such channels can be provided in a structure which, in one embodiment, is referred to herein as a printhead. The width of the exit (or ejection) orifice of a channel is typically on the order of about 250 microns or smaller, and preferably in the range of about 100 microns or smaller. When more than one channel is provided, the pitch, or spacing from edge to edge (or center to center) between adjacent channels can also be on the order of about 250 microns or smaller, and preferably in the range of about 100 microns or smaller. Alternatively, the channels can be staggered, allowing reduced edge-to-edge spacing. The exit orifice and/or some or all of each channel can have a circular, semicircular, oval, square, rectangular, triangular or other cross-sectional shape when viewed along the direction of flow of the propellant stream (the channel's longitudinal axis).

The marking material to be applied to the substrate can be transported to a port by one or more of a wide variety of ways, including simple gravity feed, hydrodynamic, electrostatic, or ultrasonic transport, or the like. The material can be metered out of the port into the propellant stream also by one of a wide variety of ways, including control of the transport mechanism, or a separate system such as pressure balancing, electrostatics, acoustic energy, ink jet, or the like.

The marking material to be applied to the substrate can be a solid or semi-solid particulate material, such as a toner or variety of toners in different colors, a suspension of such a marking material in a carrier, a suspension of such a marking material in a carrier with a charge director, a phase change material, or the like. Preferably the marking material is particulate, solid or semi-solid, and dry or suspended in a liquid carrier. Such a marking material is referred to herein as a particulate marking material. A particulate marking material is to be distinguished from a liquid marking material, dissolved marking material, atomized marking material, or similar non-particulate material, which is generally referred to herein as a liquid marking material. However, ballistic aerosol marking processes are also able to utilize such a liquid marking material in certain applications.

Ballistic aerosol marking processes also enable marking on a wide variety of substrates, including direct marking on non-porous substrates such as polymers, plastics, metals, glass, treated and finished surfaces, and the like. The reduction in wicking and elimination of drying time also provides improved printing to porous substrates such as paper, textiles, ceramics, and the like. In addition, ballistic aerosol marking processes can be configured for indirect marking, such as marking to an intermediate transfer roller or belt, marking to a viscous binder film and nip transfer system, or the like.

The marking material to be deposited on a substrate can be subjected to post ejection modification, such as fusing or drying, overcoating, curing, or the like. In the case of fusing, the kinetic energy of the material to be deposited can itself be sufficient effectively to melt the marking material upon impact with the substrate and fuse it to the substrate. The substrate can be heated to enhance this process. Pressure rollers can be used to cold-fuse the marking material to the substrate. In-flight phase change (solid-liquid-solid) can alternatively be employed. A heated wire in the particle path is one way to accomplish the initial phase change. Alternatively, propellant temperature can accomplish this result. In one embodiment, a laser can be employed to heat and melt the particulate material in-flight to accomplish the initial phase change. The melting and fusing can also be electrostatically assisted (i.e., retaining the particulate material in a desired position to allow ample time for melting and fusing into a final desired position). The type of particulate can also dictate the post-ejection modification. For example, ultraviolet curable materials can be cured by application of ultraviolet radiation, either in flight or when located on the material-bearing substrate.

Since propellant can continuously flow through a channel, channel clogging from the build-up of material is reduced (the propellant effectively continuously cleans the channel). In addition, a closure can be provided that isolates the channels from the environment when the system is not in use. Alternatively, the printhead and substrate support (for example, a platen) can be brought into physical contact to effect a closure of the channel. Initial and terminal cleaning cycles can be designed into operation of the printing system to optimize the cleaning of the channel(s). Waste material cleaned from the system can be deposited in a cleaning station. It is also possible, however, to engage the closure against an orifice to redirect the propellant stream through the port and into the reservoir thereby to flush out the port.

Further details on the ballistic aerosol marking process are disclosed in, for example, application U.S. Ser. No. 09/163,893, now U.S. Pat. No. 6,511,149, filed Sep. 30, 1998, with the named inventors Gregory B. Anderson, Steven B. Bolte, Dan A. Hays, Warren B. Jackson, Gregory J. Kovacs, Meng H. Lean, Jaan Noolandi, Joel A. Kubby, Eric Peeters, Raj B. Apte, Philip D. Floyd, An-Chang Shi, Frederick J. Endicott, Armin R. Volkel, and Jonathan A. Small, entitled "Ballistic Aerosol Marking Apparatus for Marking a Substrate," application U.S. Ser. No. 09/164,124, now U.S. Pat. No. 6,416,157 filed Sep. 30, 1998, with the named inventors Gregory B. Anderson, Steven B. Bolte, Dan A. Hays, Warren B. Jackson, Gregory J. Kovacs, Meng H. Lean, Jaan Noolandi, Joel A. Kubby, Eric Peeters, Raj B. Apte, Philip D. Floyd, An-Chang Shi, Frederick J. Endicott, Armin R. Volkel, and Jonathan A. Small, entitled "Method of Marking a Substrate Employing a Ballistic Aerosol Marking Apparatus," application U.S. Ser. No. 09/164,250, now U.S. Pat. No. 6,340,216 filed Sep. 30, 1998, with the named inventors Gregory B. Anderson, Danielle C. Boils, Steven B. Bolte, Dan A. Hays, Warren B. Jackson, Gregory J. Kovacs, Meng H. Lean, T. Brian McAneney, Maria N. V. McDougall, Karen A. Moffat, Jaan Noolandi, Richard P. N. Veregin, Paul D. Szabo, Joel A. Kubby, Eric Peeters, Raj B. Apte, Philip D. Floyd, An-Chang Shi, Frederick J. Endicott, Armin R. Volkel, and Jonathan A. Small, entitled "Ballistic Aerosol Marking Apparatus for Treating a Substrate," application U.S. Ser. No. 09/163,808, now U.S. Pat. No. 6,523,928 filed Sep. 30, 1998, with the named inventors Gregory B. Anderson, Danielle C. Boils, Steven B. Bolte, Dan A. Hays, Warren B. Jackson, Gregory J. Kovacs, Meng H. Lean, T. Brian McAneney, Maria N. V. McDougall, Karen A. Moffat, Jaan Noolandi, Richard P. N. Veregin, Paul D. Szabo, Joel A. Kubby, Eric Peeters, Raj B. Apte, Philip D. Floyd, An-Chang Shi, Frederick J. Endicott, Armin R. Volkel, and Jonathan A. Small, entitled "Method of Treating a Substrate Employing a Ballistic Aerosol Marking Apparatus," application U.S. Ser. No. 09/163,765, now U.S. Pat. No. 6,225,239 filed Sep. 30, 1998, with the named inventors Gregory B. Anderson, Steven B. Bolte, Dan A. Hays, Warren B. Jackson, Gregory J. Kovacs, Meng H. Lean, Jaan Noolandi, Joel A. Kubby, Eric Peeters, Raj B. Apte, Philip D. Floyd, An-Chang Shi, Frederick J. Endicott, Armin R. Volkel, and Jonathan A. Small, entitled "Cartridge for Use in a Ballistic Aerosol Marking Apparatus," application U.S. Ser. No. 09/163,924, now U.S. Pat. No. 6,454,384 filed Sep. 30, 1998, with the named inventors Gregory B. Anderson, Andrew A. Berlin, Steven B. Bolte, Ga Neville Connell, Dan A. Hays, Warren B. Jackson, Gregory J. Kovacs, Meng H. Lean, Jaan Noolandi, Joel A. Kubby, Eric Peeters, Raj B. Apte, Philip D. Floyd, An-Chang Shi, Frederick J. Endicott, Armin R. Volkel, and Jonathan A. Small, entitled "Method for Marking with a Liquid Material Using a Ballistic Aerosol Marking Apparatus," application U.S. Ser. No. 09/164,104, now U.S. Pat. No. 6,416,156 filed Sep. 30, 1998, with the named inventors T. Brian McAneney, Jaan Noolandi, and An-Chang Shi, entitled "Kinetic Fusing of a Marking Material," and Copending application U.S. Ser. No. 09/163,799, filed Sep. 30, 1998, with the named inventors Meng H. Lean, Jaan Noolandi, Eric Peeters, Raj B. Apte, Philip D. Floyd, and Armin R. Volkel, entitled "Method of Making a Printhead for Use in a Ballistic Aerosol Marking Apparatus," the disclosures of each of which are totally incorporated herein by reference.

U.S. Pat. No. 6,328,409 (Anderson et al.), the disclosure of which is totally incorporated herein by reference, discloses a marking apparatus in which a propellant stream is passed through a channel and directed toward a substrate. A liquid marking material, such as ink, is controllably introduced into the propellant stream and imparted with sufficient kinetic energy thereby to be made incident upon a substrate. A multiplicity of channels for directing the propellant and marking material allow for high throughput, high resolution marking. Multiple marking materials may be introduced into the channel and mixed therein prior to being made incident on the substrate, or mixed or superimposed on the substrate without registration. One example is a single-pass, full-color printer.

U.S. Pat. No. 6,136,442 (Wong), the disclosure of which is totally incorporated herein by reference, discloses a multi-layer organic, top-surface, semiconducting dielectric overcoat, having a selected time constant permits electric field charge and dissipation at a selected rate to facilitate particulate material movement over an underlying electrode grid. The coating may be made from a first layer including an oxidant, and a second layer thereover which omits said oxidant. Each layer may further include a compound including a polymer such as bisphenol A polycarbonate, and a charge transport molecule such as m-TBD. A planarized, wear resistant, chemically stable surface, with minimized inter-electrode build-up are also provided by the overcoat.

U.S. Pat. No. 6,116,718 (Peeters et al.), the disclosure of which is totally incorporated herein by reference, discloses a printhead for use in a marking apparatus in which a propellant stream is passed through a channel and directed toward a substrate. Marking material, such as ink, toner, etc., is controllably introduced into the propellant stream and imparted with sufficient kinetic energy thereby to be made incident upon a substrate. A multiplicity of channels for directing the propellant and marking material allow for high throughput, high resolution marking. Multiple marking materials may be introduced into the channel and mixed therein prior to being made incident on the substrate, or mixed or superimposed on the substrate without registration.

U.S. Pat. No. 6,290,342 (Vo et al.), the disclosure of which is totally incorporated herein by reference, discloses a device for the transport of particulate marking material which includes a plurality of interdigitated electrodes formed on a substrate. An electrostatic traveling wave may be generated across the electrodes to attract particles of marking material sequentially, and thereby transport them to a desired location. The electrodes may be integrally formed with driving circuitry, and may be staggered to minimize or eliminate cross-talk.

U.S. Pat. No. 6,265,050 (Wong et al.), the disclosure of which is totally incorporated herein by reference, discloses an organic, top-surface, semiconducting dielectric overcoat, having a selected time constant which permits electric field charge and dissipation at a selected rate to facilitate particulate material movement over an underlying electrode grid. The coating may be made from a compound including bisphenol A polycarbonate, or similar material, and a charge transport molecule (e.g. m-TBD). A planarized, wear resistant, chemically stable surface, with minimized inter-electrode build-up are also provided by the overcoat.

U.S. Pat. No. 6,291,088 (Wong et al.), the disclosure of which is totally incorporated herein by reference, discloses an inorganic, top-surface, semiconducting dielectric overcoat, having a selected time constant which permits electric field charge and dissipation at a selected rate to facilitate particulate material movement over an underlying electrode grid. The coating may be made from nitrides, oxides or oxy-nitrides of silicon, or amorphous silicon. A planarized, wear resistant, chemically stable surface, and minimized inter-electrode build-up are also provided by the overcoat.

U.S. Pat. No. 6,309,042 (Veregin et al.), the disclosure of which is totally incorporated herein by reference, discloses an apparatus for depositing a particulate marking material onto a substrate, comprising (a) a printhead having defined therein at least one channel, each channel having an inner surface and an exit orifice with a width no larger than about 250 microns, the inner surface of each channel having thereon a hydrophobic coating material; (b) a propellant source connected to each channel such that propellant provided by the propellant source can flow through each channel to form propellant streams therein, said propellant streams having kinetic energy, each channel directing the propellant stream through the exit orifice toward the substrate; and (c) a marking material reservoir having an inner surface, said inner surface having thereon the hydrophobic coating material, said reservoir containing particles of a particulate marking material, said reservoir being communicatively connected to each channel such that the particulate marking material from the reservoir can be controllably introduced into the propellant stream in each channel so that the kinetic energy of the propellant stream can cause the particulate marking material to impact the substrate, wherein either (i) the marking material particles of particulate marking material have an outer coating of the hydrophobic coating material; or (ii) the marking material particles have additive particles on the surface thereof, said additive particles having an outer coating of the hydrophobic coating material; or (iii) both the marking material particles and the additive particles have an outer coating of the hydrophobic coating material.

U.S. Pat. No. 6,302,513 (Moffat et al.), the disclosure of which is totally incorporated herein by reference, discloses a process for depositing marking material onto a substrate which comprises (a) providing a propellant to a head structure, said head structure having a channel therein, said channel having an exit orifice with a width no larger than about 250 microns through which the propellant can flow, said propellant flowing through the channel to form thereby a propellant stream having kinetic energy, said channel directing the propellant stream toward the substrate, and (b) controllably introducing a particulate marking material into the propellant stream in the channel, wherein the kinetic energy of the propellant particle stream causes the particulate marking material to impact the substrate, and wherein the particulate marking material comprises particles which comprise a resin and a colorant, said particles having an average particle diameter of no more than about 7 microns and a particle size distribution of GSD equal to no more than about 1.25, wherein said particles are prepared by an emulsion aggregation process.

While known compositions and processes are suitable for their intended purposes, a need remains for improved marking processes. In addition, a need remains for improved ballistic aerosol marking processes. Further, a need remains for ballistic aerosol marking processes in which the possibility of the marking material clogging the printing channels is further reduced. Additionally, a need remains for ballistic aerosol marking processes wherein the marking material does not become undesirably charged. There is also a need for ballistic aerosol marking processes wherein the marking material does not adhere to any of the surfaces within the marking device. In addition, there is a need for ballistic aerosol marking processes wherein the marking material is semi-conductive or conductive (as opposed to insulative) and capable of retaining electrostatic charge. Further, there is a need for ballistic aerosol marking processes wherein the marking materials have sufficient conductivity to provide for inductive charging to enable marking material transport and gating into the printing channels. Additionally, there is a need for ballistic aerosol marking processes wherein the marking materials have sufficient conductivity to enable marking material transport as individual discrete non-agglomerated particles through the venturi channels but also retain enough charge on the particle surface generated by either friction through triboelectrification or induction charging to enable marking material transport and gating into the printing channels.

SUMMARY OF THE INVENTION

The present invention is directed to an apparatus for depositing a particulate marking material onto a substrate, comprising (a) a printhead having defined therein at least one channel, each channel having an inner surface and an exit orifice with a width no larger than about 250 microns, the inner surface of each channel having thereon a conductive polymer coating; (b) a propellant source connected to each channel such that propellant provided by the propellant source can flow through each channel to form propellant streams therein, said propellant streams having kinetic energy, each channel directing the propellant stream through the exit orifice toward the substrate; and (c) a marking material reservoir having an inner surface, said inner surface having thereon the conductive polymer coating, said reservoir containing particles of a particulate marking material, said reservoir being communicatively connected to each channel such that the particulate marking material from the reservoir can be controllably introduced into the propellant stream in each channel so that the kinetic energy of the propellant stream can cause the particulate marking material to impact the substrate. Another embodiment of the present invention is directed to a process for depositing marking material onto a substrate which comprises (a) providing a propellant to a printhead, said printhead having defined therein at least one channel, each channel having an inner surface and an exit orifice with a width no larger than about 250 microns through which the propellant can flow, said propellant flowing through each channel, thereby forming a propellant stream having kinetic energy, each channel directing the propellant stream toward the substrate, the inner surface of each channel having thereon a conductive polymer coating; and (b) controllably introducing a particulate marking material into the propellant stream in each channel, wherein the kinetic energy of the propellant stream causes the particulate marking material to impact the substrate.

DETAILED DESCRIPTION OF THE INVENTION

To reduce clogging of the channels with particulate marking material in a ballistic aerosol marking apparatus, it has been determined that the marking particles should have low cohesion to themselves, so that they do not stick together. In addition, it has been determined that the marking materials should exhibit little or no adhesion to the channel and reservoir surfaces of the apparatus. Further, it has been determined that undesirable adhesion of marking materials to surfaces of the apparatus and undesirable cohesion of marking particles to themselves can result when charge builds up on the marking particles. The present invention is directed to an apparatus and process for ballistic aerosol marking wherein at least some inner surfaces of the apparatus that come into contact with the marking material are coated with a conductive polymer. The conductive polymer allows for charge dissipation in the marking material as marking particles contact the inner surfaces of the apparatus. In a specific embodiment, the marking particles themselves are also semiconductive or conductive on the particle surfaces, thereby further reducing adhesion between the marking particles and the apparatus surfaces and also reducing cohesion of marking particles to themselves.

In the following detailed description, numeric ranges are provided for various aspects of the embodiments described, such as pressures, velocities, widths, lengths, and the like. These recited ranges are to be treated as examples only, and are not intended to limit the scope of the claims hereof. In addition, a number of materials are identified as suitable for various aspects of the embodiments, such as for marking materials, propellants, body structures, and the like. These recited materials are also to be treated as exemplary, and are not intended to limit the scope of the claims hereof.

Figure 1:
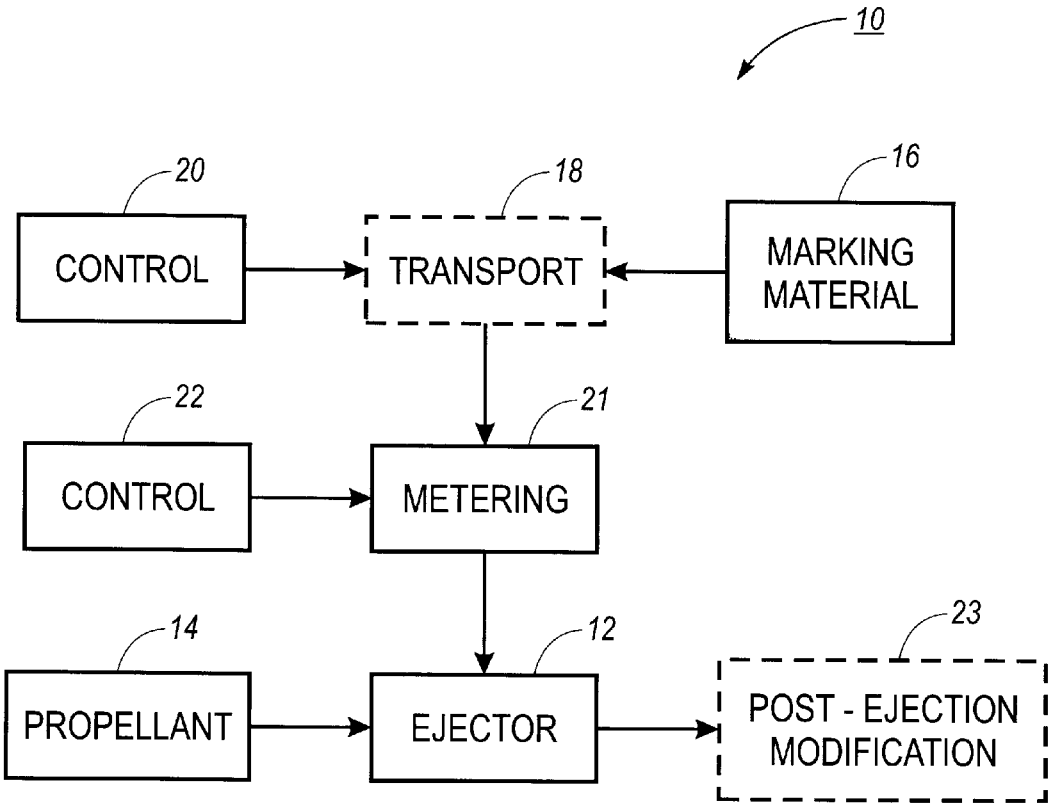
FIG. 1 is a schematic illustration of a system for marking a substrate according to the present invention.

With reference now to FIG. 1, shown therein is a schematic illustration of a ballistic aerosol marking device 10 according to one embodiment of the present invention. As shown therein, device 10 comprises one or more ejectors 12 to which a propellant 14 is fed. A marking material 16, which can be transported by a transport 18 under the control of control 20, is introduced into ejector 12. (Optional elements are indicated by dashed lines.) The marking material is metered (that is controllably introduced) into the ejector by metering device 21, under control of control 22. The marking material ejected by ejector 12 can be subject to post ejection modification 23, optionally also part of device 10. Each of these elements will be described in further detail below. It will be appreciated that device 10 can form a part of a printer, for example of the type commonly attached to a computer network, personal computer or the like, part of a facsimile machine, part of a document duplicator, part of a labelling apparatus, or part of any other of a wide variety of marking devices.

Figure 2:
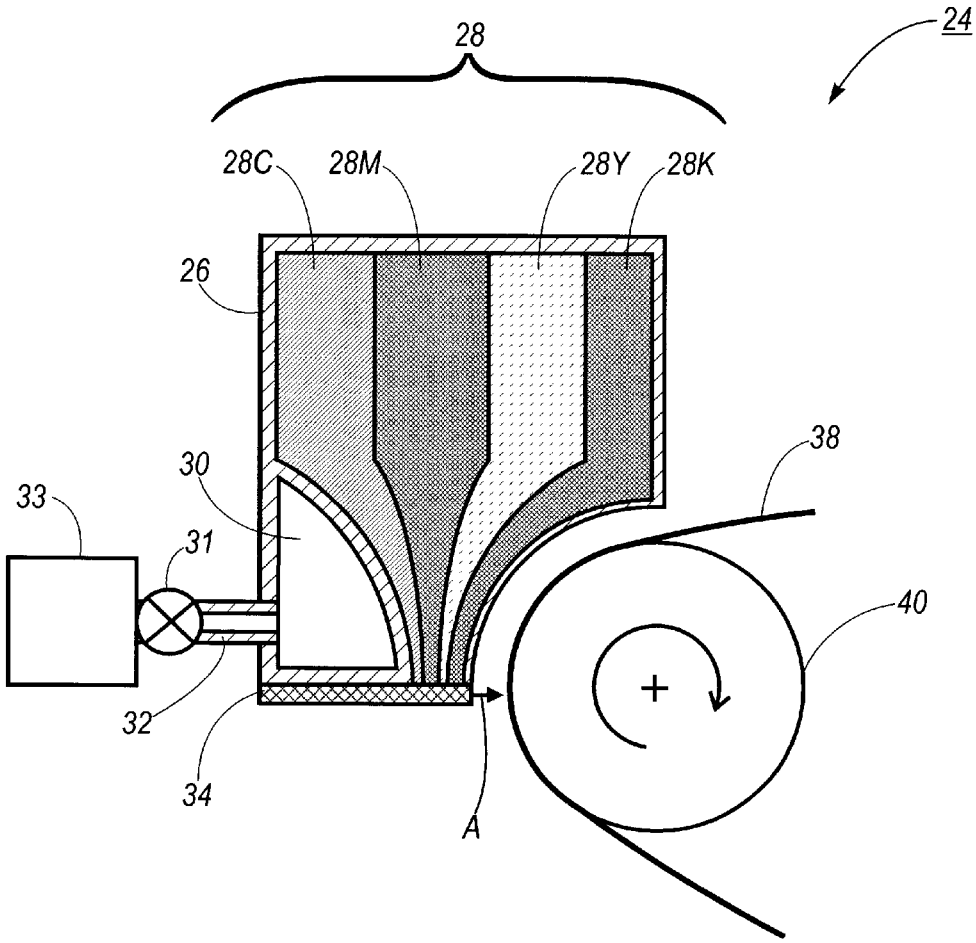
FIG. 2 is cross sectional illustration of a marking apparatus according to one embodiment of the present invention.

The embodiment illustrated in FIG. 1 can be realized by a ballistic aerosol marking device 24 of the type shown in the cut-away side view of FIG. 2. According to this embodiment, the materials to be deposited will be four colored marking materials, for example cyan (C), magenta (M), yellow (Y), and black (K), of a type described further herein, which can be deposited concomitantly, either mixed or unmixed, successively, or otherwise. While the illustration of FIG. 2 and the associated description contemplates a device for marking with four colors (either one color at a time or in mixtures thereof), a device for marking with a fewer or a greater number of colors, or other or additional materials, such as materials creating a surface for adhering marking material particles (or other substrate surface pretreatment), a desired substrate finish quality (such as a matte, satin or gloss finish or other substrate surface post-treatment), material not visible to the unaided eye (such as magnetic particles, ultra violet-fluorescent particles, and the like) or other material associated with a marked substrate, is clearly contemplated herein.

Device 24 comprises a body 26 within which is formed a plurality of cavities 28C, 28M, 28Y, and 28K (collectively referred to as cavities 28) for receiving materials to be deposited. Also formed in body 26 can be a propellant cavity 30. A fitting 32 can be provided for connecting propellant cavity 30 to a propellant source 33 such as a compressor, a propellant reservoir, or the like. Body 26 can be connected to a printhead 34, comprising, among other layers, substrate 36 and channel layer 37.

Figure 3:
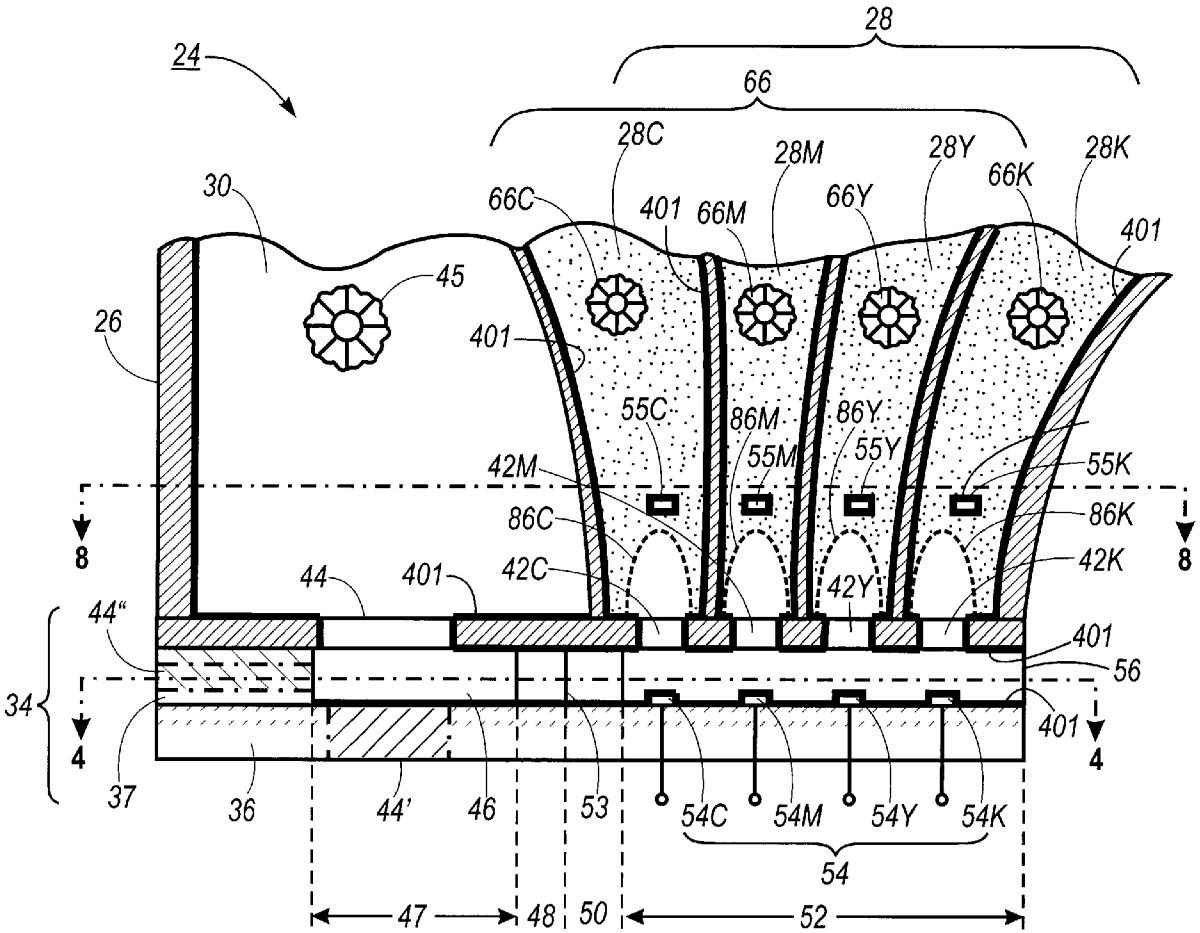
FIG. 3 is another cross sectional illustration of a marking apparatus according to one embodiment of the present invention.

With reference now to FIG. 3, shown therein is a cut-away cross section of a portion of device 24. Each of cavities 28 include a port 42C, 42M, 42Y, and 42K (collectively referred to as ports 42) respectively, of circular, oval, rectangular, or other cross-section, providing communication between said cavities, and a channel 46 which adjoins body 26. Ports 42 are shown having a longitudinal axis roughly perpendicular to the longitudinal axis of channel 46. The angle between the longitudinal axes of ports 42 and channel 46, however, can be other than 90 degrees, as appropriate for the particular application of the present invention.

Likewise, propellant cavity 30 includes a port 44, of circular, oval, rectangular, or other cross-section, between said cavity and channel 46 through which propellant can travel. Alternatively, printhead 34 can be provided with a port 44' in substrate 36 or port 44" in channel layer 37, or combinations thereof, for the introduction of propellant into channel 46. As will be described further below, marking material is caused to flow out from cavities 28 through ports 42 and into a stream of propellant flowing through channel 46. The marking material and propellant are directed in the direction of arrow A toward a substrate 38, for example paper, supported by a platen 40, as shown in FIG. 2. It has been demonstrated that a propellant marking material flow pattern from a printhead employing a number of the features described herein can remain relatively collimated for a distance of up to 10 millimeters, with an optimal printing spacing on the order of between one and several millimeters. For example, the printhead can produce a marking material stream which does not deviate by more than about 20 percent, and preferably by not more than about 10 percent, from the width of the exit orifice for a distance of at least 4 times the exit orifice width. The appropriate spacing between the printhead and the substrate, however, is a function of many parameters, and does not itself form a part of the present invention. In one specific embodiment, the kinetic energy of the particles, which are moving at very high velocities toward the substrate, is converted to thermal energy upon impact of the particles on the substrate, thereby fixing or fusing the particles to the substrate. In this embodiment, the glass transition temperature of the resin in the particles is selected so that the thermal energy generated by impact with the substrate is sufficient to fuse the particles to the substrate; this process is called kinetic fusing.

According to one embodiment of the present invention, printhead 34 comprises a substrate 36 and channel layer 37 in which is formed channel 46. Additional layers, such as an insulating layer, capping layer, or the like (not shown) can also form a part of printhead 34. Substrate 36 is formed of a suitable material such as glass, ceramic, or the like, on which (directly or indirectly) is formed a relatively thick material, such as a thick permanent photoresist (for example, a liquid photosensitive epoxy such as SU-8®, commercially available from Microlithography Chemicals, Inc. see also U.S. Pat. No. 4,882,245, the disclosure of which is totally incorporated herein by reference) and/or a dry film-based photoresist such as the RISTON® photopolymer resist series, commercially available from DuPont Printed Circuit Materials, Research Triangle Park, N.C. which can be etched, machined, or otherwise in which can be formed a channel with features described below. In one embodiment, subsequent to the formation of channel 46, substrate 34 can be surface treated with conductive polymer coating 401. In another embodiment, conductive polymer coating 401 can be applied to substrate 34 prior to or during formation of channel 46.

Figure 4:
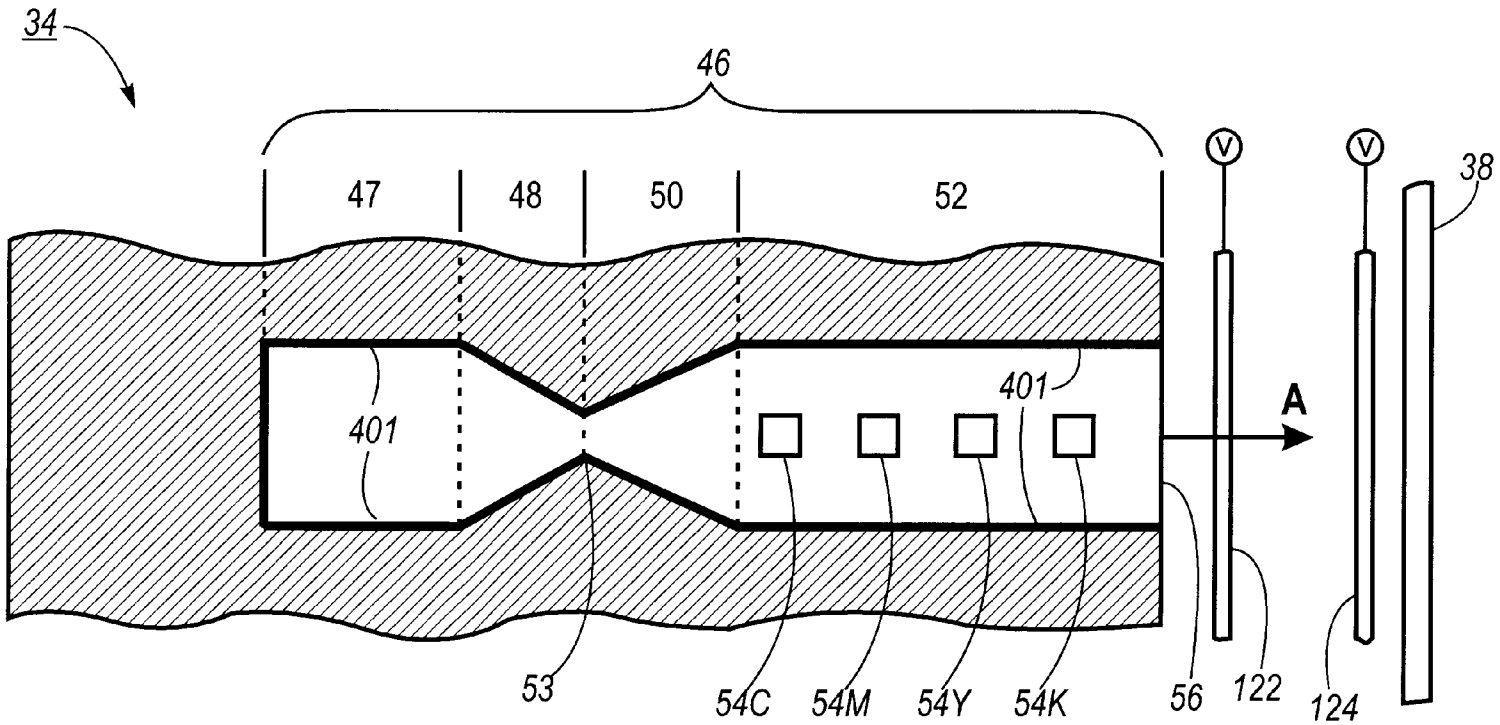
FIG. 4 is a plan view of one channel, with nozzle, of the marking apparatus shown in FIG. 3, FIGS. 5A through 5C and 6A through 6C are cross sectional views, in the longitudinal direction, of several examples of channels according to the present invention.

Referring now to FIG. 4, which is a cut-away plan view of printhead 34, in one embodiment channel 46 is formed to have at a first, proximal end a propellant receiving region 47, an adjacent converging region 48, a diverging region 50, and a marking material injection region 52. The point of transition between the converging region 48 and diverging region 50 is referred to as throat 53, and the converging region 48, diverging region 50, and throat 53 are collectively referred to as a nozzle. The general shape of such a channel is sometimes referred to as a de Laval expansion pipe or a Venturi convergence/divergence structure. An exit orifice 56 is located at the distal end of channel 46.

Figure 5A:
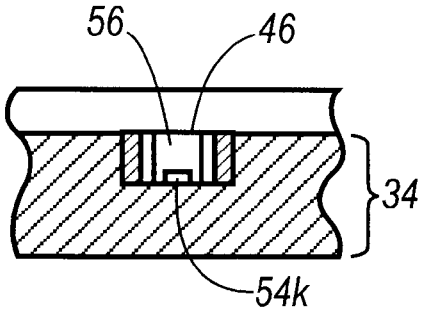
Figure 5B:
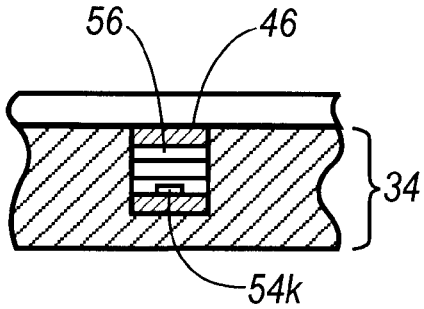
Figure 5C:
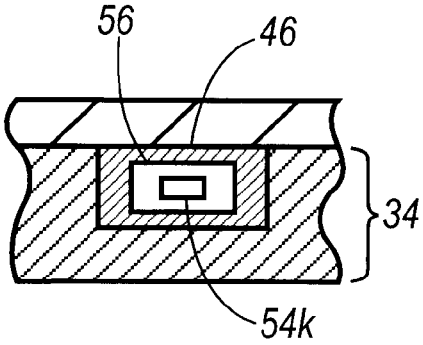
Figure 6A:
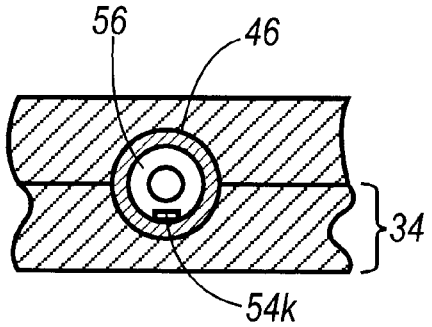
Figure 6B:
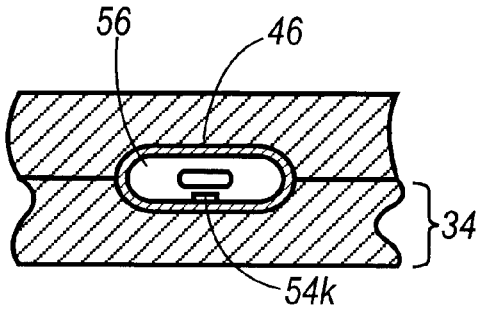
Figure 6C:
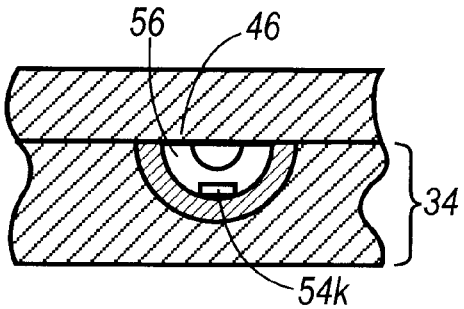

In the embodiment of the present invention shown in FIGS. 3 and 4, region 48 converges in the plane of FIG. 4, but not in the plane of FIG. 3, and likewise region 50 diverges in the plane of FIG. 4, but not in the plane of FIG. 3. Typically, this divergence determines the cross-sectional shape of the exit orifice 56. For example, the shape of orifice 56 illustrated in FIG. 5A corresponds to the device shown in FIGS. 3 and 4. However, the channel can be fabricated such that these regions converge/diverge in the plane of FIG. 3, but not in the plane of FIG. 4 (illustrated in FIG. 5B), or in both the planes of FIGS. 3 and 4 (illustrated in FIG. 5C), or in some other plane or set of planes, or in all planes (examples illustrated in FIGS. 6A through 6C) as can be determined by the manufacture and application of the present invention.

Figure 7:
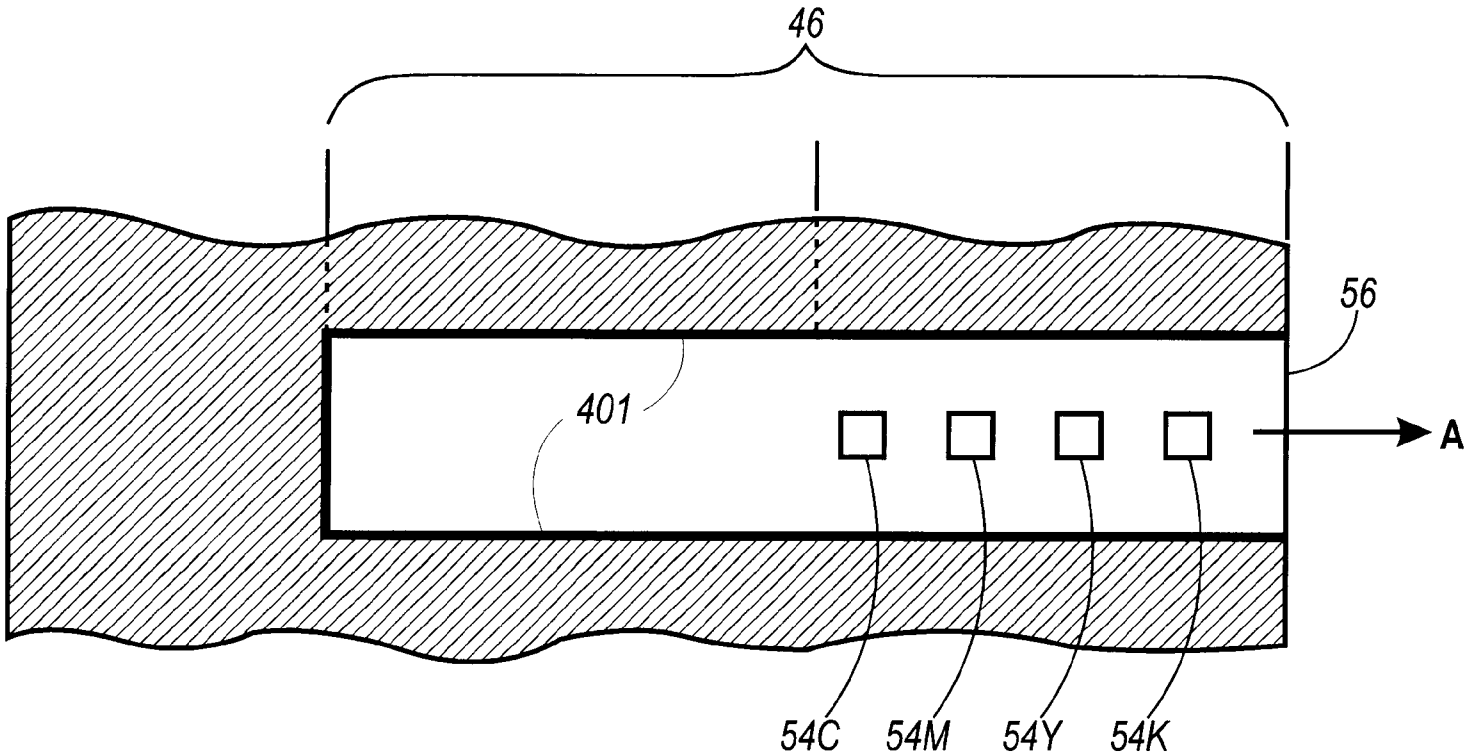
FIG. 7 is another plan view of one channel of a marking apparatus, without a nozzle, according to the present invention.
Figure 8A:
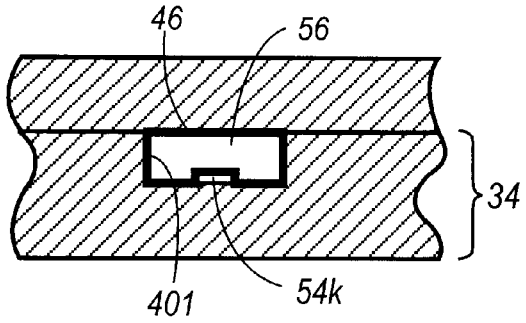
FIGS. 8A through 8D are cross sectional views, along the longitudinal axis, of several additional examples of channels according to the present invention.
Figure 8B:
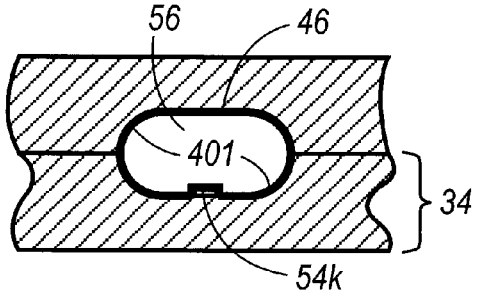
Figure 8C:
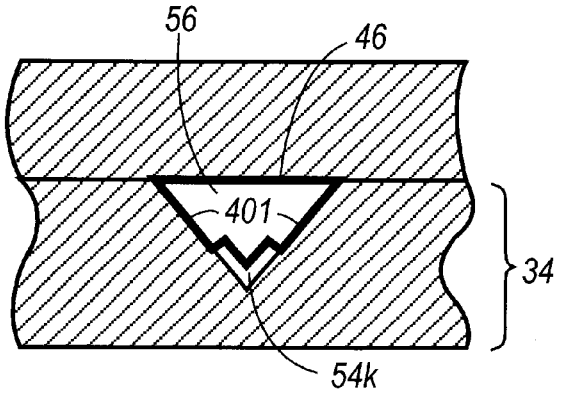
Figure 8D:
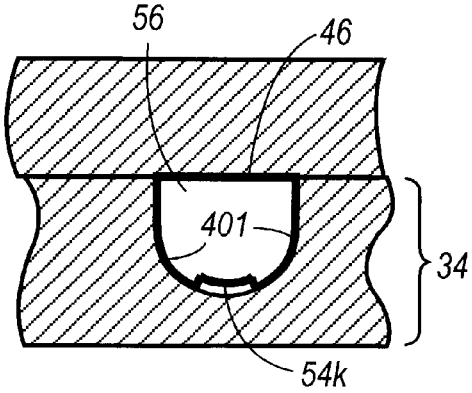

In another embodiment, shown in FIG. 7, channel 46 is not provided with a converging and diverging region, but rather has a uniform cross section along its axis. This cross section can be rectangular or square (illustrated in FIG. 8A), oval or circular (illustrated in FIG. 8B), or other cross section (examples are illustrated in FIGS. 8C and 8D), as can be determined by the manufacture and application of the present invention.

Referring again to FIG. 3, propellant enters channel 46 through port 44, from propellant cavity 30, roughly perpendicular to the long axis of channel 46. According to another embodiment, the propellant enters the channel parallel (or at some other angle) to the long axis of channel 46 by, for example, ports 44' or 44" or other manner not shown. The propellant can flow continuously through the channel while the marking apparatus is in an operative configuration (for example, a "power on" or similar state ready to mark), or can be modulated such that propellant passes through the channel only when marking material is to be ejected, as dictated by the particular application of the present invention. Such propellant modulation can be accomplished by a valve 31 interposed between the propellant source 33 and the channel 46, by modulating the generation of the propellant by, for example, turning on and off a compressor, or selectively initiating a chemical reaction designed to generate propellant, or the like.

Marking material can controllably enter the channel through one or more ports 42 located in the marking material injection region 52. That is, during use, the amount of marking material introduced into the propellant stream can be controlled from zero to a maximum per spot. The propellant and marking material travel from the proximal end to a distal end of channel 46 at which is located exit orifice 56.

According to one embodiment for metering the marking material, the marking material includes material which can be imparted with an electrostatic charge. For example, the marking material can comprise a pigment suspended in a binder together with charge directors. The charge directors can be charged, for example by way of a corona 66C, 66M, 66Y, and 66K (collectively referred to as coronas 66), located in cavities 28, shown in FIG. 3. Another option is initially to charge the propellant gas, for example, by way of a corona 45 in cavity 30 (or some other appropriate location such as port 44 or the like.) The charged propellant can be made to enter into cavities 28 through ports 42, for the dual purposes of creating a fluidized bed 86C, 86M, 86Y, and 86K (collectively referred to as fluidized bed 86), and imparting a charge to the marking material. Other options include tribocharging, by other means external to cavities 28, or other mechanism.

Formed at one surface of channel 46, opposite each of the ports 42 are electrodes 54C, 54M, 54Y, and 54K (collectively referred to as electrodes 54). Formed within cavities 28 (or some other location such as at or within ports 44) are corresponding counter-electrodes 55C, 55M, 55Y, and 55K (collectively referred to as counter-electrodes 55). When an electric field is generated by electrodes 54 and counter-electrodes 55, the charged marking material can be attracted to the field, and exits cavities 28 through ports 42 in a direction roughly perpendicular to the propellant stream in channel 46. The shape and location of the electrodes and the charge applied thereto determine the strength of the electric field, and accordingly determine the force of the injection of the marking material into the propellant stream.

In general, the force injecting the marking material into the propellant stream is chosen such that the momentum provided by the force of the propellant stream on the marking material overcomes the injecting force, and once into the propellant stream in channel 46, the marking material travels with the propellant stream out of exit orifice 56 in a direction toward the substrate.

In the event that fusing assistance is required (for example, when an elastic substrate is used, when the marking material particle velocity is low, or the like), a number of approaches can be employed. For example, one or more heated filaments 122 can be provided proximate the ejection port 56 (shown in FIG. 4), which either reduces the kinetic energy needed to melt the marking material particle or in fact at least partly melts the marking material particle in flight. Alternatively, or in addition to filament 122, a heated filament 124 can be located proximate substrate 38 (also shown in FIG. 4) to have a similar effect.

The conductive polymer coating 401 is preferably applied to the inner surface of each channel 46 in at least those areas thereof that come into contact with the marking material particles. Preferably, the conductive polymer coating is applied to all surfaces in the apparatus that will come into contact with the marking material, including the walls of cavities 28, the surface of the substrate 36, the surface of any portion of channel layer 37 that may contact the marking material particles, the surfaces of body 26 that define channel 46, the surfaces of ports 42, and the like. In addition, the conductive polymer coating can, if desired, also be applied to optional electrodes 54 and optional counter-electrodes 55. Preferably, the conductive polymer coating is also applied to any conduits or intermediate structures that might be situated between cavities 28 and channel 46. It is not necessary to apply conductive polymer coating 401 to those surfaces of the apparatus that do not come into contact with the marking material; for ease of application, however, the conductive polymer coating can, if desired, also be applied to other areas of the apparatus. For example, as shown in FIG. 3, conductive polymer coating 401 is unnecessary at port 44, inside cavity 30, or in channel 46 upstream of port 42C, but with commonly used coating methods, it may be easier to apply coating 401 to these areas than to leave them uncoated, and the coating 401 has no detrimental effect if applied in unneeded areas.

While FIGS. 4 to 8 illustrate a printhead 34 having one channel therein, it will be appreciated that a printhead according to the present invention can have an arbitrary number of channels, and range from several hundred microns across with one or several channels, to a page-width (for example, 8.5 or more inches across) with thousands of channels. The width W of each exit orifice 56 can be on the order of 250 microns or smaller, preferably in the range of 100 microns or smaller. The pitch P, or spacing from edge to edge (or center to center) between adjacent exit orifices 56 can also be on the order of 250 microns or smaller, preferably in the range of 100 microns or smaller in non-staggered array. In a two-dimensionally staggered array, the pitch can be further reduced.

Figure 9:
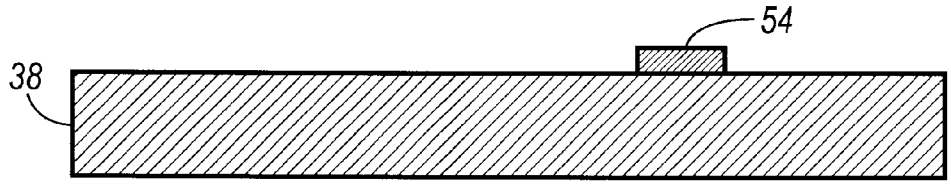
FIGS. 9 through 14 are illustrations of one process for producing a printhead according to the present invention.

Printhead 34 can be formed by one of a wide variety of methods. As an example, and with reference to FIGS. 9 through 14, printhead 34 can be manufactured as follows. Initially, a substrate 38, for example an insulating substrate such as glass or a semi-insulating substrate such as silicon, or alternatively an arbitrary substrate coated with an insulating layer, is cleaned and otherwise prepared for lithography. One or more metal electrodes 54 can be formed on (for example, photolithographically) or applied to a first surface of substrate 38, which shall form the bottom of a channel 46. This stage is illustrated in FIG. 9.

Figure 10:
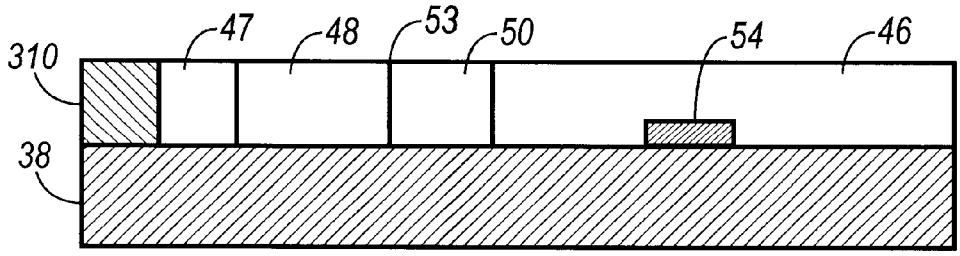
Figure 11:
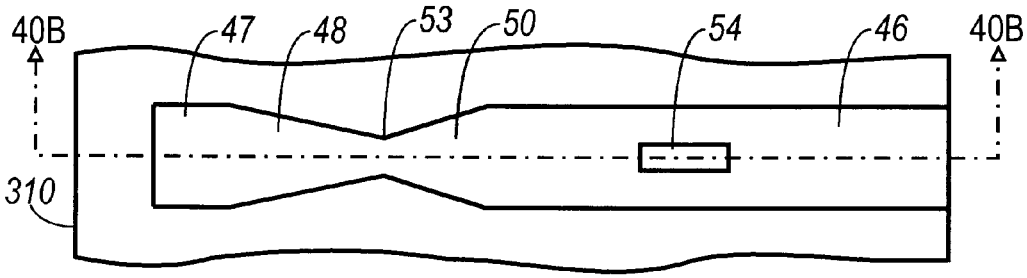

Next, a thick photoresist such as the aforementioned SU-8® is coated over substantially the entire substrate, typically by a spin-on process, although layer 310 can be laminated as an alternative. Layer 310 will be relatively quite thick, for example on the order of 100 microns or thicker. This stage is illustrated in FIG. 10. Well known processes such as lithography, ion milling, or the like, are next employed to form a channel 46 in layer 310, preferably with a converging region 48, diverging region 50, and throat 53. The structure at this point is shown in a plan view in FIG. 11.

At this point, one alternative is to machine an inlet 44' (shown in FIG. 3) for propellant through the substrate in propellant receiving region 47. This result can be accomplished by diamond drilling, ultrasonic drilling, or other techniques well known in the art as a function of the selected substrate material. Alternatively, a propellant inlet 44" (shown in FIG. 3) can be formed in layer 310. However, a propellant inlet 44 can be formed in a subsequently applied layer, as described following.

Figure 12:
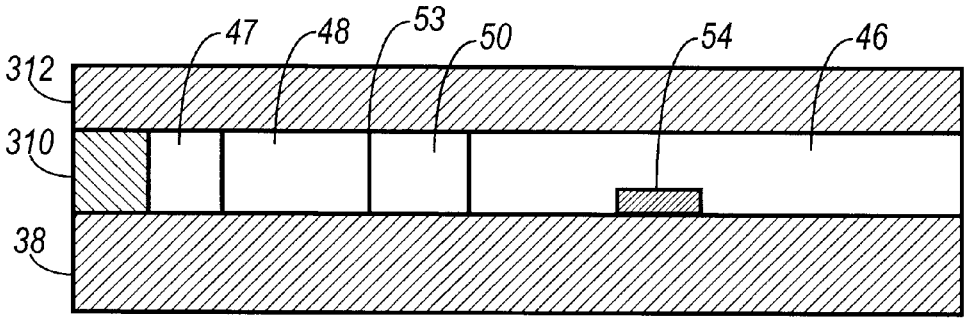

Applied directly on top of layer 310 is another relatively thick layer of photoresist 312, preferably the aforementioned RISTON® or similar material. Layer 312 is preferably on the order of 100 microns thick or thicker, and is preferably applied by lamination, although it can alternatively be spun on or otherwise deposited. Layer 312 can alternatively be glass (such as CORNING® 7740) or other appropriate material bonded to layer 310. The structure at this point is illustrated in FIG. 12.

Figure 13:
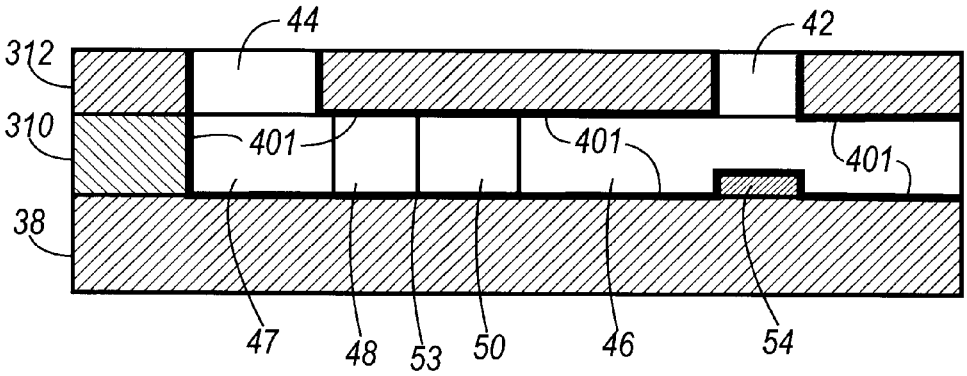

Layer 312 is then patterned, for example by photolithography, ion milling, or the like to form ports 42 and 44. Layer 312 can also be machined, or otherwise patterned by methods known in the art. The structure at this point is shown in FIG. 13.

At this point, conductive polymer coating 401 can be applied to the interior surfaces of the entire structure, including channel 46 and marking material ports 42.

One alternative to the above is to form channel 46 directly in the substrate, for example by photolithography, ion milling, or the like. Layer 312 can still be applied as described above, followed by the above described surface treatment with the conductive polymer coating. Still another alternative is to form the printhead from acrylic, or similar moldable and/or machinable material with channel 46 molded or machined therein. In addition to the above, layer 312 can also be a similar material in this embodiment, bonded to the remainder of the structure. In this embodiment, the interior surfaces of the structure such as channel 46 and marking material ports 42 can be surface treated after completion of the machining and bonding steps.

Figure 14:
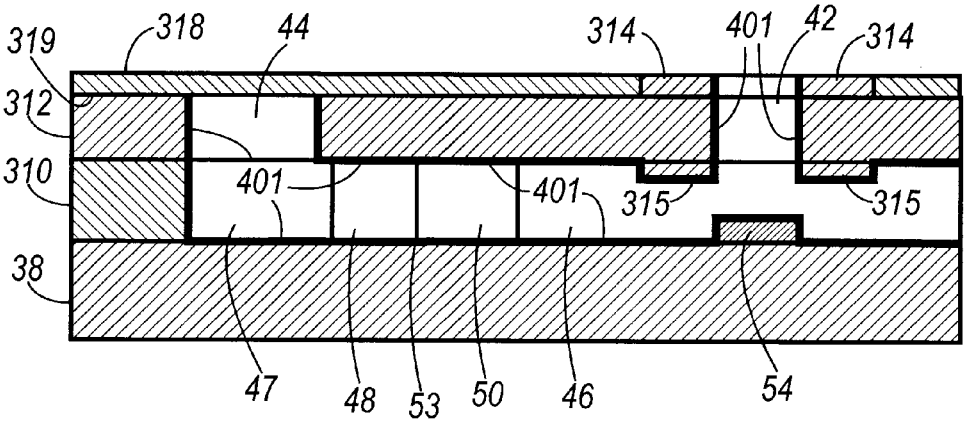

A supplement to the above is to preform electrodes 314 and 315, which can be rectangular, annular (shown), or other shape in plan form, on layer 312 prior to applying layer 312 over layer 310. In this embodiment, port 42, and possible port 44, will also be preformed prior to application of layer 312. Electrodes 314 can be formed by sputtering, lift-off, or other techniques, and can be any appropriate metal such as aluminum or the like. A dielectric layer 316 can be applied to protect the electrodes 314 and provide a planarized upper surface 318. A second dielectric layer (not shown) can similarly be applied to a lower surface 319 of layer 312 similarly to protect electrode 315 and provide a planarized lower surface. The structure of this embodiment is shown in FIG. 14. Alternatively, the second dielectric layer can be the conductive polymer coating, which can be applied to all of the interior surfaces of the device, including channel 46, marking material ports 42, and electrodes 315 and 54. In yet another embodiment, the conductive polymer surface treatment can be applied over the dielectric layer or layers.

The surfaces in the ballistic aerosol marking apparatus to be coated with the conductive polymer material are of any suitable material. Examples of suitable surface materials to be coated include silicon, silica (glass), crystalline silica (quartz), ceramics, polymers, metals, metal oxides, and the like. Specific examples of polymers include epoxies, photoresistive polymers, polymers containing vinyl or diene substituents, and polymers containing reactive side chain or terminal end groups, such as acid groups, ester groups, hydroxyl groups, cyano groups, or amine groups. Specific examples of metals include iron, titanium, nickel, copper, zirconium, aluminum, platinum, and gold.

For applying the conductive polymer coating to silicon surfaces, the silicon surface often contains surface hydroxyl groups that facilitate surface treatment. In other embodiments, the silicon surface can be pretreated by oxidation with any standard method known in the art preparatory to the above described surface conductive polymer treatment. As an example of a suitable oxidation pretreatment, the silicon can be first treated with a 3:1 mixture by weight of concentrated sulfuric acid and 3 weight percent hydrogen peroxide at about 100° C. for about 2 hours, followed by water rinsing, followed by treatment with a 1:1 mixture by weight of concentrated ammonium hydroxide and 30 weight percent hydrogen peroxide for about 15 minutes.

Also for a silicon substrate, the above oxidized surface can be treated further with 40 weight percent aqueous ammonium fluoride (for Si(111) surfaces) or 10 weight percent aqueous hydrofluoric acid (for Si(100) surfaces) to form Si—H moieties on the surface. The pretreated surface can then be heated with a diacyl peroxide (including fluorodiacyl peroxides) such as those of the general formula $(R—CO_2)_2$, wherein R is an alkyl or fluoroalkyl substituent, such as $—C_3F_7$, $H(CF_2)_4—$, $H_7C_3OCF(CF_3)—$, or the like, wherein the preparation is as described by Cheng Xue et al., Journal of Organic Chemistry, 47, 2009–2013 (1982), the disclosure of which is totally incorporated herein by reference). The resultant coating is a surface attached alkane or fluoroalkane. Alternatively, the pretreated surface with Si—H moieties can be treated by heating the substrate with an alkyl halide (said class of materials including fluoroalkyl halides), preferably a fluoroalkyl iodide, such as perfluoroethyl iodide, perfluorohexyl iodide, or perfluorodecyl iodide, available from Aldrich Chemical Company, under pressure or in vacuum. The resultant coating is a surface attached alkane or fluoroalkane.

For conductive polymer treatment of polymers containing reactive vinyl or diene groups, the polymer can be treated by heating the substrate and an alkyl or fluoroalkyl halide, preferably a fluoroalkyl iodide, such as perfluoroethyl iodide, perfluorobutyl iodide, perfluorohexyl iodide, or perfluorodecyl iodide, available from Aldrich Chemical Company, under pressure or in vacuum. The resultant coating is a surface grafted alkane or fluoroalkane. In embodiments wherein the conductive polymer is a polythiophene or polypyrrole, the iodide on the coating can also function as a dopant. This approach provides a rich doping anion surface nicely set up for the coating of the intrinsically conductive polymer without having to add more dopant, since it is already present.

For conductive polymer treatment of polymers containing hydroxyl groups, the polymer can be treated by heating the substrate with an acid halide of the formula R—(CO)—X, wherein R is an alkyl or fluoroalkyl group and X is a halogen atom or an anion of an organic acid, such as sulfonate, with specific examples of compounds including heptafluorobutyryl chloride or butanoyl chloride, available from Aldrich Chemical Co. The resultant coating is a surface attached alkane or fluoroalkane moiety bound to the surface through the carbon atom of the CO group. The chloride or organic acid anion can also function as a dopant in embodiments wherein the conductive polymer is a polythiophene or polypyrrole. This approach provides a rich doping anion surface nicely set up for the coating of the intrinsically conductive polymer without having to add more dopant, since it is already present.

For conductive polymer treatment of metal surfaces, the metal surface can be treated by exposure of the metal surface at room temperature or at elevated temperature to an alkyl thiol (said class of materials including fluoroalkyl thiols), such as butanethiol, heptanethiol, or decanethiol, available from Aldrich Chemical Company. The resultant coating is a surface attached alkane or fluoroalkane bound to the surface through a sulfur atom.

The conductive polymer coating can be applied to the apparatus and to the marking material of the present invention by any desired or suitable process. For example, the conductive polymer coating can be applied via a solution coating process, wherein the conductive polymer material or its precursor is added to a solvent and the solution thus formed is applied to the surface(s) to be coated. The marking material particles and/or the additive particles can be solution coated with the conductive polymer material by dispersing the marking material particles or additive particles in a suitable solvent, thereafter adding the conductive polymer material or its precursor to the solution, and agitating the solution, optionally followed by filtering and washing the coated particles. In one embodiment, 100 parts by weight of marking material particles or additive particles are admixed typically with from about 200 to about 2,000 parts by weight solvent, and typically with from about 1 to about 100 parts by weight, preferably from about 5 to about 40 parts by weight, of the selected conductive polymer coating or its precursor, followed by mixing, typically at from about 50 to about 500 revolutions per minute at a temperature typically of from about 10 to about 100° C., and preferably from about 15 to about 50° C., for a period typically of from about 0.25 to about 5 hours, and preferably from about 0.5 to about 2 hours, although the relative amounts, mixing speed, mixing time, and mixing temperature can be outside of these ranges. The resulting slurry is then filtered by any suitable method, such as vacuum filtration or the like. The particle filter cake thus obtained is then washed, typically from about 1 to about 10 times, with typically from about 50 to about 1,000 parts by weight of a solvent, such as methylene chloride, and subsequently dried by any desired method, such as a vacuum oven, a convection oven, a fluidized bed dryer, or the like. Suitable solvents include those sufficient to disperse the particles in typical relative amounts of, for example, from about 2 about 20 parts by weight solvent, and preferably from about 5 to about 10 parts by weight solvent, per one part by weight of the particles. Examples of suitable solvents include water, toluene, benzene, alcohols, such as methanol, ethanol, n-propanol, isopropanol, butanol, and the like, methyl ethyl ketone, ethyl acetate, methylene chloride, pentane, hexane, heptane, cyclohexane, and the like.

For conductive polymers that can be prepared by oxidative polymerization, the conductive polymer material can be coated onto the inner surfaces of the marking apparatus by coating or spin deposition of a solution containing the precursor monomers, oligomers, or polymers, the oxidant, and optionally a dopant onto the marking apparatus surfaces. Subsequent to evaporation of the solvent, the polymer thus formed will render the surfaces to which it was applied conductive or semiconductive. Solutions containing colloidal dispersions of the conductive polymer can also be applied to the surfaces of the marking apparatus, followed by evaporation of the solvent to form a coating of the conductive polymer.

In addition, the conductive polymer coating can be applied to the apparatus and to the marking material of the present invention by a gas phase coating process. The marking material particles and/or the additive particles can be gas phase coated with the conductive polymer material by adding the particles to a suitable reactor, such as a stainless steel stirred tank reactor, a tubular reactor, a packed column reactor, a tower reactor, or the like, and adding to the reactor a vapor of the conductive polymer material or its precursor under vacuum with optional application of heat, alternatively, instead of adding the conductive polymer material or its precursor under vacuum, the conductive polymer material or its precursor can be added with a carrier gas, such as dry air, nitrogen, or the like, and the gas and/or precursor and/or substrate can be optionally heated. In either of these embodiments, the reactor contents or the substrate can be optionally heated, optionally in vacuum, to complete the curing of the conductive polymer coating and/or to remove any volatile side products of the treatment process. In one embodiment of the gas phase process, about 100 parts by weight of particles are loaded into a reactor vessel. The conductive polymer material or its precursor, typically from about 1 to about 100 parts by weight, is loaded into a separate vessel. If a carrier gas is to be used, the outlet of the conductive polymer material vessel is connected to the inlet of the reactor. The inlet of the conductive polymer material vessel is connected to an air source and air is passed through the conductive polymer material or its precursor until all of the material is volatilized and carried through the reactor containing the particles. The relative humidity of the air stream preferably is controlled in the range of from 0 to about 50 percent relative humidity, and preferably from about 1 to about 25 percent relative humidity. This step typically takes from about 0.25 to about 5 hours. If a vacuum process is to be used, the outlet of the conductive polymer material vessel is connected to the inlet of the reactor. Both vessels are connected to a vacuum source, creating a vacuum of from about $10^{-3}$ to about $10^{+1}$ Torr in the two vessels, thereby causing the conductive polymer material or its precursor to be volatilized and carried into the reactor containing the particles to be coated. This step typically takes from about 0.25 to about 10 hours. For both gas phase processes, it is preferable, although not essential, to have mixing in the reactor during the coating process, with, for example, a mechanical agitator, grinding media, turbulent flow of the carrier gas in column or tower type reactors, or the like. Temperatures typically are from about 10 to about 100° C., and preferably from about 15 to about 50° C. The relative amounts, times, temperatures, relative humidities, and pressures can, however, be outside of the indicated ranges.

The apparatus of the present invention can also be coated by solution coating or gas phase coating processes similar to those employed to coat the marking materials.

The conductive polymer coating is present on the inner channel surfaces of the apparatus of the present invention in any desired or suitable dry thickness, typically from about 0.2 nanometer to about 5 microns, and preferably from about 0.5 nanometer to about 2 microns, although the thickness can be outside of these ranges.

In embodiments wherein the marking particles also contain a conductive polymer, the conductive polymer coating is present on the marking material particles and/or the additive particles of the present invention in any desired or suitable coating weight, typically from about 0.2 to about 70 percent by weight of the coated particles, and preferably from about 1 to about 40 percent by weight of the coated particles, although the coating weight can be outside of these ranges.

Further information and details regarding solution coating and gas phase coating of materials onto substrates such as marking particles or additive particles is disclosed in, for example, U.S. Pat. No. 5,484,675 and U.S. Pat. No. 5,376,172, the disclosures of each of which are totally incorporated herein by reference.

The conductive polymer can also be applied to the inner surfaces of the marking apparatus by in situ polymerization. In this embodiment, the precursor monomers, oligomers, or polymers are dissolved in a solvent and are exposed to an oxidizing agent and, if present, a dopant, followed by subsequent removal of the solvent upon completion of polymerization. This method is similar to that described hereinbelow with respect to methods for polymerizing conductive materials such as polythiophenes and polypyrroles onto marking particle surfaces.

The conductive polymer can also be applied to the inner surfaces of the marking apparatus by electrochemical polymerization in an electrochemical cell. In this embodiment, a solution containing the precursor monomers, oligomers, or polymers in a solvent, such as acetonitrile or the like, containing a salt, such as tetrphenylphosphonium chloride ($Ph_4P^+Cl^-$) or the like, are situated in the presence of an anode and cathode, and voltage is applied from a power supply, such as a 1.5 V battery. For the electrochemical polymerization method of applying the conductive polymer onto the inner surfaces of the marking apparatus, the inner surfaces of the apparatus are the receiving surface where the electrochemical polymerized polymer is deposited. This method can produce very thin and even films onto the desired surface. Further information on electrochemical polymerization is provided in, for example, *Handbook of Conductive Polymers*, $2^{nd}$ edition, edited by T. A. Skotheim, R. L. Elsenbaumer, J. R. Reynolds, the disclosure of which is totally incorporated herein by reference, Chapter 20: Electrochemistry of Conductive Polymers, by K. Doblhofer and K. Rajeshwar, Marcel Bekker, Inc. (1998) and all of the references cited therein.

The marking materials of the present invention comprise particles typically having an average particle diameter of no more than about 17 microns, preferably no more than about 15 microns, more preferably no more than about 14 microns, even more preferably no more than about 10 microns, still more preferably no more than about 7 microns, and yet more preferably no more than about 6.5 microns, although the particle size can be outside of these ranges, and typically have a particle size distribution of GSD equal to no more than about 1.45, preferably no more than about 1.38, more preferably no more than about 1.35, even more preferably no more than about 1.25, still more preferably no more than about 1.23, and yet more preferably no more than about 1.20, although the particle size distribution can be outside of these ranges. When the marking particles are made by an emulsion aggregation process, the marking materials of the present invention comprise particles typically having an average particle diameter of no more than about 13 microns, preferably no more than about 12 microns, more preferably no more than about 10 microns, and even more preferably no more than about 7 microns, although the particle size can be outside of these ranges, and typically have a particle size distribution of GSD equal to no more than about 1.25, preferably no more than about 1.23, and more preferably no more than about 1.20, although the particle size distribution can be outside of these ranges.

In a specific embodiment of the present invention, either (i) the marking material particles of particulate marking material have either an outer coating of the conductive polymer or the conductive polymer distributed throughout, including on the marking particle surfaces; or (ii) the marking material particles have additive particles on the surface thereof, said additive particles having either an outer coating of the conductive polymer or the conductive polymer distributed throughout, including on the additive particle surfaces; or (iii) both the marking material particles and the additive particles have either an outer coating of the conductive polymer or the conductive polymer distributed throughout, including on the particle surfaces. In some of these embodiments, larger particles can be preferred even for those marking materials made by emulsion aggregation processes, such as particles of between about 7 and about 13 microns, because in these instances the marking particle surface area is relatively less with respect to particle mass and accordingly a lower amount by weight of conductive polymer with respect to marking particle mass can be used to obtain the desired particle conductivity or charging, resulting in a thinner shell of the conductive polymer and thus a reduced effect on the color of the marking material. The marking material particles comprise a resin and an optional colorant, said marking particles either having incorporated therein or having coated thereon a conductive polymer.

The marking particles of the present invention comprise a resin and an optional colorant. Typical resins include polyesters, such as those disclosed in U.S. Pat. No. 3,590,000, the disclosure of which is totally incorporated herein by reference, polyamides, epoxies, polyurethanes, diolefins, vinyl resins, and polymeric esterification products of a dicarboxylic acid and a diol comprising a diphenol. Examples of vinyl monomers include styrene, p-chlorostyrene, vinyl naphthalene, unsaturated monoolefins such as ethylene, propylene, butylene, isobutylene, and the like; vinyl halides such as vinyl chloride, vinyl bromide, vinyl fluoride, vinyl acetate, vinyl propionate, vinyl benzoate, and vinyl butyrate; vinyl esters such as esters of monocarboxylic acids, including methyl acrylate, ethyl acrylate, n-butyl acrylate, isobutyl acrylate, dodecyl acrylate, n-octyl acrylate, 2-chloroethyl acrylate, phenyl acrylate, methylalpha-chloroacrylate, methyl methacrylate, ethyl methacrylate, butyl methacrylate, and the like; acrylonitrile, methacrylonitrile, acrylamide, vinyl ethers, including vinyl methyl ether, vinyl isobutyl ether, and vinyl ethyl ether; vinyl ketones such as vinyl methyl ketone, vinyl hexyl ketone, and methyl isopropenyl ketone; N-vinyl indole and N-vinyl pyrrolidene; styrene butadienes, including those disclosed in U.S. Pat. No. 4,560,635, the disclosure of which is totally incorporated herein by reference; mixtures of these monomers; and the like. Mixtures of two or more polymers can also constitute the resin. The resin is present in the marking material in any effective amount, typically from about 75 to about 99 percent by weight, preferably from about 90 to about 98 percent by weight, and more preferably from about 95 to about 96 percent by weight, although the amount can be outside of these ranges.

Examples of suitable colorants include dyes and pigments, such as carbon black (for example, REGAL 330®), magnetites, phthalocyanines, HELIOGEN BLUE L6900, D6840, D7080, D7020, PYLAM OIL BLUE, PYLAM OIL YELLOW, and PIGMENT BLUE 1, all available from Paul Uhlich & Co., PIGMENT VIOLET 1, PIGMENT RED 48, LEMON CHROME YELLOW DCC 1026, E.D. TOLUIDINE RED, and BON RED C, all available from Dominion Color Co., NOVAPERM YELLOW FGL and HOSTAPERM PINK E, available from Hoechst, CINQUASIA MAGENTA, available from E.I. DuPont de Nemours & Company, 2,9-dimethyl-substituted quinacridone and anthraquinone dyes identified in the Color Index as CI 60710, CI Dispersed Red 15, diazo dyes identified in the Color Index as CI 26050, CI Solvent Red 19, copper tetra(octadecyl sulfonamido)phthalocyanine, x-copper phthalocyanine pigment listed in the Color Index as CI 74160, CI Pigment Blue, Anthrathrene Blue, identified in the Color Index as CI 69810, Special Blue X-2137, diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, Permanent Yellow FGL, Pigment Yellow 74, B 15:3 cyan pigment dispersion, commercially available from Sun Chemicals, Magenta Red 81:3 pigment dispersion, commercially available from Sun Chemicals, Yellow 180 pigment dispersion, commercially available from Sun Chemicals, colored magnetites, such as mixtures of MAPICO BLACK® and cyan components, and the like, as well as mixtures thereof. Other commercial sources of pigments available as aqueous pigment dispersion from either Sun Chemical or Ciba include (but are not limited to) Pigment Yellow 17, Pigment Yellow 14, Pigment Yellow 93, Pigment Yellow 74, Pigment Violet 23, Pigment Violet 1, Pigment Green 7, Pigment Orange 36, Pigment Orange 21, Pigment Orange 16, Pigment Red 185, Pigment Red 122, Pigment Red 81:3, Pigment Blue 15:3, and Pigment Blue 61, and other pigments that enable reproduction of the maximum Pantone color space. Mixtures of colorants can also be employed. When present, the optional colorant is present in the marking material in any desired or effective amount, typically at least about 1 percent by weight of the marking material, and preferably at least about 2 percent by weight of the marking material, and typically no more than about 25 percent by weight of the marking material, and preferably no more than about 15 percent by weight of the marking material, depending on the desired particle size, although the amount can be outside of these ranges.

The marking material can be prepared by any suitable method. For example, the components of the marking material can be mixed in a ball mill, to which steel beads for agitation are added in an amount of approximately five times the weight of the marking material. The ball mill can be operated at about 120 feet per minute for about 30 minutes, after which time the steel beads are removed, Another method, known as spray drying, entails dissolving the appropriate polymer or resin in an organic solvent such as toluene or chloroform, or a suitable solvent mixture. The optional colorant is also added to the solvent. Vigorous agitation, such as that obtained by ball milling processes, assists in assuring good dispersion of the components. The solution is then pumped through an atomizing nozzle while using an inert gas, such as nitrogen, as the atomizing agent. The solvent evaporates during atomization, resulting in marking particles which are then attrited and classified by particle size. Particle diameter of the resulting marking material varies, depending on the size of the nozzle, and generally varies between about 0.1 and about 100 microns.

Another suitable process is known as the Banbury method, a batch process wherein the marking material ingredients are pre-blended and added to a Banbury mixer and mixed, at which point melting of the materials occurs from the heat energy generated by the mixing process. The mixture is then dropped into heated rollers and forced through a nip, which results in further shear mixing to form a large thin sheet of the marking material. This material is then reduced to pellet form and further reduced in size by grinding or jetting, after which the particles are classified by size.

Another suitable marking material preparation process, extrusion, is a continuous process that entails dry blending the marking material ingredients, placing them into an extruder, melting and mixing the mixture, extruding the material, and reducing the extruded material to pellet form. The pellets are further reduced in size by grinding or jetting, and are then classified by particle size, Encapsulated marking materials for the present invention can also be prepared. For example, encapsulated marking materials can be prepared by an interfacial/free-radical polymerization process in which the shell formation and the core formation are controlled independently. The core materials selected for the marking material are blended together, followed by encapsulation of these core materials within a polymeric material, followed by core monomer polymerization. The encapsulation process generally takes place by means of an interfacial polymerization reaction, and the optional core monomer polymerization process generally takes by means of a free radical reaction. Processes for preparing encapsulated marking materials by these processes are disclosed in, for example, U.S. Pat. No. 4,000,087, U.S. Pat. No. 4,307,169, U.S. Pat. No. 4,725,522, U.S. Pat. No. 4,727,011, U.S. Pat. No. 4,766,051, U.S. Pat. No. 4,851,318, U.S. Pat. No. 4,855,209, and U.S. Pat. No. 4,937,167, the disclosures of each of which are totally incorporated herein by reference. In this embodiment, the oxidation/reduction polymerization is performed at room temperature after the interfacial/free-radical polymerization process is complete, thereby forming an intrinsically conductive polymeric shell on the particle surfaces.

Marking materials for the present invention can also be prepared by an emulsion aggregation process, as disclosed in, for example, U.S. Pat. No. 5,278,020, U.S. Pat. No. 5,290,654, U.S. Pat. No. 5,308,734, U.S. Pat. No. 5,344,738, U.S. Pat. No. 5,346,797, U.S. Pat. No. 5,348,832, U.S. Pat. No. 5,364,729, U.S. Pat. No. 5,366,841, U.S. Pat. No. 5,370,963, U.S. Pat. No. 5,376,172, U.S. Pat. No. 5,403,693, U.S. Pat. No. 5,405,728, U.S. Pat. No. 5,418,108, U.S. Pat. No. 5,496,676, U.S. Pat. No. 5,501,935, U.S. Pat. No. 5,527,658, U.S. Pat. No. 5,585,215, U.S. Pat. No. 5,593,807, U.S. Pat. No. 5,604,076, U.S. Pat. No. 5,648,193, U.S. Pat. No. 5,650,255, U.S. Pat. No. 5,650,256, U.S. Pat. No. 5,658,704, U.S. Pat. No. 5,660,965, U.S. Pat. No. 5,840,462, U.S. Pat. No. 5,853,944, U.S. Pat. No. 5,869,215, U.S. Pat. No. 5,869,216, U.S. Pat. No. 5,910,387, U.S. Pat. No. 5,916,725, U.S. Pat. No. 5,919,595, U.S. Pat. No. 5,922,501, U.S. Pat. No. 5,945,245, U.S. Pat. No. 6,017,671, U.S. Pat. No. 6,020,101, U.S. Pat. No. 6,054,240, U.S. Pat. No. 6,210,853, U.S. Pat. No. 6,143,457, and U.S. Pat. No. 6,132,924, the disclosures of each of which are totally incorporated herein by reference.

Any other desired or suitable method can also be used to form the marking material.

In embodiments wherein the marking particles are treated with surface additives, examples of surface additives include metal salts, metal salts of fatty acids, colloidal silicas, AEROSIL R812® silica, available from Degussa, zinc stearate, and the like, as well as mixtures thereof. Also suitable are conductive metal oxides. The conductive metal oxide can be a conductive titanium dioxide ($TiO_2$), including a metatitanic acid type and also those in the anatase, rutile, or amorphous forms. Other suitable conductive metal oxides include doped conductive tin oxides ($SnO_2$), such as Tego Conduct Ultra and Tego Conduct S, available from Goldshmidt Industrial Chemical Corporation, and SN-100P from Ishihara Sangyo Kaisha, LTD. Japan. Also suitable are antimony-doped tin oxides, such as EC-100, EC-210, EC-300, and EC-650. Also suitable are aluminum oxide ($Al^2O_3$) incorporating silicon dioxide ($SiO_2$), such as ST-490C, and silicon dioxide treated with, for example, n-butyl trimethoxysilane (STT-30A), all available from Titan Kogyo Kabushiki Kaisha, Tokio-Japan (IK Inabata America Corporation, New York). If desired, these surface additives can be surface treated by methods described in, for example, Copending application U.S. Ser. No. 09/863,032, filed May 22, 2001, entitled "Marking Material and Ballistic Aerosol Marking Process for the Use Thereof," with the named inventors Maria N. V. McDougall, Richard P. N. Veregin, and Karen A. Moffat, the disclosure of which is totally incorporated herein by reference. Examples of suitable commercially available surface treated conductive titanium dioxide particles include (but are not limited to) STT-30A, STT-30A-I, STT-A11-I, STT100H, STT-100HF10, and STT-100HF20, all available from Titan Kogyo Kabushiki Kaisha, Tokio-Japan (IK Inabata America Corporation, New York). The conductive metal oxide particles can also be treated with the materials and by the methods disclosed in, for example, U.S. Pat. No. 5,376,172, U.S. Pat. No. 5,484,675, and U.S. Pat. No. 6,309,042, the disclosures of each of which are totally incorporated herein by reference. External additives are present in any desired or effective amount, typically at least about 0.1 percent by weight of the marking particles, and typically no more than about 2 percent by weight of the marking particles, although the amount can be outside of this range, as disclosed in, for example, U.S, Pat. No. 3,590,000, U.S. Pat. No. 3,720,617, U.S. Pat. No. 3,655,374 and U.S. Pat. No. 3,983,045, the disclosures of each of which are totally incorporated herein by reference. The external additives can be added during the aggregation process when the marking particles are prepared by an emulsion aggregation process; for all types of marking particles, the surface additives can also be blended onto the formed particles. Mixing can be done by any suitable dry mixing process; one preferred mixing process provides high shear by the use of an impeller blade. Examples of dry mixing processes are for example by roll mill, media mill, paint shaker, Henschel blender, and the like.

In a specific embodiment, the marking material particles of the present invention have either incorporated therein or coated thereon a conductive polymer. In this embodiment, the conductive polymer can be either the same as or different from the conductive polymer coated on the inner surfaces of the marking apparatus.

In embodiments wherein the marking particles and/or surface additive particles contain a conductive material, the marking material typically has an average bulk conductivity of from about $10^{-11}$ to about 10 Siemens per centimeter, and preferably from about $10^{-11}$ to about $10^{-7}$ Siemens per centimeter, although the conductivity can be outside of this range. "Average bulk conductivity" refers to the ability for electrical charge to pass through a pellet of the marking material, measured when the pellet is placed between two electrodes. The marking material conductivity can be adjusted by various synthetic parameters of the polymerization; reaction time, molar ratios of oxidant and dopant to thiophene or pyrrole monomer, temperature, and the like.

The coatings employed in the apparatus, and, in some specific embodiments, the materials contained in or on the marking material of the present invention, can be any suitable conductive polymer material. Suitable conductive polymer materials include (but are not limited to) those that contain a conjugated aromatic polymer backbone which can allow the flow of electrical charge along the linear backbone. The polymer chain length is long enough to enable charge dissipation; typical general minimum repeat monomer units are 6 or 8, although the minimum number of repeat monomer units can be outside of this range. Examples of suitable conductive polymers include polythiophenes, polypyrroles, polyaniline, poly(para-phenylene)s, polyisothianaphthenes, and other types of intrinsically conductive polymers that can be coated onto a surface and that are not oxygen sensitive or moisture sensitive after surface treatment and isolation.

One class of suitable conductive polymer materials is that of polythiophenes. Examples of suitable thiophenes include those of the general formula

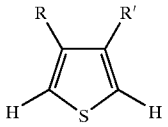

(shown in the reduced form) wherein R and R' each, independently of the other, is a hydrogen atom, an alkyl group, including linear, branched, saturated, unsaturated, cyclic, and substituted alkyl groups, typically with from 1 to about 20 carbon atoms and preferably with from 1 to about 16 carbon atoms, although the number of carbon atoms can be outside of these ranges, an alkoxy group, including linear, branched, saturated, unsaturated, cyclic, and substituted alkoxy groups, typically with from 1 to about 20 carbon atoms and preferably with from 1 to about 16 carbon atoms, although the number of carbon atoms can be outside of these ranges, an aryl group, including substituted aryl groups, typically with from 6 to about 16 carbon atoms, and preferably with from 6 to about 14 carbon atoms, although the number of carbon atoms can be outside of these ranges, an aryloxy group, including substituted aryloxy groups, typically with from 6 to about 17 carbon atoms, and preferably with from 6 to about 15 carbon atoms, although the number of carbon atoms can be outside of these ranges, an arylalkyl group or an alkylaryl group, including substituted arylalkyl and substituted alkylaryl groups, typically with from 7 to about 20 carbon atoms, and preferably with from 7 to about 16 carbon atoms, although the number of carbon atoms can be outside of these ranges, an arylalkyloxy or an alkylaryloxy group, including substituted arylalkyloxy and substituted alkylaryloxy groups, typically with from 7 to about 21 carbon atoms, and preferably with from 7 to about 17 carbon atoms, although the number of carbon atoms can be outside of these ranges, a heterocyclic group, including substituted heterocyclic groups, wherein the hetero atoms can be (but are not limited to) nitrogen, oxygen, sulfur, and phosphorus, typically with from about 4 to about 6 carbon atoms, and preferably with from about 4 to about 5 carbon atoms, although the number of carbon atoms can be outside of these ranges, wherein the substituents on the substituted alkyl, alkoxy, aryl, aryloxy, arylalkyl, alkylaryl, arylalkyloxy, alkylaryloxy, and heterocyclic groups can be (but are not limited to) hydroxy groups, halogen atoms, amine groups, imine groups, ammonium groups, cyano groups, pyridine groups, pyridinium groups, ether groups, aldehyde groups, ketone groups, ester groups, amide groups, carbonyl groups, thiocarbonyl groups, sulfate groups, sulfonate groups, sulfide groups, sulfoxide groups, phosphine groups, phosphonium groups, phosphate groups, nitrile groups, mercapto groups, nitro groups, nitroso groups, sulfone groups, acyl groups, acid anhydride groups, azide groups, mixtures thereof, and the like, as well as mixtures thereof, and wherein two or more substituents can be joined together to form a ring. One example of a suitable thiophene is simple thiophene, of the formula

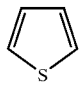

(shown in the reduced form). The polymerized thiophene (shown in the reduced form) is of the formula

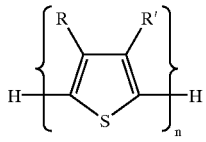

wherein R and R' are as defined above and n is an integer representing the number of repeat monomer units.

One particularly preferred class of thiophenes is that of 3,4-ethylenedioxythiophenes. A poly(3,4-ethylenedioxythiophene), in its reduced form, is of the formula

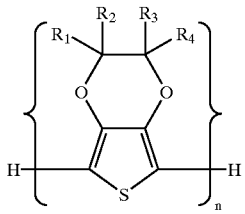

wherein each of $R_1$, $R_2$, $R_3$, and $R_4$, independently of the others, is a hydrogen atom, an alkyl group, including linear, branched, saturated, unsaturated, cyclic, and substituted alkyl groups, typically with from 1 to about 20 carbon atoms and preferably with from 1 to about 16 carbon atoms, although the number of carbon atoms can be outside of these ranges, an alkoxy group, including linear, branched, saturated, unsaturated, cyclic, and substituted alkoxy groups, typically with from 1 to about 20 carbon atoms and preferably with from 1 to about 16 carbon atoms, although the number of carbon atoms can be outside of these ranges, an aryl group, including substituted aryl groups, typically with from 6 to about 16 carbon atoms, and preferably with from 6 to about 14 carbon atoms, although the number of carbon atoms can be outside of these ranges, an aryloxy group, including substituted aryloxy groups, typically with from 6 to about 17 carbon atoms, and preferably with from 6 to about 15 carbon atoms, although the number of carbon atoms can be outside of these ranges, an arylalkyl group or an alkylaryl group, including substituted arylalkyl and substituted alkylaryl groups, typically with from 7 to about 20 carbon atoms, and preferably with from 7 to about 16 carbon atoms, although the number of carbon atoms can be outside of these ranges, an arylalkyloxy or an alkylaryloxy group, including substituted arylalkyloxy and substituted alkylaryloxy groups, typically with from 7 to about 21 carbon atoms, and preferably with from 7 to about 17 carbon atoms, although the number of carbon atoms can be outside of these ranges, a heterocyclic group, including substituted heterocyclic groups, wherein the hetero atoms can be (but are not limited to) nitrogen, oxygen, sulfur, and phosphorus, typically with from about 4 to about 6 carbon atoms, and preferably with from about 4 to about 5 carbon atoms, although the number of carbon atoms can be outside of these ranges, wherein the substituents on the substituted alkyl, alkoxy, aryl, aryloxy, arylalkyl, alkylaryl, arylalkyloxy, alkylaryloxy, and heterocyclic groups can be (but are not limited to) hydroxy groups, halogen atoms, amine groups, imine groups, ammonium groups, cyano groups, pyridine groups, pyridinium groups, ether groups, aldehyde groups, ketone groups, ester groups, amide groups, carbonyl groups, thiocarbonyl groups, sulfate groups, sulfonate groups, sulfide groups, sulfoxide groups, phosphine groups, phosphonium groups, phosphate groups, nitrile groups, mercapto groups, nitro groups, nitroso groups, sulfone groups, acyl groups, acid anhydride groups, azide groups, mixtures thereof, and the like, as well as mixtures thereof, and wherein two or more substituents can be joined together to form a ring, and n is an integer representing the number of repeat monomer units.

Particularly preferred $R_1$, $R_2$, $R_3$, and $R_4$ groups on the 3,4-ethylenedioxythiophene monomer and poly(3,4-ethylenedioxythiophene) polymer include hydrogen atoms, linear alkyl groups of the formula $—(CH_2)_nCH_3$ wherein n is an integer of from 0 to about 16, linear alkyl sulfonate groups of the formula $—(CH_2)_nSO_3^-M^+$ wherein n is an integer of from 1 to about 6 and M is a cation, such as sodium, potassium, other monovalent cations, or the like, and linear alkyl ether groups of the formula $—(CH_2)_nOR_3$ wherein n is an integer of from 0 to about 6 and $R_3$ is a hydrogen atom or a linear alkyl group of the formula $—(CH_2)_mCH_3$ wherein n is an integer of from 0 to about 6. Specific examples of preferred 3,4-ethylenedioxythiophene monomers include those with $R_1$ and $R_3$ as hydrogen groups and $R_2$ and $R_4$ groups as follows:

| $R^2$ | $R^4$ |
|---|---|
| H | H |
| $(CH_2)_nCH_3$ n = 0–14 | H |
| $(CH_2)_nCH_3$ n = 0–14 | $(CH_2)_nCH_3$ n = 0–14 |
| $(CH_2)_nSO_3^-Na^+$ n = 1–6 | H |
| $(CH_2)_nSO_3^-Na^+$ n = 1–6 | $(CH_2)_nSO_3^-Na^+$ n = 1–6 |
| $(CH_2)_nOR_6$ n = 0–4 $R_6$ = H, $(CH_2)_mCH_3$ m = 0–4 | H |
| $(CH_2)_nOR_6$ n = 0–4 $R_6$ = H, $(CH_2)_mCH_3$ m = 0–4 | $(CH_2)_nOR_6$ n = 0–4 $R_6$ = H, $(CH_2)_mCH_3$ m = 0–4 |

Unsubstituted 3,4-ethylenedioxythiophene monomer is commercially available from, for example Bayer AG. Substituted 3,4-ethylenedioxythiophene monomers can be prepared by known methods. For example, the substituted thiophene monomer 3,4-ethylenedioxythiophene can be synthesized following early methods of Fager (Fager, E. W. *J. Am. Chem. Soc.* 1945, 67, 2217), Becker et al. (Becker, H. J.; Stevens, *W. Rec. Trav. Chim.* 1940, 59, 435) Guha and Iyer (Guha, P. C., Iyer, B. H.; *J. Ind. Inst. Sci.* 1938, A21, 115), and Gogte (Gogte, V. N.; Shah, L. G.; Tilak, B. D.; Gadekar, K. N.; Sahasrabudhe, M. B., *Tetrahedron*, 1967, 23, 2437). More recent references for the EDOT synthesis and 3,4-alkylenedioxythiophenes are the following: Pei, Q.; Zuccarello, G.; Ahiskog, M.; Inganas, O. Polymer, 1994, 35(7), 1347; Heywang, G.; Jonas, F. *Adv. Mater.* 1992, 4(2), 116; Jonas, F.; Heywang, G.; *Electrochimica Acta.* 1994, 39(8/9), 1345; Sankaran, B.; Reynolds, J. R.; *Macromolecules*, 1997, 30, 2582; Coffey, M.; McKellar, B. R.; Reinhardt, B. A.; Nijakowski, T.; Feld, W. A.; *Syn. Commun.*, 1996, 26(11), 2205; Kumar, A.; Welsh, D. M.; Morvant, M. C.; Piroux, F.; Abboud, K. A.; Reynolds, J. R. *Chem. Mater.* 1998, 10, 896; Kumar, A.; Reynolds, J. R. *Macromolecules*, 1996, 29, 7629; Groenendaal, L.; Jonas, F.; Freitag, D.; Pielartzik, H.; Reynolds, J. R.; *Adv. Mater.* 2000, 12(7), 481; and U.S. Pat. No. 5,035,926, the disclosures of each of which are totally incorporated herein by reference. The synthesis of poly(3,4-ethylenedioxypyrrole)s and 3,4-ethylenedioxypyrrole monomers is also disclosed in Merz, A., Schropp, R., Dötterl, E., *Synthesis*, 1995, 795; Reynolds, J. R.; Brzezinski, J., DuBois, C. J., Giurgiu, I., Kloeppner, L., Ramey, M. B., Schottland, P., Thomas, C., Tsuie, B. M., Welsh, D. M., Zong, K., Polym. Prepr. *Am. Chem. Soc. Div. Polym. Chem*, 1999, 40(2), 1192; Thomas, C. A., Zong, K., Schottland, P., Reynolds, J. R., *Adv. Mater.*, 2000, 12(3), 222; Thomas, C. A., Schottland, P., Zong, K, Reynolds, J. R., *Polym. Prepr. Am. Chem. Soc. Div. Polym. Chem*, 1999, 40(2), 615; and Gaupp, C. L., Zong, K., Schottland, P., Thompson, B. C., Thomas, C. A., Reynolds, J. R., *Macromolecules*, 2000, 33, 1132; the disclosures of each of which are totally incorporated herein by reference.

An example of a monomer synthesis is as follows:

Thiodiglycolic acid (1, 50 grams, commercially available from Aldrich or Fluka) is dissolved in methanol (200 milliliters) and concentrated sulfuric acid (57 milliliters) is added slowly with continuous stirring. After refluxing for 16 to 24 hours, the reaction mixture is cooled and poured into water (300 milliliters). The product is extracted with diethyl ether (200 milliliters) and the organic layer is repeatedly washed with saturated aqueous $NaHCO_3$, dried with $MgSO_4$, and concentrated by rotary evaporation. The residue is distilled to give colorless dimethyl thiodiglycolate (2, 17 grams). If the solvent is changed to ethanol the resulting product obtained is diethyl thiodiglycolate (3).

A solution of 2 and diethyl oxalate (4, 22 grams, commercially available from Aldrich) in methanol (100 milliliters) is added dropwise into a cooled (0° C.) solution of sodium methoxide (34.5 grams) in methanol (150 milliliters). After the addition is completed, the mixture is refluxed for 1 to 2 hours. The yellow precipitate that forms is filtered, washed with methanol, and dried in vacuum at room temperature. A pale yellow powder of disodium 2,5-dicarbomethoxy-3,4-dioxythiophene (5) is obtained in 100 percent yield (28 grams). The disodium 2,5-dicarbethyoxy-3,4-dioxythiophene (6) derivative of 5 can also be used instead of the methoxy derivative. This material is prepared similarly to 5 except 3 and diethyl oxalate (4) in ethanol is added dropwise into a cooled solution of sodium ethoxide in ethanol.

The salt either 5 or 6 is dissolved in water and acidified with 1 Molar HCl added slowly dropwise with constant stirring until the solution becomes acidic. Immediately following, thick white precipitate falls out. After filtration, the precipitate is washed with water and air-dried to give 2,5-dicarbethoxy-3,4-dihydroxythiophene (7). The salt either (5, 2.5 grams) or 6 can be alkylated directly or the dihydrothiophene derivative (7) can be suspended in the appropriate 1,2-dihaloalkane or substituted 1,2-dihaloalkane and refluxed for 24 hours in the presence of anhydrous $K_2CO_3$ in anhydrous DMF. To prepare EDOT, either 1,2-dicholorethane (commercially available from Aldrich) or 1,2-dibromoethane (commercially from Aldrich) is used. To prepare the various substituted EDOT derivatives the appropriate 1,2-dibromoalkane is used, such as 1-dibromodecane, 1,2-dibromohexadecane (prepared from 1-hexadecene and bromine), 1,2-dibromohexane, other reported 1,2-dibromoalkane derivatives, and the like. The resulting 2,5-dicarbethoxy-3,4-ethylenedioxythiophene or 2,5-dicarbethoxy-3,4-alkylenedioxythiophene is refluxed in base, for example 10 percent aqueous sodium hydroxide solution for 1 to 2 hours, and the resulting insoluble material is collected by filtration. This material is acidified with 1 Normal HCl and recrystallized from methanol to produce either 2,5-dicarboxy-3,4-ethylenedioxythiophene or the corresponding 2,5-dicarboxy-3,4-alkylenedioxythiophene. The final step to reduce the carboxylic acid functional groups to hydrogen to produce the desired monomer is given in the references above.

Another class of suitable conductive polymer materials is that of polypyrroles. Examples of suitable pyrroles include those of the general formula

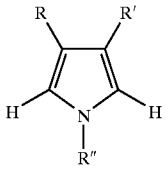

(shown in the reduced form) wherein R, R', and R" each, independently of the other, is a hydrogen atom, an alkyl group, including linear, branched, saturated, unsaturated, cyclic, and substituted alkyl groups, typically with from 1 to about 20 carbon atoms and preferably with from 1 to about 16 carbon atoms, although the number of carbon atoms can be outside of these ranges, an alkoxy group, including linear, branched, saturated, unsaturated, cyclic, and substituted alkoxy groups, typically with from 1 to about 20 carbon atoms and preferably with from 1 to about 16 carbon atoms, although the number of carbon atoms can be outside of these ranges, an aryl group, including substituted aryl groups, typically with from 6 to about 16 carbon atoms, and preferably with from 6 to about 14 carbon atoms, although the number of carbon atoms can be outside of these ranges, an aryloxy group, including substituted aryloxy groups, typically with from 6 to about 17 carbon atoms, and preferably with from 6 to about 15 carbon atoms, although the number of carbon atoms can be outside of these ranges, an arylalkyl group or an alkylaryl group, including substituted arylalkyl and substituted alkylaryl groups, typically with from 7 to about 20 carbon atoms, and preferably with from 7 to about 16 carbon atoms, although the number of carbon atoms can be outside of these ranges, an arylalkyloxy or an alkylaryloxy group, including substituted arylalkyloxy and substituted alkylaryloxy groups, typically with from 7 to about 21 carbon atoms, and preferably with from 7 to about 17 carbon atoms, although the number of carbon atoms can be outside of these ranges, a heterocyclic group, including substituted heterocyclic groups, wherein the hetero atoms can be (but are not limited to) nitrogen, oxygen, sulfur, and phosphorus, typically with from about 4 to about 6 carbon atoms, and preferably with from about 4 to about 5 carbon atoms, although the number of carbon atoms can be outside of these ranges, wherein R" can further be an oligoether group of the formula $(C_xH_{2x}O)_yR$, wherein n is an integer of from 1 to about 6 and y is an integer representing the number of repeat monomer units and typically is from about 1 to about 4 and R is as defined hereinabove (with specific examples of R" including $—(CH_2CH_2O)_2CH_2CH_3$, $—(CH_2CH_2O)_2CH_2CH_2OH$, and $—(CH_2)_3SO_3^-Na^+$, wherein the substituents on the substituted alkyl, alkoxy, aryl, aryloxy, arylalkyl, alkylaryl, arylalkyloxy, alkylaryloxy, and heterocyclic groups can be (but are not limited to) hydroxy groups, halogen atoms, amine groups, imine groups, ammonium groups, cyano groups, pyridine groups, pyridinium groups, ether groups, aldehyde groups, ketone groups, ester groups, amide groups, carbonyl groups, thiocarbonyl groups, sulfate groups, sulfonate groups, sulfide groups, sulfoxide groups, phosphine groups, phosphonium groups, phosphate groups, nitrile groups, mercapto groups, nitro groups, nitroso groups, sulfone groups, acyl groups, acid anhydride groups, azide groups, mixtures thereof, and the like, as well as mixtures thereof, and wherein two or more substituents can be joined together to form a ring. One example of a suitable pyrrole is simple pyrrole, of the formula

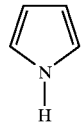

(shown in the reduced form). The polymerized pyrrole (shown in the reduced form) is of the formula

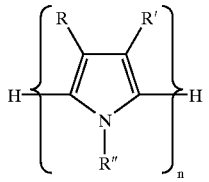

wherein R, R', and R" are as defined above and n is an integer representing the number of repeat monomer units.

One particularly preferred class of pyrroles is that of 3,4-ethylenedioxypyrroles. A poly(3,4-ethylenedioxypyrrole), in its reduced form, is of the formula

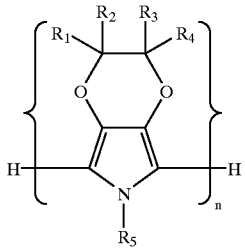

wherein each of $R_1$, $R_2$, $R_3$, $R_4$, and $R_5$, independently of the others, is a hydrogen atom, an alkyl group, including linear, branched, saturated, unsaturated, cyclic, and substituted alkyl groups, typically with from 1 to about 20 carbon atoms and preferably with from 1 to about 16 carbon atoms, although the number of carbon atoms can be outside of these ranges, an alkoxy group, including linear, branched, saturated, unsaturated, cyclic, and substituted alkoxy groups, typically with from 1 to about 20 carbon atoms and preferably with from 1 to about 16 carbon atoms, although the number of carbon atoms can be outside of these ranges, an aryl group, including substituted aryl groups, typically with from 6 to about 16 carbon atoms, and preferably with from 6 to about 14 carbon atoms, although the number of carbon atoms can be outside of these ranges, an aryloxy group, including substituted aryloxy groups, typically with from 6 to about 17 carbon atoms, and preferably with from 6 to about 15 carbon atoms, although the number of carbon atoms can be outside of these ranges, an arylalkyl group or an alkylaryl group, including substituted arylalkyl and substituted alkylaryl groups, typically with from 7 to about 20 carbon atoms, and preferably with from 7 to about 16 carbon atoms, although the number of carbon atoms can be outside of these ranges, an arylalkyloxy or an alkylaryloxy group, including substituted arylalkyloxy and substituted alkylaryloxy groups, typically with from 7 to about 21 carbon atoms, and preferably with from 7 to about 17 carbon atoms, although the number of carbon atoms can be outside of these ranges, a heterocyclic group, including substituted heterocyclic groups, wherein the hetero atoms can be (but are not limited to) nitrogen, oxygen, sulfur, and phosphorus, typically with from about 4 to about 6 carbon atoms, and preferably with from about 4 to about 5 carbon atoms, although the number of carbon atoms can be outside of these ranges, wherein $R_5$ can further be an oligoether group of the formula $(C_xH_{2x}O)_yR_1$, wherein x is an integer of from 1 to about 6 and y is an integer representing the number of repeat monomer units and typically is from about 1 to about 4 and $R_1$ is as defined hereinabove (with specific examples of $R_5$ including $—(CH_2CH_2O)_2CH_2CH_3$, $—(CH_2CH_2O)_2CH_2CH_2OH$, and $—(CH_2)_3SO_3^-Na^+$, wherein materials with these $R_5$ groups can be prepared as disclosed in, for example, Merz, A., Schropp, R., Dötterl, E., *Synthesis*, 1995, 795; Reynolds, J. R.; Brzezinski, J., DuBois, C. J., Giurgiu, I., Kloeppner, L., Ramey, M. B., Schottland, P., Thomas, C., Tsuie, B. M., Welsh, D. M., Zong, K., *Polym. Prepr. Am. Chem. Soc. Div. Polym. Chem*, 1999, 40(2), 1192; and Thomas, C. A., Zong, K., Schottland, P., Reynolds, J. R., *Adv. Mater.*, 2000, 12(3), 222, the disclosures of each of which are totally incorporated herein by reference), wherein the substituents on the substituted alkyl, alkoxy, aryl, aryloxy, arylalkyl, alkylaryl, arylalkyloxy, alkylaryloxy, and heterocyclic groups can be (but are not limited to) hydroxy groups, halogen atoms, amine groups, imine groups, ammonium groups, cyano groups, pyridine groups, pyridinium groups, ether groups, aldehyde groups, ketone groups, ester groups, amide groups, carbonyl groups, thiocarbonyl groups, sulfate groups, sulfonate groups, sulfide groups, sulfoxide groups, phosphine groups, phosphonium groups, phosphate groups, nitrile groups, mercapto groups, nitro groups, nitroso groups, sulfone groups, acyl groups, acid anhydride groups, azide groups, mixtures thereof, and the like, as well as mixtures thereof, and wherein two or more substituents can be joined together to form a ring, and n is an integer representing the number of repeat monomer units.

Particularly preferred $R_1$, $R_2$, $R_3$, and $R_4$ groups on the 3,4-ethylenedioxypyrrole monomer and poly(3,4-ethylenedioxypyrrole) polymer include hydrogen atoms, linear alkyl groups of the formula $—(CH_2)_nCH_3$ wherein n is an integer of from 0 to about 16, linear alkyl sulfonate groups of the formula $—(CH_2)_nSO_3^-M^+$ wherein n is an integer of from 1 to about 6 and M is a cation, such as sodium, potassium, other monovalent cations, or the like, and linear alkyl ether groups of the formula $—(CH_2)_nOR_3$ wherein n is an integer of from 0 to about 6 and $R_3$ is a hydrogen atom or a linear alkyl group of the formula $—(CH_2)_mCH_3$ wherein n is an integer of from 0 to about 6. Specific examples of preferred 3,4-ethylenedioxypyrrole monomers include those with $R_1$ and $R_3$ as hydrogen groups and $R_2$ and $R_4$ groups as follows:

| $R_2$ | $R_4$ |
|---|---|
| H | H |
| $(CH_2)_nCH_3$ n = 0–14 | H |
| $(CH_2)_nCH_3$ n = 0–14 | $(CH_2)_nCH_3$ n = 0–14 |
| $(CH_2)_nSO_3^-Na^+$ n = 1–6 | H |
| $(CH_2)_nSO_3^-Na^+$ n = 1–6 | $(CH_2)_nSO_3^-Na^+$ n = 1–6 |
| $(CH_2)_nOR_6$ n = 0–4 $R_6$ = H, $(CH_2)_mCH_3$ m = 0–4 | H |
| $(CH_2)_nOR_6$ n = 0–4 $R_6$ = H, $(CH_2)_mCH_3$ m = 0–4 | $(CH_2)_nOR_6$ n = 0–4 $R_6$ = H, $(CH_2)_mCH_3$ m = 0–4 |

Poly(3,4-ethylenedioxypyrrole)s and 3,4-ethylenedioxypyrrole monomers suitable for the present invention can be prepared as disclosed in, for example, Merz, A., Schropp, R., Dötterl, E., *Synthesis*, 1995, 795; Reynolds, J. R.; Brzezinski, J., DuBois, C. J., Giurgiu, I., Kloeppner, L., Ramey, M. B., Schottland, P., Thomas, C., Tsuie, B. M., Welsh, D. M., Zong, K., *Polym. Prepr. Am. Chem. Soc. Div. Polym. Chem*, 1999, 40(2), 1192; Thomas, C. A., Zong, K., Schottland, P., Reynolds, J. R., *Adv. Mater.*, 2000, 12(3), 222, Thomas, C. A., Schottland, P., Zong, K, Reynolds, J. R., *Polym. Prepr. Am. Chem. Soc. Div. Polym. Chem*, 1999, 40(2), 615; and Gaupp, C. L., Zong, K., Schottland, P., Thompson, B. C., Thomas, C. A., Reynolds, J. R., *Macromolecules*, 2000, 33, 1132; the disclosures of each of which are totally incorporated herein by reference. The synthesis of poly(3,4-ethylenedioxythiophene)s and 3,4-ethylenedioxythiophene monomers is also disclosed in Fager (Fager, E. W. *J. Am. Chem. Soc.* 1945, 67, 2217), Becker et al. (Becker, H. J.; Stevens, W. *Rec. Trav. Chim.* 1940, 59, 435) Guha and Iyer (Guha, P. C., Iyer, B. H.; *J. Ind. Inst. Sci.* 1938, A21, 115), Gogte (Gogte, V. N.; Shah, L. G.; Tilak, B. D.; Gadekar, K. N.; Sahasrabudhe, M. B.; *Tetrahedron*, 1967, 23, 2437), Pei, Q.; Zuccarello, G.; Ahiskog, M.; Inganas, O. *Polymer, 1994, 35*(7), 1347; Heywang, G.; Jonas, F. *Adv. Mater.* 1992, 4(2), 116; Jonas, F.; Heywang, G.; *Electrochimica Acta*. 1994, 39(8/9), 1345; Sankaran, B.; Reynolds, J. R.; *Macromolecules*, 1997, 30, 2582; Coffey, M.; McKellar, B. R.; Reinhardt, B. A.; Nijakowski, T.; Feld, W. A.; *Syn. Commun.*, 1996, 26(11), 2205; Kumar, A.; Welsh, D. M.; Morvant, M. C.; Piroux, F.; Abboud, K. A.; Reynolds, J. R. *Chem. Mater.* 1998, 10, 896; Kumar, A.; Reynolds, J. R. *Macromolecules*, 1996, 29, 7629; Groenendaal, L.; Jonas, F.; Freitag, D.; Pielartzik, H.; Reynolds, J. R.; *Adv, Mater.* 2000, 12(7), 481; and U.S. Pat. No. 5,035,926, the disclosures of each of which are totally incorporated herein by reference.

The polythiophene or polypyrrole can be applied to the surfaces of the marking apparatus by the methods described hereinabove. In embodiments wherein the marking particles, additive particles on the marking particle surfaces, or both are coated with a conductive polymer, the polythiophene or polypyrrole can be applied to the particle surfaces by an oxidative polymerization process. The particles are suspended in a solvent in which the particles will not dissolve, such as water, methanol, ethanol, butanol, acetone, acetonitrile, blends of water with methanol, ethanol, butanol, acetone, acetonitrile, and/or the like, preferably in an amount of from about 5 to about 20 weight percent particles in the solvent, and the thiophene or pyrrole monomer is added slowly (a typical addition time period would be over about 10 minutes) to the solution with stirring. The thiophene or pyrrole monomer typically is added in an amount of from about 5 to about 15 percent by weight of the particles. Thereafter, the solution is stirred for a period of time, typically from about 0.5 to about 3 hours to enable the monomer to be absorbed into the particle surface. When a dopant is employed, it is typically added at this stage, although it can also be added after addition of the oxidant. Subsequently, the oxidant selected is dissolved in a solvent sufficiently polar to keep the particles from dissolving therein, such as water, methanol, ethanol, butanol, acetone, acetonitrile, or the like, typically in a concentration of from about 0.1 to about 5 molar equivalents of oxidant per molar equivalent of thiophene or pyrrole monomer, and slowly added dropwise with stirring to the solution containing the particles. The amount of oxidant added to the solution typically is in a molar ratio of 1:1 or less with respect to the thiophene or pyrrole, although a molar excess of oxidant can also be used and can be preferred in some instances. The oxidant is preferably added to the solution subsequent to addition of the thiophene or pyrrole monomer so that the thiophene or pyrrole has had time to adsorb onto the particle surfaces prior to polymerization, thereby enabling the thiophene or pyrrole to polymerize on the particle surfaces instead of forming separate particles in the solution. When the oxidant addition is complete, the solution is again stirred for a period of time, typically from about 1 to about 2 days, although the time can be outside of this range, to allow the polymerization and doping process to occur. Thereafter, the particles having the polythiophene or polypyrrole polymerized on the surfaces thereof are washed, preferably with water, to remove therefrom any polythiophene or polypyrrole that formed in the solution as separate particles instead of as a coating on the particle surfaces, and the particles are dried. The entire process typically takes place at about room temperature (typically from about 15 to about 30° C.), although lower temperatures can also be used if desired.

Examples of suitable oxidants include water soluble persulfates, such as ammonium persulfate, potassium persulfate, and the like, cerium (IV) sulfate, ammonium cerium (IV) nitrate, ferric salts, such as ferric chloride, iron (III) sulfate, ferric nitrate nanohydrate, tris(p-toluenesulfonato)iron (III) (commercially available from Bayer under the tradename Baytron C), and the like. The oxidant is typically employed in an amount of at least about 0.1 molar equivalent of oxidant per molar equivalent of thiophene or pyrrole monomer, preferably at least about 0.25 molar equivalent of oxidant per molar equivalent of thiophene or pyrrole monomer, and more preferably at least about 0.5 molar equivalent of oxidant per molar equivalent of thiophene or pyrrole monomer, and typically is employed in an amount of no more than about 5 molar equivalents of oxidant per molar equivalent of thiophene or pyrrole monomer, preferably no more than about 4 molar equivalents of oxidant per molar equivalent of thiophene or pyrrole monomer, and more preferably no more than about 3 molar equivalents of oxidant per molar equivalent of thiophene or pyrrole monomer, although the relative amounts of oxidant and thiophene or pyrrole can be outside of these ranges.

The molecular weight of the polythiophene or polypyrrole formed on the particle surfaces need not be high; typically the polymer can have three or more repeat thiophene units, and more typically six or more repeat thiophene or pyrrole units to enable the desired marking particle conductivity. If desired, however, the molecular weight of the polythiophene or polypyrrole formed on the particle surfaces can be adjusted by varying the molar ratio of oxidant to thiophene or pyrrole monomer, the acidity of the medium, the reaction time of the oxidative polymerization, and/or the like. In specific embodiments, the polymer has no more than about 100 repeat thiophene units. Molecular weights wherein the number of thiophene or pyrrole repeat monomer units is about 1,000 or higher can be employed, although higher molecular weights tend to make the material more insoluble and therefore more difficult to process.

In addition to polymerizing the thiophene or pyrrole monomer in the particle and/or on the particle surface, an aqueous dispersion of the desired polythiophene or polypyrrole, such as poly(3,4-ethylenedioxythiophene) (such as that commercially available under the tradename Baytron P from Bayer) or poly(3,4-ethylenedioxypyrrole), can be used to produce a conductive surface on the particles by adding some of the aqueous dispersion of polythiophene or polypyrrole to a suspension of the particles.

Alternatively, instead of coating the polythiophene or polypyrrole onto the marking particle or additive particle surfaces, the polythiophene or polypyrrole can be incorporated into the particles during the particle preparation process. For example, for marking particles prepared by an emulsion aggregation process, the polythiophene or polypyrrole polymer can be prepared during the aggregation of the particle latex process to make the particles, and then as the particles coalesced, the polythiophene or polypyrrole polymer can be included within the interior of the particles in addition to some polymer remaining on the surface. Another method of incorporating the polythiophene or polypyrrole within the particles is to perform the oxidative polymerization of the thiophene or pyrrole monomer on the aggregated particles prior to heating for particle coalescence. As the irregular shaped particles are coalesced with the polythiophene or polypyrrole polymer the polymer can be embedded or partially mixed into the particles as the particle coalesce. Yet another method of incorporating polythiophene or polypyrrole within the particles is to add the thiophene or pyrrole monomer, dopant, and oxidant after the particles are coalesced and cooled but before any washing is performed. The oxidative polymerization can, if desired, be performed in the same reaction kettle to minimize the number of process steps.

To achieve the desired conductivity of the polythiophene or polypyrrole, it is sometimes desirable for the polythiophene or polypyrrole to be in its oxidized form. The polythiophene or polypyrrole can be shifted to its oxidized form by doping it with dopants such as sulfonate, phosphate, or phosphonate moieties, iodine, mixtures thereof, or the like.

Poly(3,4-ethylenedioxythiophene) in its doped and oxidized form is believed to be of the formula

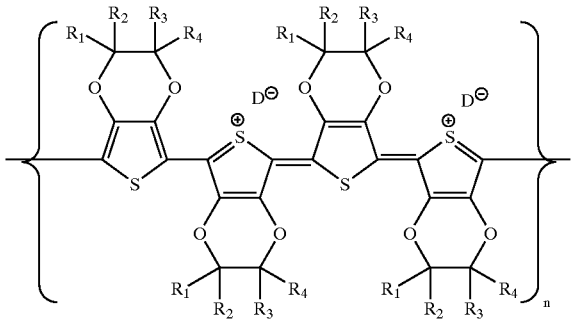

wherein $R_1$, $R_2$, $R_3$, and $R_4$ are as defined above, $D^-$ corresponds to the dopant, and n is an integer representing the number of repeat monomer units. For example, poly(3,4-ethylenedioxythiophene) in its oxidized form and doped with sulfonate moieties is believed to be of the formula

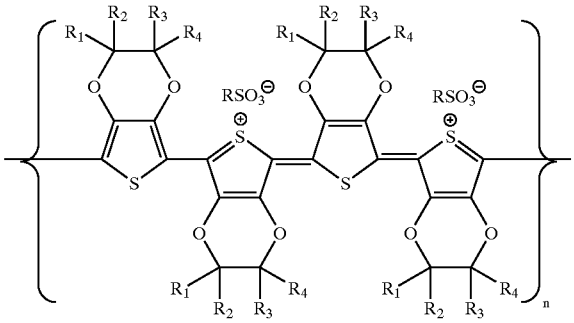

wherein $R_1$, $R_2$, $R_3$, and $R_4$ are as defined above, R corresponds to the organic portion of the sulfonate dopant molecule, such as an alkyl group, including linear, branched, saturated, unsaturated, cyclic, and substituted alkyl groups, typically with from 1 to about 20 carbon atoms and preferably with from 1 to about 16 carbon atoms, although the number of carbon atoms can be outside of these ranges, an alkoxy group, including linear, branched, saturated, unsaturated, cyclic, and substituted alkoxy groups, typically with from 1 to about 20 carbon atoms and preferably with from 1 to about 16 carbon atoms, although the number of carbon atoms can be outside of these ranges, an aryl group, including substituted aryl groups, typically with from 6 to about 16 carbon atoms, and preferably with from 6 to about 14 carbon atoms, although the number of carbon atoms can be outside of these ranges, an aryloxy group, including substituted aryloxy groups, typically with from 6 to about 17 carbon atoms, and preferably with from 6 to about 15 carbon atoms, although the number of carbon atoms can be outside of these ranges, an arylalkyl group or an alkylaryl group, including substituted arylalkyl and substituted alkylaryl groups, typically with from 7 to about 20 carbon atoms, and preferably with from 7 to about 16 carbon atoms, although the number of carbon atoms can be outside of these ranges, an arylalkyloxy or an alkylaryloxy group, including substituted arylalkyloxy and substituted alkylaryloxy groups, typically with from 7 to about 21 carbon atoms, and preferably with from 7 to about 17 carbon atoms, although the number of carbon atoms can be outside of these ranges, wherein the substituents on the substituted alkyl, alkoxy, aryl, aryloxy, arylalkyl, alkylaryl, arylalkyloxy, and alkylaryloxy groups can be (but are not limited to) hydroxy groups, halogen atoms, amine groups, imine groups, ammonium groups, cyano groups, pyridine groups, pyridinium groups, ether groups, aldehyde groups, ketone groups, ester groups, amide groups, carbonyl groups, thiocarbonyl groups, sulfate groups, sulfonate groups, sulfide groups, sulfoxide groups, phosphine groups, phosphonium groups, phosphate groups, nitrile groups, mercapto groups, nitro groups, nitroso groups, sulfone groups, acyl groups, acid anhydride groups, azide groups, mixtures thereof, and the like, as well as mixtures thereof, and wherein two or more substituents can be joined together to form a ring, and n is an integer representing the number of repeat monomer units.

Poly(3,4-ethylenedioxypyrrole) in its doped and oxidized form is believed to be of the formula

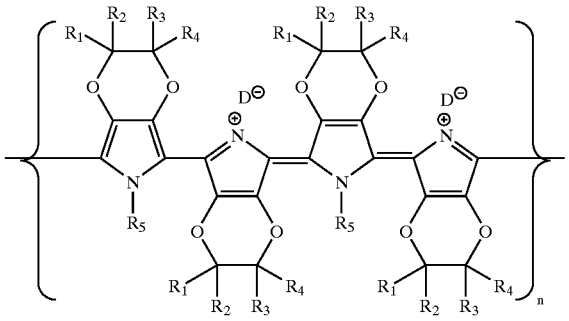

wherein $R_1$, $R_2$, $R_3$, $R_4$, and $R_5$ are as defined above, $D^-$ corresponds to the dopant, and n is an integer representing the number of repeat monomer units. For example, poly(3,4-ethylenedioxypyrrole) in its oxidized form and doped with sulfonate moieties is believed to be of the formula

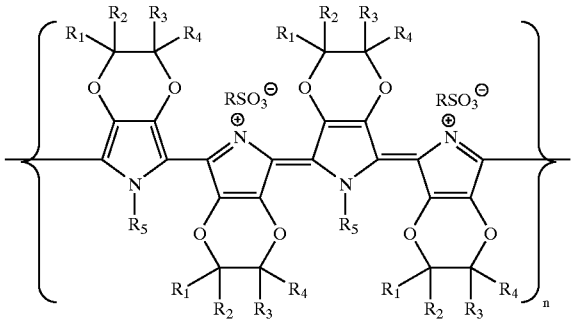

wherein $R_1$, $R_2$, $R_3$, $R_4$, and $R_5$ are as defined above, R corresponds to the organic portion of the sulfonate dopant molecule, such as an alkyl group, including linear, branched, saturated, unsaturated, cyclic, and substituted alkyl groups, typically with from 1 to about 20 carbon atoms and preferably with from 1 to about 16 carbon atoms, although the number of carbon atoms can be outside of these ranges, an alkoxy group, including linear, branched, saturated, unsaturated, cyclic, and substituted alkoxy groups, typically with from 1 to about 20 carbon atoms and preferably with from 1 to about 16 carbon atoms, although the number of carbon atoms can be outside of these ranges, an aryl group, including substituted aryl groups, typically with from 6 to about 16 carbon atoms, and preferably with from 6 to about 14 carbon atoms, although the number of carbon atoms can be outside of these ranges, an aryloxy group, including substituted aryloxy groups, typically with from 6 to about 17 carbon atoms, and preferably with from 6 to about 15 carbon atoms, although the number of carbon atoms can be outside of these ranges, an arylalkyl group or an alkylaryl group, including substituted arylalkyl and substituted alkylaryl groups, typically with from 7 to about 20 carbon atoms, and preferably with from 7 to about 16 carbon atoms, although the number of carbon atoms can be outside of these ranges, an arylalkyloxy or an alkylaryloxy group, including substituted arylalkyloxy and substituted alkylaryloxy groups, typically with from 7 to about 21 carbon atoms, and preferably with from 7 to about 17 carbon atoms, although the number of carbon atoms can be outside of these ranges, wherein the substituents on the substituted alkyl, alkoxy, aryl, aryloxy, arylalkyl, alkylaryl, arylalkyloxy, and alkylaryloxy groups can be (but are not limited to) hydroxy groups, halogen atoms, amine groups, imine groups, ammonium groups, cyano groups, pyridine groups, pyridinium groups, ether groups, aldehyde groups, ketone groups, ester groups, amide groups, carbonyl groups, thiocarbonyl groups, sulfate groups, sulfonate groups, sulfide groups, sulfoxide groups, phosphine groups, phosphonium groups, phosphate groups, nitrile groups, mercapto groups, nitro groups, nitroso groups, sulfone groups, acyl groups, acid anhydride groups, azide groups, mixtures thereof, and the like, as well as mixtures thereof, and wherein two or more substituents can be joined together to form a ring, and n is an integer representing the number of repeat monomer units.

One method of causing the polythiophene or polypyrrole to be doped is to select as the marking particle resin a polymer wherein at least some of the repeat monomer units have groups such as sulfonate groups thereon, such as sulfonated polyester resins and sulfonated vinyl resins. The sulfonated resin has surface exposed sulfonate groups that serve the dual purpose of anchoring and doping the coating layer of polythiophene or polypyrrole onto the marking particle surface.

Another method of causing the polythiophene or polypyrrole to be doped is to place groups such as sulfonate moieties on the marking particle surfaces during the marking particle synthesis. For example, when the marking particles are made by an emulsion aggregation process, the ionic surfactant selected for the emulsion aggregation process can be an anionic surfactant having a sulfonate group thereon, such as sodium dodecyl sulfonate, sodium dodecylbenzene sulfonate, dodecylbenzene sulfonic acid, dialkyl benzenealkyl sulfonates, such as 1,3-benzene disulfonic acid sodium salt, para-ethylbenzene sulfonic acid sodium salt, and the like, sodium alkyl naphthalene sulfonates, such as 1,5-naphthalene disulfonic acid sodium salt, 2-naphthalene disulfonic acid, and the like, sodium poly(styrene sulfonate), and the like, as well as mixtures thereof. During the emulsion polymerization process, the surfactant becomes grafted and/or adsorbed onto the latex particles that are later aggregated and coalesced. While the marking particles are washed subsequent to their synthesis to remove surfactant therefrom, some of this surfactant still remains on the particle surfaces, and in sufficient amounts to enable doping of the polythiophene or polypyrrole so that it is desirably conductive.

Yet another method of causing the polythiophene or polypyrrole to be doped is to add small dopant molecules containing sulfonate, phosphate, or phosphonate groups to the marking particle solution before, during, or after the oxidative polymerization of the thiophene or pyrrole. For example, after the marking particles have been suspended in the solvent and prior to addition of the thiophene or pyrrole, the dopant can be added to the solution. When the dopant is a solid, it is allowed to dissolve prior to addition of the thiophene or pyrrole monomer, typically for a period of about 0.5 hour. Alternatively, the dopant can be added after addition of the thiophene or pyrrole and before addition of the oxidant, or after addition of the oxidant, or at any other time during the process. The dopant is added to the polythiophene or polypyrrole in any desired or effective amount, typically at least about 0.1 molar equivalent of dopant per molar equivalent of thiophene or pyrrole monomer, preferably at least about 0.25 molar equivalent of dopant per molar equivalent of thiophene or pyrrole monomer, and more preferably at least about 0.5 molar equivalent of dopant per molar equivalent of thiophene or pyrrole monomer, and typically no more than about 5 molar equivalents of dopant per molar equivalent of thiophene or pyrrole monomer, preferably no more than about 4 molar equivalents of dopant per molar equivalent of thiophene or pyrrole monomer, and more preferably no more than about 3 molar equivalents of dopant per molar equivalent of thiophene or pyrrole monomer, although the amount can be outside of these ranges. This same method can be used to apply a coating of reagents that upon evaporation of the solvent produce a conductive polymer. The precursor monomers, oligomers, or polymers undergo polymerization in the presence of the oxidant and doping to form the polymer, which is deposited out of solution onto the apparatus surfaces because the conductive polymer is not soluble in the solvent.

Examples of suitable dopants include those with p-toluene sulfonate anions, such as p-toluene sulfonic acid, those with camphor sulfonate anions, such as camphor sulfonic acid, those with dodecyl sulfonate anions, such as dodecane sulfonic acid and sodium dodecyl sulfonate, those with benzene sulfonate anions, such as benzene sulfonic acid, those with naphthalene sulfonate anions, such as naphthalene sulfonic acid, those with dodecylbenzene sulfonate anions, such as dodecylbenzene sulfonic acid and sodium dodecyl benzene sulfonate, dialkyl benzenealkyl sulfonates, those with 1,3-benzene disulfonate anions, such as 1,3-benzene disulfonic acid sodium salt, those with para-ethylbenzene sulfonate anions, such as para-ethylbenzene sulfonic acid sodium salt, and the like, those with alkyl naphthalene sulfonate anions, such as sodium alkyl naphthalene sulfonates, including those with 1,5-naphthalene disulfonate anions, such as 1,5-naphthalene disulfonic acid sodium salt, and those with 2-naphthalene disulfonate anions, such as 2-naphthalene disulfonic acid, and the like, those with poly(styrene sulfonate) anions, such as poly (styrene sulfonate sodium salt), and the like.

Still another method of doping the polythiophene or polypyrrole is to expose the marking particles that have the polythiophene or polypyrrole on the particle surfaces to iodine vapor in solution, as disclosed in, for example, Yamamoto, T., Morita, A.; Miyazaki, Y.; Maruyama, T.; Wakayama, H.; Zhou, Z. H.; Nakamura, Y.; Kanbara, T.; Sasaki, S.; Kubota, K.; *Macromolecules*, 1992, 25, 1214 and Yamamoto, T.; Abla, M.; Shimizu, T.; Komarudin, D.; Lee, B-L.; Kurokawa, E. *Polymer Bulletin*, 1999, 42, 321, the disclosures of each of which are totally incorporated herein by reference.

When additive particles situated on the marking particle surfaces are coated with the conductive polymer, the polymer can be applied to the additive particles and doped by methods similar to those suitable for the marking particles.

The polythiophene or polypyrrole thickness on the marking or additive particles is a function of the surface area exposed for surface treatment, which is related to particle size and particle morphology, spherical vs potato or raspberry. For smaller particles the weight fraction of thiophene or pyrrole monomer used based on total mass of particles can be increased to, for example, 20 percent from 10 or 5 percent. The coating weight typically is at least about 5 weight percent of the particle mass, and typically is no more than about 20 weight percent of the particle mass. The solids loading of the particles can be measured using a heated balance which evaporates off the water, and, based on the initial mass and the mass of the dried material, the solids loading can be calculated. Once the solids loading is determined, the particle slurry is diluted to a 10 percent loading of particles in water. For example, for 20 grams of particles the total mass of particle slurry is 200 grams and 2 grams of 3,4-ethylenedioxythiophene is used. Then the 3,4-ethylenedioxythiophene and other reagents are added as indicated hereinabove. For a 5 micron particle using a 10 weight percent of 3,4-ethylenedioxythiophene, 2 grams for 20 grams of particles the thickness of the conductive polymer shell was 20 nanometers. Depending on the surface morphology, which also can change the surface area, the shell can be thicker or thinner or even incomplete.

Specific embodiments of the invention will now be described in detail. These examples are intended to be illustrative, and the invention is not limited to the materials, conditions, or process parameters set forth in these embodiments. All parts and percentages are by weight unless otherwise indicated.

The particle flow values of the marking particles were measured with a Hosokawa Micron Powder tester by applying a 1 millimeter vibration for 90 seconds to 2 grams of the marking particles on a set of stacked screens. The top screen contained 150 micron openings, the middle screen contained 75 micron openings, and the bottom screen contained 45 micron openings. The percent cohesion is calculated as follows:

$$\%\ \text{cohesion}=50\cdot A+30\cdot B+10\cdot C$$

wherein A is the mass of marking material remaining on the 150 micron screen, B is the mass of marking material remaining on the 75 micron screen, and C is the mass of marking material remaining on the 45 micron screen. (The equation applies a weighting factor proportional to screen size.) This test method is further described in, for example, R. Veregin and R. Bartha, Proceedings of IS&T 14th International Congress on Advances in Non-Impact Printing Technologies, pg. 358–361, 1998, Toronto, the disclosure of which is totally incorporated herein by reference. For the ballistic aerosol marking materials, the input energy applied to the apparatus of 300 millivolts was decreased to 50 millivolts to increase the sensitivity of the test. The lower the percent cohesion value, the better the marking material flowability.

Conductivity values of the marking particles were determined by preparing pellets of each material under 1,000 to 3,000 pounds per square inch and then applying 10 DC volts across the pellet. The value of the current flowing was then recorded, the pellet was removed and its thickness measured, and the bulk conductivity for the pellet was calculated in Siemens per centimeter.

EXAMPLE I

The inner surfaces of a ballistic aerosol marking device are coated with a conductive polymer as follows. A conductive coating material 401 as shown in FIG. 3 and FIG. 4 is applied to the interior surfaces of the structure, including but not limited to the walls of channels 46, the walls of cavities 28, the surface of substrate 36, the surface of channel layer 37, the surfaces of body 26 defining channels 46, and the surfaces of ports 42. A colloidal dispersion containing para-toluenesulfonic acid-doped poly(3,4-ethylenedioxythiophene) in water is prepared, and the marking device is dipped into the dispersion. Subsequently, the marking device is placed in an oven to remove the water, resulting in formation of a coating of conductive para-toluenesulfonic acid-doped poly(3,4-ethylenedioxythiophene) on the surfaces of the marking apparatus.

EXAMPLE II

The inner surfaces of a ballistic aerosol marking device are coated with a conductive polymer as described in Example I except that the para-toluenesulfonic acid-doped poly(3,4-ethylenedioxythiophene) is replaced with para-toluenesulfonic acid-doped poly(3,4-ethylenedioxypyrrole), resulting in formation of a coating of conductive para-toluenesulfonic acid-doped poly(3,4-ethylenedioxypyrrole) on the surfaces of the marking apparatus.

EXAMPLE III

The inner surfaces of a ballistic aerosol marking device are coated with a conductive polymer as described in Example I except that the para-toluenesulfonic acid-doped poly(3,4-ethylenedioxythiophene) is replaced with para-toluenesulfonic acid-doped polythiophene, resulting in formation of a coating of conductive para-toluenesulfonic acid-doped polythiophene on the surfaces of the marking apparatus.

EXAMPLE IV

The inner surfaces of a ballistic aerosol marking device are coated with a conductive polymer as described in Example I except that the para-toluenesulfonic acid-doped poly(3,4-ethylenedioxythiophene) is replaced with para-toluenesulfonic acid-doped polypyrrole, resulting in formation of a coating of conductive para-toluenesulfonic acid-doped polypyrrole on the surfaces of the marking apparatus.

EXAMPLE V

The inner surfaces of a ballistic aerosol marking device are coated with a conductive polymer as follows. A conductive coating material 401 as shown in FIG. 3 and FIG. 4 is applied to the interior surfaces of the structure, including but not limited to the walls of channels 46, the walls of cavities 28, the surface of substrate 36, the surface of channel layer 37, the surfaces of body 26 defining channels 46, and the surfaces of ports 42. To 52 grams of water is first added 2.0 grams (8.75 mmol) of the oxidant ammonium persulfate followed by stirring at room temperature for 15 minutes. About 0.5 grams (3.5 mmol) of 3,4-ethylenedioxythiophene monomer is pre-dispersed into 2 milliliters of a 1 percent wt/vol Neogen-RK surfactant solution, and this dispersion is transferred dropwise into the oxidant-treated marking aqueous solution with vigorous stirring. The molar ratio of oxidant to 3,4-ethylenedioxythiophene monomer is 2.5 to 1.0. 30 minutes after completion of the monomer addition, a 0.6 gram (3.5 mmol, equimolar to 3,4-ethylenedioxythiophene monomer) quantity of para-toluenesulfonic acid (external dopant) is added. The marking device is then dipped into the resulting mixture. The mixture is stirred for 24 hours at room temperature, followed by placing the marking device into an oven to complete the polymerization and remove water, resulting in formation of a coating of conductive para-toluenesulfonic acid-doped poly(3,4-ethylenedioxythiophene) on the surfaces of the marking apparatus.

EXAMPLE VI

The inner surfaces of a ballistic aerosol marking device are coated with a conductive polymer as described in Example V except that the 3,4-ethylenedioxythiophene is replaced with 3,4-ethylenedioxypyrrole, resulting in formation of a coating of conductive para-toluenesulfonic acid-doped poly(3,4-ethylenedioxypyrrole) on the surfaces of the marking apparatus.

EXAMPLE VII

The inner surfaces of a ballistic aerosol marking device are coated with a conductive polymer as described in Example V except that the 3,4-ethylenedioxythiophene is replaced with thiophene monomer, resulting in formation of a coating of conductive para-toluenesulfonic acid-doped polythiophene on the surfaces of the marking apparatus.

EXAMPLE VIII

The inner surfaces of a ballistic aerosol marking device are coated with a conductive polymer as described in Example V except that the 3,4-ethylenedioxythiophene is replaced with pyrrole monomer, resulting in formation of a coating of conductive para-toluenesulfonic acid-doped polypyrrole on the surfaces of the marking apparatus.

EXAMPLE IX

The inner surfaces of a ballistic aerosol marking device are coated with a conductive polymer as follows. A conductive coating material 401 as shown in FIG. 3 and FIG. 4 is applied to the interior surfaces of the structure, including but not limited to the walls of channels 46, the walls of cavities 28, the surface of substrate 36, the surface of channel layer 37, the surfaces of body 26 defining channels 46, and the surfaces of ports 42. A colloidal dispersion containing para-toluenesulfonic acid-doped poly(3,4-ethylenedioxythiophene) in water is prepared and is placed in ejector 12 and caused to pass through the device by propellant 14. After the desired portions of the inner surfaces of the apparatus have thus been coated with the colloidal dispersion, the apparatus is placed in a vacuum oven to remove the water, resulting in formation of a coating of conductive para-toluenesulfonic acid-doped poly(3,4-ethylenedioxythiophene) on the surfaces of the apparatus.

EXAMPLE X

The inner surfaces of a ballistic aerosol marking device are coated with a conductive polymer as described in Example IX except that the para-toluenesulfonic acid-doped poly(3,4-ethylenedioxythiophene) is replaced with para-toluenesulfonic acid-doped poly(3,4-ethylenedioxypyrrole), resulting in formation of a coating of conductive para-toluenesulfonic acid-doped poly(3,4-ethylenedioxypyrrole) on the surfaces of the marking apparatus.

EXAMPLE XI

The inner surfaces of a ballistic aerosol marking device are coated with a conductive polymer as described in Example IX except the para-toluenesulfonic acid-doped poly(3,4-ethylenedioxythiophene) is replaced with para-toluenesulfonic acid-doped polythiophene, resulting in formation of a coating of conductive para-toluenesulfonic acid-doped polythiophene on the surfaces of the marking apparatus.

EXAMPLE XII

The inner surfaces of a ballistic aerosol marking device are coated with a conductive polymer as described in Example IX except that the para-toluenesulfonic acid-doped poly(3,4-ethylenedioxythiophene) is replaced with para-toluenesulfonic acid-doped polypyrrole, resulting in formation of a coating of conductive para-toluenesulfonic acid-doped polypyrrole on the surfaces of the marking apparatus.

EXAMPLE XIII

The inner surfaces of a ballistic aerosol marking device are coated with a conductive polymer as follows. A conductive coating material 401 as shown in FIG. 3 and FIG. 4 is applied to the interior surfaces of the structure, including but not limited to the walls of channels 46, the walls of cavities 28, the surface of substrate 36, the surface of channel layer 37, the surfaces of body 26 defining channels 46, and the surfaces of ports 42. A mixture of water, ammonium persulfate, 3,4-ethylenedioxythiophene monomer, and para-toluenesulfonic acid is prepared as described in Example V and is placed in ejector 12 and caused to pass through the device by propellant 14. After the desired portions of the inner surfaces of the apparatus have thus been coated with the colloidal dispersion, the apparatus is placed in a vacuum oven to remove the water and complete the polymerization, resulting in formation of a coating of conductive para-toluenesulfonic acid-doped poly(3,4-ethylenedioxythiophene) on the surfaces of the apparatus.

EXAMPLE XIV

The inner surfaces of a ballistic aerosol marking device are coated with a conductive polymer as described in Example XIII except that the 3,4-ethylenedioxythiophene is replaced with 3,4-ethylenedioxypyrrole, resulting in formation of a coating of conductive para-toluenesulfonic acid-doped poly(3,4-ethylenedioxypyrrole) on the surfaces of the marking apparatus.

EXAMPLE XV

The inner surfaces of a ballistic aerosol marking device are coated with a conductive polymer as described in Example XIII except that the 3,4-ethylenedioxythiophene is replaced with thiophene monomer, resulting in formation of a coating of conductive para-toluenesulfonic acid-doped polythiophene on the surfaces of the marking apparatus.

EXAMPLE XVI

The inner surfaces of a ballistic aerosol marking device are coated with a conductive polymer as described in Example XIII except that the 3,4-ethylenedioxythiophene is replaced with pyrrole monomer, resulting in formation of a coating of conductive para-toluenesulfonic acid-doped polypyrrole on the surfaces of the marking apparatus.

EXAMPLE XVII

The inner surfaces of a ballistic aerosol marking device constructed from silicon are coated with a conductive polymer as follows. A conductive coating material 401 as shown in FIG. 3 and FIG. 4 is applied to the interior surfaces of the structure, including but not limited to the walls of channels 46, the walls of cavities 28, the surface of substrate 36, the surface of channel layer 37, the surfaces of body 26 defining channels 46, and the surfaces of ports 42. The silicon surfaces are first treated with aqueous hydrofluoric acid to generate a hydrogen-terminated silicon surface. If desired, the silicon surfaces can be further tailored for improved interaction with the conductive polymer by methods described in, for example, N. Y. Kim, I. E. Varmeir, and P. E. Laibinis, *Mat. Res. Soc. Symp. Proc.*, Vol. 598, 2000, Materials Research Society, BB5.6.1, the disclosure of which is totally incorporated herein by reference. Thereafter, a solution is prepared which is 0.1 Molar $LiClO_4$ and 0.05 molar thiophene in acetonitrile. The marking device is then placed in the solution and subjected to electrochemical polymerization with 600 mV vs. $Ag/AgNO_3$, resulting in formation of a coating of conductive polythiophene on the surfaces of the marking apparatus.

EXAMPLE XVIII

The inner surfaces of a ballistic aerosol marking device are coated with a conductive polymer as described in Example XVII except that the thiophene monomer is replaced with pyrrole monomer, resulting in formation of a coating of polypyrrole on the surfaces of the marking apparatus.

EXAMPLE XIX

The inner surfaces of a ballistic aerosol marking device are coated with a conductive polymer as described in Example XVII except that the thiophene monomer is replaced with 3,4-ethylenedioxythiophene monomer, resulting in formation of a coating of poly(3,4-ethylenedioxythiophene) on the surfaces of the marking apparatus.

EXAMPLE XX

The inner surfaces of a ballistic aerosol marking device are coated with a conductive polymer as described in Example XVII except that the thiophene monomer is replaced with 3,4-ethylenedioxypyrrole monomer, resulting in formation of a coating of poly(3,4-ethylenedioxypyrrole) on the surfaces of the marking apparatus.

EXAMPLE XXI

The inner surfaces of a ballistic aerosol marking device constructed from an epoxy resin (SU-8®, available from available from Microlithography Chemicals, Inc.) are coated with a conductive polymer as follows. A conductive coating material 401 as shown in FIG. 3 and FIG. 4 is applied to the interior surfaces of the structure, including but not limited to the walls of channels 46, the walls of cavities 28, the surface of substrate 36, the surface of channel layer 37, the surfaces of body 26 defining channels 46, and the surfaces of ports 42. The epoxy resin surfaces are first coated with a thin layer of indium tin oxide. Thereafter, 3,4-ethylenedioxythiophene is electropolymerized onto the indium tin oxide coated surfaces at either a constant potential or voltammetrically with potential scanning between the neutral state and conductive state. The polymerization reaction is carried out in a three-electrode cell using a platinum working electrode, a platinum counterelectrode, and a Ag/AgCl reference electrode. The anodic and cathodic parts of the cell are separated with a dense frit. With the marking apparatus surfaces immersed in the electrolyte solution, thin layers of poly(3,4-ethylenedioxythiophene) are deposited onto the inner surfaces. The electropolymerization is carried out in 0.2 Molar tetraethylammonium tetrafluoroborate ($Et_4NBF_4$) solution in acetonitrile containing a monomer 3,4-ethylenedioxythiophene concentration of $10^{-3}$ Molar.

Further information regarding the electrochemical oxidation of poly(3,4-ethylenedioxythiphene) onto indium tin oxide is disclosed in, for example, M. Lapkowski and A. Pr ón, *Synthetic Metals*, Volume 110, pages 79–83, 2000, and in *Handbook of Conductive Polymers*, T. Skotheim, R. L. Elsenbaumer, and J. R. Reynolds, eds., Chapter 20, "Electrochemistry of Conducting Polymers," K. Doblhofer and K. Rajeshwar, the disclosures of each of which are totally incorporated herein by reference.

EXAMPLE XXII

The inner surfaces of a ballistic aerosol marking device are coated with a conductive polymer as described in Example XXI except that the 3,4-ethylenedioxythiphene monomer is replaced with 3,4-ethylenedioxypyrrole monomer, resulting in formation of a coating of poly(3,4-ethylenedioxypyrrole) on the surfaces of the marking apparatus.

EXAMPLE XXIII

The inner surfaces of a ballistic aerosol marking device are coated with a conductive polymer as described in Example XXI except that the 3,4-ethylenedioxythiphene monomer is replaced with thiophene monomer, resulting in formation of a coating of polythiophene on the surfaces of the marking apparatus.

EXAMPLE XXIV

The inner surfaces of a ballistic aerosol marking device are coated with a conductive polymer as described in Example XXI except that the 3,4-ethylenedioxythiphene monomer is replaced with pyrrole monomer, resulting in formation of a coating of polypyrrole on the surfaces of the marking apparatus.

EXAMPLE XXV

A polymeric latex was prepared by the emulsion polymerization of styrene/n-butyl acrylate/acrylic acid (monomer weight ratio 82 parts by weight styrene, 18 parts by weight n-butyl acrylate, 2 parts by weight acrylic acid) in a nonionic/anionic surfactant solution (37.25 percent by weight solids) as follows; 17.54 kilograms of styrene, 3.85 kilograms of n-butyl acrylate, 427.8 grams of acrylic acid, 213.9 grams of carbon tetrabromide, and 620.4 grams of dodecanethiol were admixed with 38.92 kilograms of deionized water in which 481.5 grams of sodium dodecyl benzene sulfonate anionic surfactant (Neogen RK; contains 60 percent active component), 256.7 grams of Hydrosurf NX2 nonionic surfactant (obtained from Xerox Corporation), and 213.9 grams of ammonium persulfate polymerization initiator had been dissolved. The emulsion thus formed was then polymerized at 70° C. for 3 hours, followed by heating to 85° C. for an additional 1 hour. The resulting latex contained 62.75 percent by weight water and 37.25 percent by weight solids, which solids comprised particles of a random copolymer of poly(styrene/n-butyl acrylate/acrylic acid), the glass transition temperature of the latex dry sample was 55.2° C., as measured on a DuPont DSC. The latex had a weight average molecular weight of 25,300 and a number average molecular weight of 5,600, as determined with a Waters gel permeation chromatograph. The particle size of the latex as measured on a Disc Centrifuge was 207 nanometers. 1,040 grams of the styrene/n-butyl acrylate/acrylic acid anionic latex thus prepared and 30.4 grams of BHD 6000 pigment dispersion (obtained from Sun Chemical, containing 53 percent by weight solids of pigment blue cyan 15:3) dispersed into sodium dodecyl benzene sulfonate anionic surfactant (Neogen R) solution was blended with 7.5 grams of cationic surfactant Sanizol B-50 (obtained from Kao Chemical) in 2,000 grams of deionized water using a high shear homogenizer at 10,000 revolutions per minute for 2 minutes, producing a flocculation or heterocoagulation of gelled particles consisting of nanometer sized latex particles and pigment. The pigmented latex slurry was heated at a controlled rate of 0.50° C. per minute to 50° C., at which point the average marking particle size was 5.9 microns and the particle size distribution was 1.21. At this stage, 200 milliliters of a 20 percent by weight solution of Neogen R was added to freeze the marking particle size, The mixture was then heated at a controlled rate of 1° C. per minute to 95° C., followed by maintenance of this temperature for 3 hours. After cooling the reaction mixture to room temperature, the pH of the supernatant was adjusted to pH 11 with a 4 percent by weight solution of potassium hydroxide. The particles were then washed and reslurried in deionized water. The particles were washed twice more at pH 11, followed by two washes in deionized water without any pH adjustment. The particles were then dried on a freeze drier for over 48 hours to provide a dry cyan powder. The resulting dried cyan marking particles of poly(styrene/n-butyl acrylate/acrylic acid) had an average volume diameter of 5.95 microns and the particle size distribution was 1.21 as measured by a Coulter Counter.

29.55 grams of the powdered cyan particles thus formed were then dry blended with 0.45 grams (1.5 percent by weight of the cyan particles) of silica particles (Aerosil R-812, obtained from Degussa).

30 grams of the powdered cyan particles thus formed were then dry blended with 1.35 grams (4.5 percent by weight of the cyan particles) of conductive titanium dioxide particles (STT100H, obtained from Titan Kogyo Kabushiki Kaisha (IK Inabata America Corporation, New York)). This process was repeated to produce a second batch of marking particles surface treated with conductive titanium dioxide particles.

The particle flow values of the marking material with no silica particles, the marking material with silica particles, and the marking materials with conductive titanium dioxide particles were measured. The flowability characteristics of the marking materials thus prepared were evaluated as follows. About 2 grams of the marking material was placed on top of a porous glass frit inside a ballistic aerosol marking (BAM) flow test fixture. The apparatus consisted of a cylindrical hollow column of plexi-glass approximately 8 centimeters tall by 6 centimeters in diameter containing two porous glass frits. The marking material was placed on the lower glass frit, which was approximately 4 centimeters from the bottom. The second glass frit was part of the removable top portion. Gas was ejected through an opening in the bottom of the device, which was evenly distributed through the lower glass frit to create a fluidized bed of marking material in the gas stream. In the top portion of the device was an opening into which a narrow inner diameter straight glass capillary was inserted and through which the marking particle stream was ejected. A continuous 5 mV laser was focused on the particle stream and, using an optical camera and monitor, the particle stream was visualized. The inner diameter of the straight glass capillaries can be changed to screen and identify good flowing marking materials. In this instance, a 47 micron inner diameter straight glass capillary tube of 3 centimeters in length was used. Using dry nitrogen gas, a fluidized bed of the marking material was produced by blowing gas through the lower porous glass frit to fluidize the marking particles. The height of the fluidized bed and the concentration of marking material exiting the glass capillary from the top of the BAM test fixture was controlled by the gas regulator. The stream of marking particles was observed using a laser-scattering visualization system. A qualitative subjective evaluation scale was developed to rate the different flow performance of the various marking materials tested in the BAM flow cell. Using a 47 micron inner diameter straight glass capillary a rating of 1 indicated that no marking material was seen ejecting out of the capillary as observed using the laser-scattering visualization system. A rating of 2 indicated minimal flow. A rating of 3 was indicated that particle flow was observed for 5 to 8 minutes continuously after shaking or tapping the flow cell. A rating of 4 indicated that marking particles were observed flowing out of the capillary continuously for 12 to 19 minutes. A rating of 5 was given to marking materials that demonstrated excellent continuous particle flow for greater than 20 minutes without the need to tap or shake the flow cell.

Values for the conductivity (in Siemens per centimeter), Hosokawa percent cohesion, and flow rating for the marking materials thus prepared were as follows:

| Surface Treatment | Conductivity | % Cohesion | Flow Rating |
|---|---|---|---|
| none | $7.9 \times 10^{-14}$ | >60 | 1 |
| 4.5 wt. % titanium dioxide batch A | $1.5 \times 10^{-11}$ | 5.1 | 5 |
| 4.5 wt. % titanium dioxide batch B | $2.4 \times 10^{-11}$ | 5.2 | 5 |

As the data indicate, when the conductive titanium dioxide was blended onto the marking particles, the particle flow was improved, the cohesion was improved with respect to the marking particles with no surface treatment, and the conductivity was substantially improved.

Additional marking materials were prepared with varying amounts of the conductive titanium dioxide particles. Pellets of these marking materials were formed and the conductivity of each was measured. The results were as follows:

| Wt. % titanium dioxide | Conductivity (S/cm) |
|---|---|
| 0 | $9.9 \times 10^{-14}$ |
| 2.5 | $1.3 \times 10^{-12}$ |
| 3 | $7.8 \times 10^{-12}$ |
| 4.5 | $1.5 \times 10^{-11}$ |

As the results indicate, there is a very strong correlation between the amount of the conductive titanium dioxide on the marking particle surface and the conductivity. The conductivity increases about one order of magnitude for a 1 weight percent increase in this specific additive loading. Different relative amounts of conductive titanium dioxide particles may be ideal, depending on the specific conductive titanium dioxide particles selected.

EXAMPLE XXVI

A marking material composition was prepared as described in Example XXV except that: (1) a styrene/n-butyl acrylate/β-carboxy ethyl acrylate latex, with the monomers present in relative amounts of 71 parts by weight/23 parts by weight/6 parts by weight respectively, obtained as Antarox-free EAN12-37/39K2 from Dow Chemical Co., Midland, Mich. (this latex can also be prepared as described in, for example, U.S. Pat. No. 6,132,924, the disclosure of which is totally incorporated herein by reference), was substituted for the 82/18/2 styrene/n-butyl acrylate/acrylic acid latex; REGAL® 330 carbon black pigment was substituted for the pigment blue cyan 15:3, said carbon black pigment being present in the marking material in an amount of 6 percent by weight; and (3) the marking material further contained 8 percent by weight of Polywax® 725 polyethylene wax. The marking particles had a weight average molecular weight of 37,200 and a number average molecular weight of 10,500, with an average particle size (D50) of 5.33 microns (GSD of 1,214) and a glass transition temperature $T_g$ of 51.1° C. Portions of the marking particles thus prepared were admixed with various different conductive titanium dioxide particles (all obtained from Titan Kogyo Kabushiki Kaisha (IK Inabata America Corporation, New York)) in amounts of 30 grams of marking particles admixed with 1.35 grams of conductive titanium dioxide particles (4.5 percent by weight conductive titanium dioxide particles). The percent cohesion and average bulk conductivity (Siemens per centimeter) were measured as described in Example XXV. In addition, relative humidity sensitivity was measured by charging a first portion of the particles in a controlled atmosphere at 10° C. and 15 percent relative humidity (referred to as "C" zone), charging a second portion of the particles in a controlled atmosphere at 28° C. and 80 percent relative humidity (referred to as "A" zone), by roll milling 1 gram of marking material and 24 grams of carrier on a roll mill at a speed of 90 feet per minute for 30 minutes, measuring the charge over mass (q/m) values for each marking material portion, and dividing the q/m value for the C zone by the q/m value for the A zone, as follows:

$$\text{RH Sensitivity} = \frac{\left(\frac{qc}{mc}\right)}{\left(\frac{qa}{ma}\right)}$$

The results were as follows:

| Additive | $q_A/m_A$ | $q_C/m_C$ | RH Sensitivity | % Cohesion | Conductivity |
|---|---|---|---|---|---|
| STT-100H | −13 | −10.2 | 0.78 | 2.2 | $4.80 \times 10^{-10}$ |
| STT-100HF10 | −15.1 | −23.4 | 1.55 | 3.4 | $1.40 \times 10^{-10}$ |
| STT-100HF20 | −20.6 | −29.2 | 1.42 | 11.7 | $2.00 \times 10^{-10}$ |
| STT-30A | −5.7 | −6.7 | 1.17 | 9.7 | $3.50 \times 10^{-11}$ |
| STT-30A-1 | −8.6 | −11.7 | 1.36 | 10 | $1.70 \times 10^{-11}$ |
| STT-A11-1 | −14.25 | −13.2 | 0.93 | 7.3 | $1.80 \times 10^{-10}$ |

EXAMPLE XXVII

Cyan marking material was prepared as follows. A linear sulfonated random copolyester resin comprising 46.5 mole percent terephthalate, 3.5 mole percent sodium sulfoisophthalate, 47.5 mole percent 1,2-propanediol, and 2.5 mole percent diethylene glycol was prepared as follows. Into a 5 gallon Parr reactor equipped with a bottom drain valve, double turbine agitator, and distillation receiver with a cold water condenser were charged 3.98 kilograms of dimethylterephthalate, 451 grams of sodium dimethyl sulfoisophthalate, 3,104 kilograms of 1,2-propanediol (1 mole excess of glycol), 351 grams of diethylene glycol (1 mole excess of glycol), and 8 grams of butyltin hydroxide oxide catalyst. The reactor was then heated to 165° C. with stirring for 3 hours whereby 1.33 kilograms of distillate were collected in the distillation receiver, and which distillate comprised about 98 percent by volume methanol and 2 percent by volume 1,2-propanediol as measured by the ABBE refractometer available from American Optical Corporation. The reactor mixture was then heated to 190° C. over a one hour period, after which the pressure was slowly reduced from atmospheric pressure to about 260 Torr over a one hour period, and then reduced to 5 Torr over a two hour period with the collection of approximately 470 grams of distillate in the distillation receiver, and which distillate comprised approximately 97 percent by volume 1,2-propanediol and 3 percent by volume methanol as measured by the ABBE refractometer. The pressure was then further reduced to about 1 Torr over a 30 minute period whereby an additional 530 grams of 1,2-propanediol were collected. The reactor was then purged with nitrogen to atmospheric pressure, and the polymer product discharged through the bottom drain onto a container cooled with dry ice to yield 5.60 kilograms of 3.5 mole percent sulfonated polyester resin, sodio salt of (1,2-propylene-dipropylene-5-sulfoisophthalate)-copoly (1,2-propylene-dipropylene terephthalate). The sulfonated polyester resin glass transition temperature was measured to be 56.6° C. (onset) utilizing the 910 Differential Scanning Calorimeter available from E.I. DuPont operating at a heating rate of 10° C. per minute. The number average molecular weight was measured to be 3,250 grams per mole, and the weight average molecular weight was measured to be 5,290 grams per mole using tetrahydrofuran as the solvent.

A 15 percent solids concentration of colloidal sulfonate polyester resin dissipated in aqueous media was prepared by first heating about 2 liters of deionized water to about 85° C. with stirring, and adding thereto 300 grams of the sulfonated polyester resin, followed by continued heating at about 85° C. and stirring of the mixture for a duration of from about one to about two hours, followed by cooling to about room temperature (25° C.). The colloidal solution of sodio-sulfonated polyester resin particles had a characteristic blue tinge and particle sizes in the range of from about 5 to about 150 nanometers, and typically in the range of 20 to 40 nanometers, as measured by the NiCOMP® particle sizer.

A 2 liter colloidal solution containing 15 percent by weight of the sodio sulfonated polyester resin was charged into a 4 liter kettle equipped with a mechanical stirrer. To this solution was added 42 grams of a cyan pigment dispersion containing 30 percent by weight of Pigment Blue 15:3 (available from Sun Chemicals), and the resulting mixture was heated to 56° C. with stirring at about 180 to 200 revolutions per minute. To this heated mixture was then added dropwise 760 grams of an aqueous solution containing 5 percent by weight of zinc acetate dehydrate. The dropwise addition of the zinc acetate dihydrate solution was accomplished utilizing a peristaltic pump, at a rate of addition of approximately 2.5 milliliters per minute. After the addition was complete (about 5 hours), the mixture was stirred for an additional 3 hours. A sample (about 1 gram) of the reaction mixture was then retrieved from the kettle, and a particle size of 4.9 microns with a GSD of 1.18 was measured by the Coulter Counter. The mixture was then allowed to cool to room temperature, about 25° C., overnight, about 18 hours, with stirring. The product was filtered off through a 3 micron hydrophobic membrane cloth, and the marking material cake was reslurried into about 2 liters of deionized water and stirred for about 1 hour. The marking material slurry was refiltered and dried on a freeze drier for 48 hours. The uncoated cyan polyester marking particles with average particle size of 5.0 microns and GSD of 1.18 was pressed into a pellet and the average bulk conductivity was measured to be $\sigma=1.4\times10^{-12}$ Siemens per centimeter. The conductivity was determined by preparing a pressed pellet of the material under 1,000 to 3,000 pounds per square inch of pressure and then applying 10 DC volts across the pellet. The value of the current flowing through the pellet was recorded, the pellet was removed and its thickness measured, and the bulk conductivity for the pellet was calculated in Siemens per centimeter.

Approximately 10 grams of the cyan marking particles were dispersed in 52 grams of aqueous slurry (19.4 percent by weight solids pre-washed marking material) with a slurry pH of 6.0 and a slurry solution conductivity of 15 microSiemens per centimeter. To the aqueous marking material slurry was first added 2.0 grams (8.75 mmol) of the oxidant ammonium persulfate followed by stirring at room temperature for 15 minutes. About 0.5 grams (3.5 mmol) of 3,4-ethylenedioxythiophene monomer was pre-dispersed into 2 milliliters of a 1 percent wt/vol Neogen-RK surfactant solution, and this dispersion was transferred dropwise into the oxidant-treated marking material slurry with vigorous stirring. The molar ratio of oxidant to 3,4-ethylenedioxythiophene monomer was 2.5 to 1.0, and the monomer concentration was 5 percent by weight of marking material solids. 30 minutes after completion of the monomer addition, a 0.6 gram (3.5 mmol, equimolar to 3,4-ethylenedioxythiophene monomer) quantity of para-toluenesulfonic acid (external dopant) was added. The mixture was stirred for 24 hours at room temperature to afford a surface-coated cyan marking material. The marking particles were filtered from the aqueous media, washed 3 times with deionized water, and then freeze-dried for 2 days. A dry yield of 9.38 grams for the poly(3,4-ethylenedioxythiophene) treated cyan 5 micron marking particles was obtained. The particle bulk conductivity was initially measured at $2.1\times10^{-3}$ Siemens per centimeter. About one month later the particle bulk conductivity was remeasured at about $10^{-13}$ Siemens per centimeter.

It is believed that if the relative amount of 3,4-ethylenedioxythiophene is increased to 10 percent by weight of the marking particles, using the above molar equivalents of dopant and oxidant, the resulting marking particles will also be highly conductive at about $2.1\times10^{-3}$ Siemens per centimeter and that the thickness and uniformity of the poly(3,4-ethylenedioxythiophene) shell will be improved over the 5 weight percent poly(3,4-ethylenedioxythiophene) conductive shell described in this example. It is further believed that if the relative amount of 3,4-ethylenedioxythiophene is increased to 10 percent by weight of the marking particles, using the above molar equivalents of dopant and oxidant, the resulting marking particles will maintain their conductivity levels over time.

EXAMPLE XXVIII

Cyan marking particles were prepared by the method described in Example XXVII. The marking particles had an average particle size of 5.13 microns with a GSD of 1.16.

The cyan marking particles were dispersed in water to give 62 grams of cyan marking particles in water (20.0 percent by weight solids loading) with a slurry pH of 6.2 and slurry solution conductivity of 66 microSiemens per centimeter. To the aqueous marking material slurry was first added 12.5 grams (54.5 mmol) of the oxidant ammonium persulfate followed by stirring at room temperature for 15 minutes. Thereafter, 3,4-ethylenedioxythiophene monomer (3.1 grams, 21.8 mmol) was added neat and dropwise to the solution over 15 to 20 minute period with vigorous stirring. The molar ratio of oxidant to 3,4-ethylenedioxythiophene monomer was 2.5 to 1.0, and the monomer concentration was 5 percent by weight of marking material solids. 30 minutes after completion of the monomer addition, the dopant para-toluenesulfonic acid (3.75 grams, 21.8 mmol, equimolar to 3,4-ethylenedioxythiophene monomer) was added. The mixture was stirred for 48 hours at room temperature to afford a surface-coated cyan marking material. The marking particles were filtered from the aqueous media, washed 3 times with deionized water, and then freeze-dried for 2 days. A dry yield of 71.19 grams for the poly(3,4-ethylenedioxythiophene) treated cyan 5 micron marking material was obtained. The particle bulk conductivity was measured at $2.6\times10^{-4}$ Siemens per centimeter. The flow properties of this marking material were measured with a Hosakawa powder flow tester to be 62.8 percent cohesion.

It is believed that if the relative amount of 3,4-ethylenedioxythiophene is increased to 10 percent by weight of the marking particles, using the above molar equivalents of dopant and oxidant, the resulting marking particles will also be highly conductive at about $2.6\times10^{-4}$ Siemens per centimeter and that the thickness and uniformity of the poly(3,4-ethylenedioxythiophene) shell will be improved over the 5 weight percent poly(3,4-ethylenedioxythiophene) conductive shell described in this example.

EXAMPLE XXIX

Unpigmented marking particles were prepared as follows. A colloidal solution of sodio-sulfonated polyester resin particles was prepared as described in Example XXVIII. A 2 liter colloidal solution containing 15 percent by weight of the sodio sulfonated polyester resin was charged into a 4 liter kettle equipped with a mechanical stirrer and heated to 56° C. with stirring at about 180 to 200 revolutions per minute. To this heated mixture was then added dropwise 760 grams of an aqueous solution containing 5 percent by weight of zinc acetate dehydrate. The dropwise addition of the zinc acetate dihydrate solution was accomplished utilizing a peristaltic pump, at a rate of addition of approximately 2.5 milliliters per minute. After the addition was complete (about 5 hours), the mixture was stirred for an additional 3 hours. A sample (about 1 gram) of the reaction mixture was then retrieved from the kettle, and a particle size of 4.9 microns with a GSD of 1.18 was measured by the Coulter Counter. The mixture was then allowed to cool to room temperature, about 25° C., overnight, about 18 hours, with stirring. The product was then filtered off through a 3 micron hydrophobic membrane cloth, and the marking material cake was reslurried into about 2 liters of deionized water and stirred for about 1 hour. The marking material slurry was refiltered and dried on a freeze drier for 48 hours. The uncoated non-pigmented polyester marking particles with average particle size of 5.0 microns and GSD of 1.18 was pressed into a pellet and the average bulk conductivity was measured to be $\sigma=2.6\times10^{-13}$ Siemens per centimeter.

Approximately 10 grams of the cyan marking particles were dispersed in 52 grams of aqueous slurry (19.4 percent by weight solids pre-washed marking material) with a slurry pH of 6.0 and a slurry solution conductivity of 15 microSiemens per centimeter. To the aqueous marking material slurry was first added 4.0 grams (17.5 mmol) of the oxidant ammonium persulfate followed by stirring at room temperature for 15 minutes. Thereafter, 3,4-ethylenedioxythiophene monomer (1.0 gram, 7.0 mmol) was added neat and dropwise to the solution over 15 to 20 minute period with vigorous stirring. The molar ratio of oxidant to 3,4-ethylenedioxythiophene monomer was 2.5 to 1.0, and the monomer concentration was 10 percent by weight of marking material solids. 30 minutes after completion of the monomer addition, the dopant para-toluenesulfonic acid (1.2 grams, 7.0 mmol, equimolar to 3,4-ethylenedioxythiophene monomer) was added. The mixture was stirred for 48 hours at slightly elevated temperature (between 32° C. to 35° C.) to afford a surface-coated cyan marking material. The marking particles were filtered from the aqueous media, washed 3 times with deionized water, and then freeze-dried for 48 hours. A dry yield of 9.54 grams for the poly(3,4-ethylenedioxythiophene) treated cyan 5 micron marking material was obtained. The particle bulk conductivity was measured at $2.9\times10^{-7}$ Siemens per centimeter.

EXAMPLE XXX

Marking particles were prepared by aggregation of a styrene/n-butyl acrylate/acrylic acid latex using a flocculate poly(aluminum chloride) followed by particle coalescence at elevated temperature. The polymeric latex was prepared by the emulsion polymerization of styrene/n-butyl acrylate/acrylic acid (monomer ratio 82 parts by weight styrene, 18 parts by weight n-butyl acrylate, 2 parts by weight acrylic acid) in a nonionic/anionic surfactant solution (40.0 percent by weight solids) as follows: 279.6 kilograms of styrene, 61.4 kilograms of n-butyl acrylate, 6.52 kilograms of acrylic acid, 3.41 kilograms of carbon tetrabromide, and 11.2 kilograms of dodecanethiol were mixed with 461 kilograms of deionized water, to which had been added 7.67 kilograms of sodium dodecyl benzene sulfonate anionic surfactant (Neogen RK; contained 60 percent active component), 3.66 kilograms of a nonophenol ethoxy nonionic surfactant (Antarox CA-897; contained 100 percent active material), and 3.41 kilograms of ammonium persulfate polymerization initiator dissolved in 50 kilograms of deionized water. The emulsion thus formed was polymerized at 70° C. for 3 hours, followed by heating to 85° C. for an additional 1 hour. The resulting latex contained 59.5 percent by weight water and 40.5 percent by weight solids, which solids comprised particles of a random copolymer of poly(styrene/n-butyl acrylate/acrylic acid), the glass transition temperature of the latex dry sample was 47.7° C., as measured on a DuPont DSC. The latex had a weight average molecular weight of 30,600 and a number average molecular weight of 4,400 as determined with a Waters gel permeation chromatography The particle size of the latex as measured on a Disc Centrifuge was 278 nanometers. 375 grams of the styrene/n-butyl acrylate/acrylic acid anionic latex thus prepared was then diluted with 761.43 grams of deionized water. The diluted latex solution was blended with an acidic solution of the flocculent, 3.35 grams of poly(aluminum chloride) in 7.86 grams of 1 molar nitric acid solution, using a high shear homogenizer at 4,000 to 5,000 revolutions per minutes for 2 minutes, producing a flocculation or heterocoagulation of gelled particles consisting of nanometer sized latex particles. The slurry was heated at a controlled rate of 0.25° C. per minute to 50° C., at which point the average particle size was 4.5 microns and the particle size distribution was 1.17. At this point the pH of the solution was adjusted to 7.0 using 4 percent sodium hydroxide solution. The mixture was then heated at a controlled rate of 0.5° C. per minute to 95° C. Once the particle slurry reacted, the pH was dropped to 5.0 using 1 Molar nitric acid, followed by maintenance of the temperature at 95° C. for 6 hours. After cooling the reaction mixture to room temperature, the particles were washed and reslurried in deionized water. The average particle size of the marking particles was 5.4 microns and the particle size distribution was 1.26. A total of 5 washes were performed before the particle surface was treated by the in situ polymerization of the conductive polymer.

Into a 250 milliliter beaker was added 120 grams of the pigmentless marking particle size particle slurry (average particle diameter 5.4 microns; particle size distribution GSD 1.26) thus prepared, providing a total of 19.8 grams of solid material in the solution. The solution was then further diluted with deionized water to create a 200 gram particle slurry. Into this stirred solution was dissolved the oxidant ammonium persulfate (8.04 grams; 0.03525 mole). After 15 minutes, 2 grams (0.0141 mole) of 3,4-ethylenedioxythiophene monomer (EDOT) diluted in 5 milliliters of acetonitrile was added to the solution. The molar ratio of oxidant to EDOT was 2.5:1, and EDOT was present in an amount of 10 percent by weight of the marking particles. The reaction was stirred for 15 minutes, followed by the addition of 2 grams of the external dopant para-toluene sulfonic acid (p-TSA) dissolved in 10 milliliters of water. The solution was stirred overnight at room temperature. The resulting blue-green marking particles (with the slight coloration being the result of the poly(3,4-ethylenedioxythiophene) (PEDOT) particle coating) were washed 7 times with distilled water and then dried with a freeze dryer for 48 hours. The chemical oxidative polymerization of EDOT to produce PEDOT occurred on the marking particle surface, and the particle surfaces were rendered conductive by the presence of the sulfonate groups from the marking particle surfaces and by the added p-TSA. The measured average bulk conductivity of a pressed pellet of this marking material was $\sigma=1.10\times10^{-7}$ Siemens per centimeter. The conductivity was determined by preparing a pressed pellet of the material under 1,000 to 3,000 pounds per square inch of pressure and then applying 10 DC volts across the pellet. The value of the current flowing through the pellet was recorded, the pellet was removed and its thickness measured, and the bulk conductivity for the pellet was calculated in Siemens per centimeter. The flow properties of this marking material were measured with a Hosakawa powder flow tester to be 4.5 percent cohesion. Scanning electron micrographs (SEM) of the treated particles indicated that a surface coating was indeed on the surface, and transmission electron micrographs indicated that the surface layer of PEDOT was 20 nanometers thick.

EXAMPLE XXXI

Marking particles were prepared by aggregation of a styrene/n-butyl acrylate/acrylic acid latex using a flocculate poly(aluminum chloride) followed by particle coalescence at elevated temperature. The polymeric latex was prepared by the emulsion polymerization of styrene/n-butyl acrylate/acrylic acid (monomer ratio 82 parts by weight styrene, 18 parts by weight n-butyl acrylate, 2 parts by weight acrylic acid) in a nonionic/anionic surfactant solution (40.0 percent by weight solids) as follows: 279.6 kilograms of styrene, 61.4 kilograms of n-butyl acrylate, 6.52 kilograms of acrylic acid, 3.41 kilograms of carbon tetrabromide, and 11.2 kilograms of dodecanethiol were mixed with 461 kilograms of deionized water, to which had been added 7.67 kilograms of sodium dodecyl benzene sulfonate anionic surfactant (Neogen RK: contained 60 percent active component), 3.66 kilograms of a nonophenol ethoxy nonionic surfactant (Antarox CA-897: contained 100 percent active material), and 3.41 kilograms of ammonium persulfate polymerization initiator dissolved in 50 kilograms of deionized water. The emulsion thus formed was polymerized at 70° C. for 3 hours, followed by heating to 85° C. for an additional 1 hour. The resulting latex contained 59.5 percent by weight water and 40.5 percent by weight solids, which solids comprised particles of a random copolymer of poly(styrene/n-butyl acrylate/acrylic acid); the glass transition temperature of the latex dry sample was 47.7° C., as measured on a DuPont DSC. The latex had a weight average molecular weight of 30,600 and a number average molecular weight of 4,400 as determined with a Waters gel permeation chromatograph. The particle size of the latex as measured on a Disc Centrifuge was 278 nanometers. 375 grams of the styrene/n-butyl acrylate/acrylic acid anionic latex thus prepared was then diluted with 761.43 grams of deionized water. The diluted latex solution was blended with an acidic solution of the flocculent, 3.345 grams of poly(aluminum chloride) in 7.86 grams of 1 molar nitric acid solution, using a high shear homogenizer at 4,000 to 5,000 revolutions per minutes for 2 minutes, producing a flocculation or heterocoagulation of gelled particles consisting of nanometer sized latex particles. The slurry was heated at a controlled rate of 0.25° C. per minute to 53° C., at which point the average particle size was 5.2 microns and the particle size distribution was 1.20. At this point the pH of the solution was adjusted to 7.2 using 4 percent sodium hydroxide solution. The mixture was then heated at a controlled rate of 0.5° C. per minute to 95° C. Once the particle slurry reacted, the pH was dropped to 5.0 using 1 Molar nitric acid, followed by maintenance of the temperature at 95° C. for 6 hours. After cooling the reaction mixture to room temperature, the particles were washed and reslurried in deionized water. The average particle size of the marking particles was 5.6 microns and the particle size distribution was 1.24. A total of 5 washes were performed before the particle surface was treated by the in situ polymerization of the conductive polymer.

Into a 250 milliliter beaker was added 150 grams of the pigmentless marking particle size particle slurry (average particle diameter 5.6 microns: particle size distribution GSD 1.24) thus prepared, providing a total of 25.0 grams of solid material in the solution. The solution was then further diluted with deionized water to create a 250 gram particle slurry. The pH of the particle slurry was measured to be 6.24. Into this stirred solution was added 3.35 grams (0.0176 mole) of the dopant para-toluene sulfonic acid (p-TSA), and the pH was then measured as 1.22. After 15 minutes, 2.5 grams (0.0176 mole) of 3,4-ethylenedioxythiophene monomer (EDOT) was added to the solution. The molar ratio of dopant to EDOT was 1:1, and EDOT was present in an amount of 10 percent by weight of the marking particles. After 2 hours, the dissolved oxidant ammonium persulfate (4.02 grams (0.0176 mole) in 10 milliliters of deionized water) was added dropwise over a 10 minute period. The molar ratio of oxidant to EDOT was 1:1. The solution was then stirred overnight at room temperature and thereafter allowed to stand for 3 days. The resulting bluish marking particles (with the slight coloration being the result of the PEDOT particle coating) were washed 7 times with distilled water and then dried with a freeze dryer for 48 hours. The chemical oxidative polymerization of EDOT to produce PEDOT occurred on the marking particle surface, and the particle surfaces were rendered conductive by the presence of the sulfonate groups from the marking particle surfaces and by the added p-TSA. The measured average bulk conductivity of a pressed pellet of this marking material was $\sigma=3.9\times10^{-3}$ Siemens per centimeter. The bulk conductivity was remeasured one week later and found to be $\sigma=4.5\times10^{-3}$ Siemens per centimeter. This remeasurement was performed to determine if the conductivity level was stable over time.

EXAMPLE XXXII

Marking particles were prepared as described in Example XXXI. Into a 250 milliliter beaker was added 150 grams of the pigmentless marking particle size particle slurry (average particle diameter 5.6 microns; particle size distribution GSD 1.24) thus prepared, providing a total of 25.0 grams of solid material in the solution. The solution was then further diluted with deionized water to create a 250 gram particle slurry. The pH of the particle slurry was measured to be 6.02. Into this stirred solution was added 8.37 grams (0.0440 mole) of the dopant para-toluene sulfonic acid (p-TSA) and the pH was measured as 0.87. After 15 minutes, 2.5 grams (0.0176 mole) of 3,4-ethylenedioxythiophene monomer (EDOT) was added to the solution. The molar ratio of dopant to EDOT was 2.5:1, and EDOT was present in an amount of 10 percent by weight of the marking particles. After 2 hours, the dissolved oxidant (ammonium persulfate 5.02 grams (0.0219 mole) in 10 milliliters of deionized water) was added dropwise over a 10 minute period. The molar ratio of oxidant to EDOT was 1.25:1. The solution was stirred overnight at room temperature and then allowed to stand for 3 days. The resulting bluish marking particles (with the slight coloration being the result of the PEDOT particle coating) were washed 7 times with distilled water and then dried with a freeze dryer for 48 hours. The chemical oxidative polymerization of EDOT to produce PEDOT occurred on the marking particle surface, and the particle surfaces were rendered conductive by the presence of the sulfonate groups from the marking particle surfaces and by the added p-TSA. The measured average bulk conductivity of a pressed pellet of this marking material was $\sigma=4.9\times10^{-3}$ Siemens per centimeter. The bulk conductivity was remeasured one week later and found to be $\sigma=3.7\times10^{-3}$ Siemens per centimeter. This remeasurement was done to determine if the conductivity level was stable over time.

EXAMPLE XXXIII

Cyan marking particles were prepared by aggregation of a styrene/n-butyl acrylate/acrylic acid latex using a flocculate poly(aluminum chloride) followed by particle coalescence at elevated temperature. The polymeric latex was prepared by the emulsion polymerization of styrene/n-butyl acrylate/acrylic acid (monomer ratio 82 parts by weight styrene, 18 parts by weight n-butyl acrylate, 2 parts by weight acrylic acid) in a nonionic/anionic surfactant solution (40.0 percent by weight solids) as follows: 279.6 kilograms of styrene, 61.4 kilograms of n-butyl acrylate, 6.52 kilograms of acrylic acid, 3.41 kilograms of carbon tetrabromide, and 11.2 kilograms of dodecanethiol were mixed with 461 kilograms of deionized water, to which had been added 7.67 kilograms of sodium dodecyl benzene sulfonate anionic surfactant (Neogen RK; contained 60 percent active component), 3.66 kilograms of a nonophenol ethoxy nonionic surfactant (Antarox CA-897; contained 100 percent active material), and 3.41 kilograms of ammonium persulfate polymerization initiator dissolved in 50 kilograms of deionized water. The emulsion thus formed was polymerized at 70° C. for 3 hours, followed by heating to 85° C. for an additional 1 hour. The resulting latex contained 59.5 percent by weight water and 40.5 percent by weight solids, which solids comprised particles of a random copolymer of poly(styrene/n-butyl acrylate/acrylic acid); the glass transition temperature of the latex dry sample was 47.7° C., as measured on a DuPont DSC. The latex had a weight average molecular weight of 30,600 and a number average molecular weight of 4,400 as determined with a Waters gel permeation chromatograph. The particle size of the latex as measured on a Disc Centrifuge was 278 nanometers.

The cyan marking particles were prepared using the latex thus prepared, wherein the marking particles consisted of 70 percent by weight of the latex mixed with pigment to prepare the particle cores and 30 percent by weight of the same latex used to form shells around the pigmented cores. Into a 2 liter glass reaction kettle was added 294.4 grams of the styrene/n-butyl acrylate/acrylic acid anionic latex thus prepared and diluted with 646.05 grams of deionized water. To the diluted latex solution was added 14.6 grams of BHD 6000 pigment dispersion (obtained from Sun Chemical, containing 51.4 percent by weight solids of pigment blue cyan 15:3) dispersed into sodium dodecyl benzene sulfonate anionic surfactant (Neogen R) solution. The pigmented latex solution was blended with an acidic solution of the flocculent (3.2 grams of poly(aluminum chloride) in 7.5 grams of 1 molar nitric acid solution) using a high shear homogenizer at 4,000 to 5,000 revolutions per minutes for 2 minutes, producing a flocculation or heterocoagulation of gelled particles consisting of nanometer sized pigmented latex particles. The slurry was heated at a controlled rate of 0.25° C. per minute to 50° C., at which point the average particle size was 4.75 microns and the particle size distribution was 1.20. At this point, 106.98 grams of the above latex was added to aggregate around the already marking particle sized pigmented cores to form polymeric shells. After an additional 2 hours at 50° C., the aggregated particles had an average particle size of 5.55 microns and a particle size distribution of 1.33. At this point, the pH of the solution was adjusted to 8.0 using 4 percent sodium hydroxide solution. The mixture was then heated at a controlled rate of 0.5° C. per minute to 96° C.

After the particle slurry had maintained the reaction temperature of 96° C. for 1 hour, the pH was dropped to 5.5 using 1 molar nitric acid, followed by maintenance of this temperature for 6 hours. After cooling the reaction mixture to room temperature, the particles were washed and reslurried in deionized water. The average particle size of the marking particles was 5.6 microns and the particle size distribution was 1.24. A total of 5 washes were performed before the particle surface was treated by the in situ polymerization of the conductive polymer.

Into a 250 milliliter beaker was added 150 grams of the cyan marking particle size particle slurry (average particle diameter 5.6 microns; particle size distribution GSD 1.24) thus prepared, providing a total of 18.7 grams of solid material in the solution. The solution was then further diluted with deionized water to create a 200 gram particle slurry. Into this stirred solution was added 1.25 grams (0.00658 mole) of the dopant para-toluene sulfonic acid (p-TSA) and the pH was measured as 2.4. After 15 minutes, 1.87 grams (0.0132 mole) of 3,4-ethylenedioxythiophene monomer (EDOT) diluted in 2 milliliters of acetonitrile was added to the solution. The molar ratio of dopant to EDOT was 0.5:1, and EDOT was present in an amount of 10 percent by weight of the marking particles. After 1 hour, the dissolved oxidant ammonium persulfate (7.53 grams (0.033 mole) in 10 milliliters of deionized water) was added dropwise over a 10 minute period. The molar ratio of oxidant to EDOT was 2.5:1. The solution was then stirred overnight at room temperature. The resulting bluish marking particles (with the slight coloration being the result of the PEDOT particle coating) in a yellowish supernatant solution were washed 5 times with distilled water and then dried with a freeze dryer for 48 hours. The solution conductivity was measured on the supernatant using an Accumet Research AR20 pH/conductivity meter purchased from Fisher Scientific and found to be $5.499\times10^{-2}$ Siemens per centimeter. The chemical oxidative polymerization of EDOT to produce PEDOT occurred on the marking particle surface, and the particle surfaces were rendered semi-conductive by the presence of the sulfonate groups from the marking particle surfaces and by the added p-TSA. The measured average bulk conductivity of a pressed pellet of this marking material was $\sigma=1.9\times10^{-9}$ Siemens per centimeter.

EXAMPLE XXXIV

Cyan marking particles were prepared as described in Example XXXIII. Into a 250 milliliter beaker was added 150 grams of the cyan marking particle size particle slurry (average particle diameter 5.6 microns, particle size distribution GSD 1.24) thus prepared, providing a total of 18.7 grams of solid material in the solution. The solution was then further diluted with deionized water to create a 200 gram particle slurry. Into this stirred solution was added 2.51 grams (0.0132 mole) of the dopant para-toluene sulfonic acid (p-TSA) and the pH was measured as 0.87. After 15 minutes, 1.87 grams (0.0132 mole) of 3,4-ethylenedioxythiophene monomer (EDOT) was added to the solution. The molar ratio of dopant to EDOT was 1:1, and EDOT was present in an amount of 10 percent by weight of the marking particles. After 2 hours, the dissolved oxidant ammonium persulfate (7.53 grams (0.033 mole) in 10 milliliters of deionized water) was added dropwise over a 10 minute period. The molar ratio of oxidant to EDOT was 2.5:1. The solution was then stirred overnight at room temperature. The resulting bluish marking particles (with the slight coloration being the result of the PEDOT particle coating) in a yellowish supernatant solution were washed 5 times with distilled water and then dried with a freeze dryer for 48 hours. The solution conductivity was measured on the supernatant using an Accumet Research AR20 pH/conductivity meter purchased from Fisher Scientific and found to be $5.967\times10^{-2}$ Siemens per centimeter. The chemical oxidative polymerization of EDOT to produce PEDOT occurred on the marking particle surface, and the particle surfaces were rendered semi-conductive by the presence of the sulfonate groups from the marking particle surfaces and by the added p-TSA. The measured average bulk conductivity of a pressed pellet of this marking material was $\sigma=1.3\times10^{-7}$ Siemens per centimeter.

EXAMPLE XXXV

A black marking material is prepared as follows. 92 parts by weight of a styrene-n-butylmethacrylate polymer containing 58 percent by weight styrene and 42 percent by weight n-butylmethacrylate, 6 parts by weight of Regal 330® carbon black from Cabot Corporation, and 2 parts by weight of cetyl pyridinium chloride are melt blended in an extruder wherein the die is maintained at a temperature of between 130 and 145° C. and the barrel temperature ranges from about 80 to about 100° C., followed by micronization and air classification to yield marking particles of a size of 12 microns in volume average diameter.

The black marking material of 12 microns thus prepared is then resuspended in an aqueous surfactant solution and surface treated by oxidative polymerization of 3,4-ethylenedioxythiophene monomer to render the insulative marking particle surface conductive by a shell of intrinsically conductive polymer poly(3,4-ethylenedioxythiophene). Into a 500 milliliter beaker containing 250 grams of deionized water is dissolved 15.132 grams (0.044 mole) of a sulfonated water soluble surfactant sodium dodecylbenzene sulfonate (SDBS available from Aldrich Chemical Co., Milwaukee, Wis.). The sulfonated surfactant also functions as a dopant to rendered the PEDOT polymer conductive. To the homogeneous solution is added 25 grams of the dried 12 micron black marking particles. The slurry is stirred for two hours to allow the surfactant to wet the marking particle surface and produce a well-dispersed marking particle slurry without any agglomerates of marking particles. The marking particles are loaded at 10 percent by weight of the slurry. After 2 hours, 2.5 grams (0.0176 mole) of 3,4-ethylenedioxythiophene monomer is added to the solution. The molar ratio of dopant to EDOT is 2.5:1, and EDOT is present in an amount of 10 percent by weight of the marking particles. After 2 hours, the dissolved oxidant (ammonium persulfate 5.02 grams (0.0219 mole) in 10 milliliters of deionized water) is added dropwise over a 10 minute period. The molar ratio of oxidant to EDOT is 1.25:1. The solution is stirred overnight at room temperature and then allowed to stand for 3 days. The particles are then washed and dried. It is believed that the resulting conductive black marking particles will have a bulk conductivity in the range of $10^{-4}$ to $10^{-3}$ Siemens per centimeter.

EXAMPLE XXXVI

A red marking material is prepared as follows. 85 parts by weight of styrene butadiene, 1 part by weight of distearyl dimethyl ammonium methyl sulfate, available from Hexcel Corporation, 13.44 parts by weight of a 1:1 blend of styrene-n-butylmethacrylate and Lithol Scarlet NB3755 from BASF, and 0.56 parts by weight of Hostaperm Pink E from Hoechst Corporation are melt blended in an extruder wherein the die is maintained at a temperature of between 130 and 145° C.

and the barrel temperature ranges from about 80 to about 100° C., followed by micronization and air classification to yield marking particles of a size of 11.5 microns in volume average diameter.

The red marking material thus prepared is then resuspended in an aqueous surfactant solution and surface treated by oxidative polymerization of 3,4-ethylenedioxythiophene monomer to render the insulative marking particle surface conductive by a shell of intrinsically conductive polymer poly(3,4-ethylenedioxythiophene) by the method described in Example XXXV. It is believed that the resulting conductive red marking particles will have a bulk conductivity in the range of $10^{-4}$ to $10^{-3}$ Siemens per centimeter.

EXAMPLE XXXVII

A blue marking material is prepared as follows. 92 parts by weight of styrene butadiene, 1 part by weight of distearyl dimethyl ammonium methyl sulfate, available from Hexcel Corporation, and 7 parts by weight of PV Fast Blue from BASF are melt blended in an extruder wherein the die is maintained at a temperature of between 130 and 145° C. and the barrel temperature ranges from about 80 to about 100° C., followed by micronization and air classification to yield marking particles of a size of 12 microns in volume average diameter.

The blue marking material thus prepared is then resuspended in an aqueous surfactant solution and surface treated by oxidative polymerization of 3,4-ethylenedioxythiophene monomer to render the insulative marking particle surface conductive by a shell of intrinsically conductive polymer poly(3,4-ethylenedioxythiophene) by the method described in Example XXXV. It is believed that the resulting conductive blue marking particles will have a bulk conductivity in the range of $10^{-4}$ to $10^{-3}$ Siemens per centimeter.

EXAMPLE XXXVIII

A green marking material is prepared as follows. 89.5 parts by weight of styrene butadiene, 0.5 part by weight of distearyl dimethyl ammonium methyl sulfate, available from Hexcel Corporation, 5 parts by weight of Sudan Blue from BASF, and 5 parts by weight of Permanent FGL Yellow from E. I. Du Pont de Nemours and Company are melt blended in an extruder wherein the die is maintained at a temperature of between 130 and 145° C. and the barrel temperature ranges from about 80 to about 100° C., followed by micronization and air classification to yield marking particles of a size of 12.5 microns in volume average diameter.

The green marking material thus prepared is then resuspended in an aqueous surfactant solution and surface treated by oxidative polymerization of 3,4-ethylenedioxythiophene monomer to render the insulative marking particle surface conductive by a shell of intrinsically conductive polymer poly(3,4-ethylenedioxythiophene) by the method described in Example XXXV. It is believed that the resulting conductive green marking particles will have a bulk conductivity in the range of $10^{-4}$ to $10^{-3}$ Siemens per centimeter.

EXAMPLE XXXIX

A microencapsulated marking material is prepared using the following procedure. Into a 250 milliliter polyethylene bottle is added 39.4 grams of a styrene monomer (Polysciences Inc.), 26.3 grams of an n-butyl methacrylate monomer (Polysciences Inc.), 43.8 grams of a 52/48 ratio of styrene/n-butyl methacrylate copolymer resin, 10.5 grams of Lithol Scarlet D3700 pigment (BASF), and 5 millimeter diameter ball bearings which occupy 40 to 50 percent by volume of the total sample. This sample is ball milled for 24 to 48 hours to disperse the pigment particles into the monomer/polymer mixture. The composition thus formed comprises about 7 percent by weight of pigment, about 20 percent by weight of shell polymer, and about 73 percent by weight of the mixture of core monomers and polymers, which mixture comprises about 40 percent by weight of a styrene-n-butyl methacrylate copolymer with about 52 percent by weight of styrene and about 48 percent by weight of n-butyl methacrylate, about 35 percent by weight of styrene monomer, and about 24 percent by weight of n-butyl methacrylate monomer. After ball milling, 250 milliliters of the pigmented monomer solution is transferred into another polyethylene bottle, and into the solution is dispersed with a Brinkmann PT45/80 homogenizer and a PTA-20TS probe for 1 minute at 6,000 rpm 10.2 grams of terephthaloyl chloride (Fluka), 8.0 grams of 1,3,5-benzenetricarboxylic acid chloride, (Aldrich), 263 grams of 2,2'-azo-bis(2,4-dimethylvaleronitrile), (Polysciences Inc.), and 0.66 grams of 2,2'-azo-bis-isobutyronitrile (Polysciences Inc.). Into a stainless steel 2 liter beaker containing 500 milliliters of an about 2.0 percent by weight polyvinylalcohol solution, weight-average molecule weight 96,000, about 88 percent by weight hydrolyzed (Scientific Polymer Products), and 0.5 milliliters of 2-decanol (Aldrich), is dispersed the above pigmented monomer solution with a Brinkmann PT45/80 homogenizer and a PTA-35/4G probe at 10,000 rpm for 3 minutes. The dispersion is performed in a cold water bath at 15° C. This mixture is transferred into a 2 liter glass reactor equipped with a mechanical stirrer and an oil bath under the beaker. While stirring the solution vigorously, an aqueous solution of 8.0 grams of diethylene triamine (Aldrich), 5.0 grams of 1,6-hexanediamine (Aldrich), and 25 milliliters of distilled water is added dropwise over a 2 to 3 minute period. Simultaneously, from a separatory dropping funnel a basic solution comprising 13.0 grams of sodium carbonate (Baker) and 30 milliliters of distilled water is also added dropwise over a 10 minute period. After complete addition of the amine and base solutions, the mixture is stirred for 2 hours at room temperature. During this time the interfacial polymerization occurs to form a polyamide shell around the core material. While still stirring, the volume of the reaction mixture is increased to 1.5 liters with distilled water, and an aqueous solution containing 3.0 grams of potassium iodide (Aldrich) dissolved in 10.0 milliliters of distilled water is added. After the initial 2 hours and continuous stirring, the temperature is increased to 65° C. for 4 hours to initiate the free radical polymerization of the core. Following this 4 hour period, the temperature is increased again to 85° C. for 8 hours to complete the core polymerization and to minimize the amount of residual monomers encapsulated by the shell. The solution is then cooled to room temperature and is washed 7 times with distilled water by settling and decanting off the supernatant.

Particle size is determined by screening the particles through 425 and 250 micron sieves and then spray drying using a Yamato-Ohkawara spray dryer model DL-41. The average particle size is about 14.5 microns with a GSD of 1.7 as determined with a Coulter Counter.

While the marking particles are still suspended in water (prior to drying and measuring particle size), the particle surfaces are treated by oxidative polymerization of 3,4-ethylenedioxythiophene monomer and doped to produce a conductive polymeric shell on top of the polyamide shell encapsulating the red marking particle core. Into a 250 milliliter beaker is added 150 grams of the red marking particle slurry thus prepared, providing a total of 25.0 grams of solid material in the solution. The solution is then further diluted with deionized water to create a 250 gram particle slurry. Into this stirred solution is added 8.37 grams (0.0440 mole) of the dopant para-toluene sulfonic acid (p-TSA). After 15 minutes, 2.5 grams (0.0176 mole) of 3,4-ethylenedioxythiophene monomer (EDOT) is added to the solution. The molar ratio of dopant to EDOT is 2.5:1, and EDOT is present in an amount of 10 percent by weight of the marking particles. After 2 hours, the dissolved oxidant (ammonium persulfate 5.02 grams (0.0219 mole) in 10 milliliters of deionized water) is added dropwise over a 10 minute period. The molar ratio of oxidant to EDOT is 1.25:1. The solution is stirred overnight at room temperature and then allowed to stand for 3 days. The particles are washed once with distilled water and then dried with a freeze dryer for 48 hours. The chemical oxidative polymerization of EDOT to produce PEDOT occurs on the marking particle surfaces, and the particle surfaces are rendered conductive by the presence of the dopant sulfonate groups. It is believed that the average bulk conductivity of a pressed pellet of this marking material will be about $10^{-4}$ to about $10^{-3}$ Siemens per centimeter.

EXAMPLE XL

A microencapsulated marking material is prepared using the following procedure. Into a 250 milliliter polyethylene bottle is added 10.5 grams of Lithol Scarlet D3700 (BASF), 52.56 grams of styrene monomer (Polysciences Inc.), 35.04 grams of n-butyl methacrylate monomer (Polysciences Inc.), 21.9 grams of a 52/48 ratio of styrene/n-butyl methacrylate copolymer resin, and 5 millimeter diameter ball bearings which occupy 40 percent by volume of the total sample. This sample is ball milled overnight for approximately 17 hours to disperse the pigment particles into the monomer/polymer mixture. The composition thus formed comprises 7 percent by weight pigment, 20 percent by weight shell material, and 73 percent by weight of the mixture of core monomers and polymers, wherein the mixture comprises 20 percent polymeric resin, a 52/48 styrene/n-butyl methacrylate monomer ratio, 48 percent styrene monomer, and 32 percent n-butyl methacrylate. After ball milling, the pigmented monomer solution is transferred into another 250 milliliter polyethylene bottle, and into this is dispersed with a Brinkmann PT45/80 homogenizer and a PTA-20TS generator probe at 5,000 rpm for 30 seconds 12.0 grams of sebacoyl chloride (Aldrich), 8.0 grams of 1,35-benzenetricarboxylic acid chloride (Aldrich), 1.8055 grams of 2,2'-azo-bis(2,3-dimethylvaleronitrile), (Polysciences Inc.), and 0.5238 gram of 2,2'-azo-bis-isobutyronitrile, (Polysciences Inc.). Into a stainless steel 2 liter beaker containing 500 milliliters of 2.0 percent polyvinylalcohol solution, weight-average molecular weight 96,000, 88 percent hydrolyzed (Scientific Polymer Products), 0.3 gram of potassium iodide (Aldrich), and 0.5 milliliter of 2-decanol (Aldrich) is dispersed the above pigmented organic phase with a Brinkmann PT45/80 homogenizer and a PTA-20TS probe at 10,000 rpm for 1 minute. The dispersion is performed in a cold water bath at 15° C. This mixture is transferred into a 2 liter glass reactor equipped with a mechanical stirrer and an oil bath under the beaker. While stirring the solution vigorously, an aqueous solution of 8.0 grams of diethylene triamine (Aldrich), 5.0 grams of 1,6-hexanediamine (Aldrich), and 25 milliliters of distilled water is added dropwise over a 2 to 3 minute period. Simultaneously, from a separatory dropping funnel a basic solution comprising 13.0 grams of sodium carbonate (Baker) and 30 milliliters of distilled water is also added dropwise over a 10 minute period. After complete addition of the amine and base solutions, the mixture is stirred for 2 hours at room temperature. During this time, interfacial polymerization occurs to form a polyamide shell around the core materials. While stirring, the volume of the reaction mixture is increased to 1.5 liters with distilled water, followed by increasing the temperature to 54° C. for 12 hours to polymerize the core monomers. The solution is then cooled to room temperature and is washed 7 times with distilled water by settling the particles and decanting off the supernatant. Before spray drying, the particles are screened through 425 and 250 micron sieves and then spray dried using a Yamato-Ohkawara spray dryer model DL-41 with an inlet temperature of 120° C. and an outlet temperature of 65° C. The average particle size is about 14.5 microns with a GSD value of 1.66 as determined with a Coulter Counter.

While the marking particles are still suspended in water (prior to drying and measuring particle size), the particle surfaces are treated by oxidative polymerization of 3,4-ethylenedioxythiophene monomer and doped to produce a conductive polymeric shell on top of the shell encapsulating the marking particle core by the method described in Example XXXIX. It is believed that the average bulk conductivity of a pressed pellet of the resulting marking material will be about $10^{-4}$ to about $10^{-3}$ Siemens per centimeter.

EXAMPLE XLI

A microencapsulated marking material is prepared by the following procedure. Into a 250 milliliter polyethylene bottle is added 13.1 grams of styrene monomer (Polysciences Inc.), 52.6 grams of n-butyl methacrylate monomer (Polysciences Inc.), 33.3 grams of a 52/48 ratio of styrene/n-butyl methacrylate copolymer resin, and 21.0 grams of a mixture of Sudan Blue OS pigment (BASF) flushed into a 65/35 ratio of styrene/n-butyl methacrylate copolymer resin wherein the pigment to polymer ratio is 50/50. With the aid of a Burrell wrist shaker, the polymer and pigment are dispersed into the monomers for 24 to 48 hours. The composition thus formed comprises 7 percent by weight of pigment, 20 percent by weight shell, and 73 percent by weight of the mixture of core monomers and polymers, which mixture comprises 9.6 percent copolymer resin (65/35 ratio of styrene/n-butyl methacrylate monomers), 30.4 percent copolymer resin (52/48 ratio of styrene/n-butyl methacrylate monomers), 12 percent styrene monomer, and 48.0 percent n-butyl methacrylate monomer. Once the pigmented monomer solution is homogeneous, into this mixture is dispersed with a Brinkmann PT45/80 homogenizer and a PTA-20TS probe for 30 seconds at 5,000 rpm 20.0 grams of liquid isocyanate (tradename Isonate 143L or liquid MDI), (Upjohn Polymer Chemicals), 1.314 grams of 2,2'-azo-bis(2,4-dimethylvaleronitrile) (Polysciences Inc.), and 0.657 gram of 2,2'-azo-bis-isobutyronitrile (Polysciences Inc.). Into a stainless steel 2 liter beaker containing 600 milliliters of 1.0 percent polyvinylalcohol solution, weight-average molecular weight 96,000, 88 percent hydrolized (Scientific Polymer Products) and 0.5 milliliters of 2-decanol (Aldrich) is dispersed the above pigmented monomer solution with a Brinkmann PT45/80 homogenizer and a PTA-35/4G probe at 10,000 rpm for 1 minute. The dispersion is performed in a cold water bath at 15° C. This mixture is transferred into a 2 liter reactor equipped with a mechanical stirrer and an oil bath under the beaker. While stirring the solution vigorously, an aqueous solution of 5.0 grams of diethylene triamine (Aldrich), 5.0 grams of 1,6-hexanediamine (Aldrich), and 100 milliliters of distilled water is poured into the reactor and the mixture is stirred for 2 hours at room temperature. During this time interfacial polymerization occurs to form a polyurea shell around the core material. While still stirring, the volume of the reaction mixture is increased to 1.5 liters with 1.0 percent polyvinylalcohol solution and an aqueous solution containing 0.5 gram of potassium iodide (Aldrich) dissolved in 10.0 milliliters of distilled water is added. The pH of the solution is adjusted to pH 7 to 8 with dilute hydrochloric acid (BDH) and is then heated for 12 hours at 85° C. while still stirring. During this time, the monomeric material in the core undergoes free radical polymerization to complete formation of the core material. The solution is cooled to room temperature and is washed 7 times with distilled water. The particles are screened wet through 425 and 250 micron sieves and then spray dried using a Yamato-Ohkawara spray dryer model DL-41. The average particle size is about 164 microns with a GSD of 1.41 as determined by a Coulter Counter.

While the marking particles are still suspended in water (prior to drying and measuring particle size), the particle surfaces are treated by oxidative polymerization of 3,4-ethylenedioxythiophene monomer and doped to produce a conductive polymeric shell on top of the shell encapsulating the marking particle core by the method described in Example XXXIX. It is believed that the average bulk conductivity of a pressed pellet of the resulting marking material will be about $10^{-4}$ to about $10^{-3}$ Siemens per centimeter.

EXAMPLE XLII

Marking particles comprising about 92 percent by weight of a poly-n-butylmethacrylate resin with an average molecular weight of about 68,000, about 6 percent by weight of Regal® 330 carbon black, and about 2 percent by weight of cetyl pyridinium chloride are prepared by the extrusion process and have an average particle diameter of 11 microns.

The black marking material thus prepared is then resuspended in an aqueous surfactant solution and surface treated by oxidative polymerization of 3,4-ethylenedioxythiophene monomer to render the insulative marking particle surface conductive by a shell of intrinsically conductive polymer poly(3,4-ethylenedioxythiophene) by the method described in Example XXXV. It is believed that the resulting conductive black marking particles will have a bulk conductivity in the range of $10^{-4}$ to $10^{-3}$ Siemens per centimeter.

EXAMPLE XLIII

A blue marking material is prepared containing 90.5 percent by weight Pliotone® resin (obtained from Goodyear), 7.0 percent by weight PV Fast Blue B2G-A pigment (obtained from Hoechst-Celanese), 2.0 percent by weight Bontron E-88 aluminum compound charge control agent (obtained from Orient Chemical, Japan), and 0.5 percent by weight cetyl pyridinium chloride charge control agent (obtained from Hexcel Corporation). The marking material components are first dry blended and then melt mixed in an extruder. The extruder strands are cooled, chopped into small pellets, ground into marking particles, and then classified to narrow the particle size distribution. The marking particles have a particle size of 12.5 microns in volume average diameter.

The blue marking material thus prepared is then resuspended in an aqueous surfactant solution and surface treated by oxidative polymerization of 3,4-ethylenedioxythiophene monomer to render the insulative marking particle surface conductive by a shell of intrinsically conductive polymer poly(3,4-ethylenedioxythiophene) by the method described in Example XXXV. It is believed that the resulting conductive blue marking particles will have a bulk conductivity in the range of $10^{-4}$ to $10^{-3}$ Siemens per centimeter.

EXAMPLE XLIV

A red marking material is prepared as follows. 91.72 parts by weight Pliotone® resin (obtained from Goodyear), 1 part by weight distearyl dimethyl ammonium methyl sulfate (obtained from Hexcel Corporation), 6.72 parts by weight Lithol Scarlet NB3755 pigment (obtained from BASF), and 0.56 parts by weight Magenta Predisperse (Hostaperm Pink E pigment dispersed in a polymer resin, obtained from Hoechst-Celanese) are melt blended in an extruder wherein the die is maintained at a temperature of between 130 and 145° C. and the barrel temperature ranges from about 80 to about 100° C., followed by micronization and air classification to yield marking particles of a size of 12.5 microns in volume average diameter.

The red marking material thus prepared is then resuspended in an aqueous surfactant solution and surface treated by oxidative polymerization of 3,4-ethylenedioxythiophene monomer to render the insulative marking particle surface conductive by a shell of intrinsically conductive polymer poly(3,4-ethylenedioxythiophene) by the method described in Example XXXV. It is believed that the resulting conductive red marking particles will have a bulk conductivity in the range of $10^{-4}$ to $10^{-3}$ Siemens per centimeter.

EXAMPLE XLV

Unpigmented marking particles were prepared by aggregation of a styrene/n-butyl acrylate/acrylic acid latex using a flocculent (poly(aluminum chloride)) followed by particle coalescence at elevated temperature. The polymeric latex was prepared by the emulsion polymerization of styrene/n-butyl acrylate/acrylic acid (monomer ratio 82 parts by weight styrene, 18 parts by weight n-butyl acrylate, 2 parts by weight acrylic acid) in a nonionic/anionic surfactant solution (40.0 percent by weight solids) as follows; 279.6 kilograms of styrene, 61.4 kilograms of n-butyl acrylate, 6.52 kilograms of acrylic acid, 3.41 kilograms of carbon tetrabromide, and 11.2 kilograms of dodecanethiol were mixed with 461 kilograms of deionized water in which had been dissolved 7.67 kilograms of sodium dodecyl benzene sulfonate anionic surfactant (Neogen RK; contains 60 percent active component), 3.66 kilograms of a nonophenol ethoxy nonionic surfactant (Antarox CA-897, 100 percent active material), and 3.41 kilograms of ammonium persulfate polymerization initiator dissolved in 50 kilograms of deionized water. The emulsion thus formed was polymerized at 70° C. for 3 hours, followed by heating to 85° C. for an additional 1 hour. The resulting latex contained 59.5 percent by weight water and 40.5 percent by weight solids, which solids comprised particles of a random copolymer of poly(styrene/n-butyl acrylate/acrylic acid); the glass transition temperature of the latex dry sample was 47.7° C., as measured on a DuPont DSC. The latex had a weight average molecular weight of 30,600 and a number average molecular weight of 4,400 as determined with a Waters gel permeation chromatograph. The particle size of the latex as measured on a Disc Centrifuge was 278 nanometers.

Thereafter, 375 grams of the styrene/n-butyl acrylate/acrylic acid anionic latex thus prepared was diluted with 761.43 grams of deionized water. The diluted latex solution was blended with an acidic solution of the flocculent (3.35 grams of poly(aluminum chloride) in 7.86 grams of 1 molar nitric acid solution) using a high shear homogenizer at 4,000 to 5,000 revolutions per minute for 2 minutes, producing a flocculation or heterocoagulation of gelled particles consisting of nanometer sized latex particles. The slurry was heated at a controlled rate of 0.25° C. per minute to 50° C., at which point the average particle size was 4.5 microns and the particle size distribution was 1.17. At this point the pH of the solution was adjusted to 7.0 using 4 percent sodium hydroxide solution. The mixture was then heated at a controlled rate of 0.5° C. per minute to 95° C. Once the particle slurry reacted at the reaction temperature of 95° C., the pH was dropped to 5.0 using 1 molar nitric acid, followed by maintenance of this temperature for 6 hours. The particles were then cooled to room temperature. From this marking material slurry 150 grams was removed and washed 6 times by filtration and resuspension in deionized water. The particles were then dried with a freeze dryer for 48 hours. The average particle size of the marking particles was 5.2 microns and the particle size distribution was 1.21. The bulk conductivity of this sample when pressed into a pellet was $7.2\times10^{-15}$ Siemens per centimeter. The percent cohesion was measured to be 21.5 percent by a Hosokawa flow tester.

Into a 250 milliliter beaker was added 150 grams of a pigmentless marking particle size particle slurry (average particle diameter 5.7 microns; particle size distribution GSD 1.24) providing a total of 11.25 grams of solid material in the solution. The pH of the solution was then adjusted by adding the dopant, para-toluene sulfonic acid (pTSA) until the pH was 2.73. Into this stirred solution was dissolved the oxidant ammonium persulfate (1.81 grams; 7.93 mmole). After 15 minutes, 0.45 grams (3.17 mmole) of 3,4-ethylenedioxythiophene monomer (EDOT) was added to the solution. The molar ratio of oxidant to EDOT was 2.5:1, and EDOT was present in an amount of 4 percent by weight of the marking particles. The reaction was stirred overnight at room temperature. The resulting greyish marking particles (with the slight coloration being the result of the PEDOT particle coating) were washed 6 times with distilled water and then dried with a freeze dryer for 48 hours. The chemical oxidative polymerization of EDOT to produce PEDOT occurred on the marking particle surface, and the particle surfaces were rendered slightly conductive by the presence of the sulfonate groups from the marking particle surfaces and by the added pTSA. The average particle size of the marking particles was 5.1 microns and the particle size distribution was 1.24. The bulk conductivity of this sample when pressed into a pellet was $3.1\times10^{-13}$ Siemens per centimeter.

EXAMPLE XLVI

Unpigmented marking particles were prepared by the method described in Example XLV. Into a 250 milliliter beaker was added 150 grams of a pigmentless marking particle size particle slurry (average particle diameter 5.7 microns; particle size distribution GSD 1.24) providing a total of 20.0 grams of solid material in the solution. The pH of the solution was not adjusted before the oxidant was added. Into this stirred solution was dissolved the oxidant ammonium persulfate (3.7 grams; 0.0162 mole). After 15 minutes, 2.0 grams (0.0141 mole) of 3,4-ethylenedioxythiophene monomer (EDOT) was added to the solution. The molar ratio of oxidant to EDOT was 1.1:1, and EDOT was present in an amount of 10 percent by weight of the marking particles. The reaction was stirred overnight at room temperature. The resulting greyish marking particles (with the slight coloration being the result of the PEDOT particle coating) were washed 6 times with distilled water and then dried with a freeze dryer for 48 hours. The chemical oxidative polymerization of EDOT to produce PEDOT occurred on the marking particle surfaces, and the particle surfaces were rendered slightly conductive by the presence of the sulfonate groups from the marking particle surfaces. The average particle size of the marking particles was 5.2 microns and the particle size distribution was 1.23. The bulk conductivity of this sample when pressed into a pellet was $3.8\times10^{-13}$ Siemens per centimeter.

EXAMPLE XLVII

Marking particles were prepared by aggregation of a styrene/n-butyl acrylate/styrene sulfonate sodium salt/acrylic acid latex using a flocculent (poly(aluminum chloride)) followed by particle coalescence at elevated temperature. The polymeric latex was prepared by the emulsion polymerization of styrene/n-butyl acrylate/styrene sulfonate sodium salt/acrylic acid (monomer ratio 81.5 parts by weight styrene, 18 parts by weight n-butyl acrylate, 0.5 parts by weight of styrene sulfonate sodium salt, 2 parts by weight acrylic acid) without a nonionic surfactant and without an anionic surfactant. The solution consisted of 40.0 percent by weight solids as follows; 277.92 kilograms of styrene, 61.38 kilograms of n-butyl acrylate, 1.7 kilograms of styrene sulfonate sodium salt, 6.52 kilograms of acrylic acid, 3.41 kilograms of carbon tetrabromide, and 11.2 kilograms of dodecanethiol were mixed with 461 kilograms of deionized water and 3.41 kilograms of ammonium persulfate polymerization initiator dissolved in 50 kilograms of deionized water. The emulsion thus formed was polymerized at 70° C. for 3 hours, followed by heating to 85° C. for an additional 1 hour. The resulting self stabilized latex contained 59.5 percent by weight water and 40.5 percent by weight solids, which solids comprised particles of a random copolymer; the glass transition temperature of the latex dry sample was 48° C., as measured on a DuPont DSC. The latex had a weight average molecular weight of 30,600 and a number average molecular weight of 5,000 as determined with a Waters gel permeation chromatograph. The particle size of the latex as measured on a Disc Centrifuge was 278 nanometers.

From the latex thus prepared 50 grams was diluted with 100 milliliters of water in a 250 milliliter beaker for a solids loading of 20 grams. The pH of the slurry was not adjusted. Into this stirred solution was dissolved the oxidant ammonium persulfate (3.7 grams; 0.0162 mole). After 15 minutes, 2.0 grams (0.0141 mole) of 3,4-ethylenedioxythiophene monomer (EDOT) diluted in 5 milliliters of acetonitrile was added to the solution. The molar ratio of oxidant to EDOT was 1.1:1, and EDOT was present in an amount of 10 percent by weight of the marking particles. The reaction was stirred overnight at room temperature. The particles were then dried with a freeze dryer for 48 hours. The average particle size of the marking particles was in the nanometer size range. The bulk conductivity of this sample when pressed into a pellet was $1.3\times10^{-7}$ Siemens per centimeter.

EXAMPLE XLVIII

Unpigmented marking particles were prepared by the method described in Example XLV. Into a 250 milliliter beaker was added 150 grams of a pigmentless marking particle size particle slurry (average particle diameter 5.7 microns; particle size distribution GSD 1.24) providing a total of 11.25 grams of solid material in the solution. The pH of the solution was then adjusted by adding the dopant para-toluene sulfonic acid (pTSA) until the pH was 2.73. Into this stirred solution was dissolved the oxidant ferric chloride (1.3 grams; 8.0 mmole). After 15 minutes, 0.45 grams (3.17 mmole) of 3,4-ethylenedioxythiophene monomer (EDOT) was added to the solution. The molar ratio of oxidant to EDOT was 2.5:1, and EDOT was present in an amount of 4 percent by weight of the marking particles. The reaction was stirred overnight at room temperature. The resulting greyish marking particles (with the slight coloration being the result of the PEDOT particle coating) were washed 6 times with distilled water and then dried with a freeze dryer for 48 hours. The chemical oxidative polymerization of EDOT to produce PEDOT occurred on the marking particle surfaces, and the particle surfaces were rendered slightly conductive by the presence of the sulfonate groups from the marking particle surfaces and by the added pTSA. The average particle size of the marking particles was 5.1 microns and the particle size distribution was 1.22. The bulk conductivity of this sample when pressed into a pellet was $1.7\times10^{-13}$ Siemens per centimeter.

EXAMPLE XLIX

Marking particles were prepared by aggregation of a styrene/n-butyl acrylate/styrene sulfonate sodium salt/acrylic acid latex using a flocculent (poly(aluminum chloride)) followed by particle coalescence at elevated temperature. The polymeric latex was prepared by the emulsion polymerization of styrene/n-butyl acrylate/styrene sulfonate sodium salt/acrylic acid (monomer ratio 81.5 parts by weight styrene, 18 parts by weight n-butyl acrylate, 0.5 parts by weight of styrene sulfonate sodium salt, 2 parts by weight acrylic acid) without a nonionic surfactant and without an anionic surfactant. The solution consisted of 40.0 percent by weight solids as follows; 277.92 kilograms of styrene, 61.38 kilograms of n-butyl acrylate, 1.7 kilograms of styrene sulfonate sodium salt, 6.52 kilograms of acrylic acid, 3.41 kilograms of carbon tetrabromide, and 11.2 kilograms of dodecanethiol were mixed with 461 kilograms of deionized water and 3.41 kilograms of ammonium persulfate polymerization initiator dissolved in 50 kilograms of deionized water. The emulsion thus formed was polymerized at 70° C. for 3 hours, followed by heating to 85° C. for an additional 1 hour. The resulting self stabilized latex contained 59.5 percent by weight water and 40.5 percent by weight solids, which solids comprised particles of a random copolymer; the glass transition temperature of the latex dry sample was 48° C., as measured on a DuPont DSC. The latex had a weight average molecular weight of 30,600 and a number average molecular weight of 5,000 as determined with a Waters gel permeation chromatograph. The particle size of the latex as measured on a Disc Centrifuge was 278 nanometers.

From the latex thus prepared 50 grams was diluted with 100 milliliters of water in a 250 milliliter beaker for a solids loading of 20 grams. The pH of the slurry was not adjusted. Into this stirred solution was dissolved the oxidant ferric chloride (5.7 grams; 0.0352 mole). After 30 minutes, 2.0 grams (0.0141 mole) of 3,4-ethylenedioxythiophene monomer (EDOT) was added to the solution. The molar ratio of oxidant to EDOT was 2.5:1, and EDOT was present in an amount of 10 percent by weight of the marking particles. The reaction was stirred overnight at room temperature. The particles were then dried with a freeze dryer for 48 hours. The average particle size of the marking particles was in the nanometer size range. The bulk conductivity of this sample when pressed into a pellet was $3.5\times10^{-9}$ Siemens per centimeter.

EXAMPLE L

Marking particles were prepared by aggregation of a styrene/n-butyl acrylate/styrene sulfonate sodium salt/acrylic acid latex using a flocculent (poly(aluminum chloride)) followed by particle coalescence at elevated temperature. The polymeric latex was prepared by the emulsion polymerization of styrene/n-butyl acrylate/styrene sulfonate sodium salt/acrylic acid (monomer ratio 81.5 parts by weight styrene, 18 parts by weight n-butyl acrylate, 0.5 parts by weight of styrene sulfonate sodium salt, 2 parts by weight acrylic acid) without a nonionic surfactant and without an anionic surfactant. The solution consisted of 40.0 percent by weight solids as follows; 277.92 kilograms of styrene, 61.38 kilograms of n-butyl acrylate, 1.7 kilograms of styrene sulfonate sodium salt, 6.52 kilograms of acrylic acid, 3.41 kilograms of carbon tetrabromide, and 11.2 kilograms of dodecanethiol were mixed with 461 kilograms of deionized water and 3.41 kilograms of ammonium persulfate polymerization initiator dissolved in 50 kilograms of deionized water. The emulsion thus formed was polymerized at 70° C. for 3 hours, followed by heating to 85° C. for an additional 1 hour. The resulting self stabilized latex contained 59.5 percent by weight water and 40.5 percent by weight solids, which solids comprised particles of a random copolymer; the glass transition temperature of the latex dry sample was 48° C., as measured on a DuPont DSC. The latex had a weight average molecular weight of 30,600 and a number average molecular weight of 5,000 as determined with a Waters gel permeation chromatograph. The particle size of the latex as measured on a Disc Centrifuge was 278 nanometers.

From the latex thus prepared 50 grams was diluted with 100 milliliters of water in a 250 milliliter beaker for a solids loading of 20 grams. The pH of the slurry was not adjusted. Into this stirred solution was dissolved the oxidant ferric chloride (1.15 grams; 7.09 mmole), After 15 minutes, 2.0 grams (0.0141 mole) of 3,4-ethylenedioxythiophene monomer (EDOT) was added to the solution. The molar ratio of oxidant to EDOT was 0.5:1, and EDOT was present in an amount of 10 percent by weight of the marking particles. The reaction was stirred overnight at room temperature. The particles were then dried with a freeze dryer for 48 hours. The average particle size of the marking particles was in the nanometer size range. The bulk conductivity of this sample when pressed into a pellet was $1.5\times10^{-7}$ Siemens per centimeter.

EXAMPLE LI

A linear sulfonated random copolyester resin comprising 46.5 mole percent terephthalate, 3.5 mole percent sodium sulfoisophthalate, 47.5 mole percent 1,2-propanediol, and 2.5 mole percent diethylene glycol is prepared as follows. Into a 5 gallon Parr reactor equipped with a bottom drain valve, double turbine agitator, and distillation receiver with a cold water condenser are charged 3.98 kilograms of dimethylterephthalate, 451 grams of sodium dimethyl sulfoisophthalate, 3.104 kilograms of 1,2-propanediol (1 mole excess of glycol), 351 grams of diethylene glycol (1 mole excess of glycol), and 8 grams of butyltin hydroxide oxide catalyst. The reactor is then heated to 165° C. with stirring for 3 hours whereby 1.33 kilograms of distillate are collected in the distillation receiver, and which distillate comprises about 98 percent by volume methanol and 2 percent by volume 1,2-propanediol as measured by the ABBE refractometer available from American Optical Corporation. The reactor mixture is then heated to 190° C. over a one hour period, after which the pressure is slowly reduced from atmospheric pressure to about 260 Torr over a one hour period, and then reduced to 5 Torr over a two hour period with the collection of approximately 470 grams of distillate in the distillation receiver, and which distillate comprises approximately 97 percent by volume 1,2-propanediol and 3 percent by volume methanol as measured by the ABBE refractometer. The pressure is then further reduced to about 1 Torr over a 30 minute period whereby an additional 530 grams of 1,2-propanediol are collected. The reactor is then purged with nitrogen to atmospheric pressure, and the polymer product discharged through the bottom drain onto a container cooled with dry ice to yield 3.5 mole percent sulfonated polyester resin, sodio salt of (1,2-propylene-dipropylene-5-sulfoisophthalate)-copoly (1,2-propylene-dipropylene terephthalate).

A 15 percent by weight solids concentration of the colloidal sulfonated polyester resin dissipated in an aqueous medium is prepared by first heating 2 liters of deionized water to 85° C. with stirring and adding thereto 300 grams of a sulfonated polyester resin, followed by continued heating at about 85° C. and stirring of the mixture for a duration of from about one to about two hours, followed by cooling to room temperature (about 25° C.). The colloidal solution of the sodio-sulfonated polyester resin particles have a characteristic blue tinge and particle sizes in the range of from about 5 to about 150 nanometers, and typically in the range of 20 to 40 nanometers, as measured by a NiCOMP® Particle Size Analyzer.

A 2 liter colloidal solution containing 15 percent by weight of the sodio sulfonated polyester resin is then charged into a 4 liter kettle equipped with a mechanical stirrer. To this solution is added 42 grams of a carbon black pigment dispersion containing 30 percent by weight of Regal® 330 (available from Cabot, Inc.), and the resulting mixture is heated to 56° C. with stirring at about 180 to 200 revolutions per minute. To this heated mixture is then added dropwise 760 grams of an aqueous solution containing 5 percent by weight of zinc acetate dihydrate. The dropwise addition of the zinc acetate dihydrate solution is accomplished utilizing a peristaltic pump, at a rate of addition of about 2.5 milliliters per minute. After the addition is complete (about 5 hours), the mixture is stirred for an additional 3 hours. The mixture is then allowed to cool to room temperature (about 25° C.) overnight (about 18 hours) with stirring. The product is then filtered through a 3 micron hydrophobic membrane cloth and the marking material cake is reslurried into about 2 liters of deionized water and stirred for about 1 hour. The marking material slurry is refiltered and dried with a freeze drier for 48 hours.

Into a 250 milliliter glass beaker is placed 75 grams of distilled water along with 6.0 grams of the resultant black polyester marking material prepared as described above. This dispersion is then stirred with the aid of a magnetic stirrer to achieve an essentially uniform dispersion of polyester particles in the water. To this dispersion is added 1.27 grams of thiophene monomer. The thiophene monomer, with the aid of further stirring, dissolves in under 5 minutes. In a separate 50 milliliter beaker, 10.0 grams of ferric chloride are dissolved in 25 grams of distilled water. Subsequent to the dissolution of the ferric chloride, this solution is added dropwise to the marking material in water/thiophene dispersion. The beaker containing the marking material, thiophene, and ferric chloride is then covered and left overnight under continuous stirring. The marking material dispersion is thereafter filtered and washed twice in 600 milliliters of distilled water, filtered, and freeze dried.

It is believed that the measured average bulk conductivity of a pressed pellet of this marking material will be about $1\times10^{-2}$ Siemens per centimeter.

EXAMPLE LII

Black marking particles are prepared by aggregation of a polyester latex with a carbon black pigment dispersion as described in Example LI.

Into a 250 milliliter glass beaker is placed 150 grams of distilled water along with 12.0 grams of the black polyester marking material. This dispersion is then stirred with the aid of a magnetic stirrer to achieve an essentially uniform dispersion of polyester particles in the water. To this dispersion is added 2.55 grams of thiophene monomer. The thiophene monomer, with the aid of further stirring, dissolves in under 5 minutes. To the solution is then added 2.87 grams of p-toluene sulfonic acid. In a separate 50 milliliter beaker, 17.1 grams of ammonium persulfate are dissolved in 25 grams of distilled water. Subsequent to the dissolution of the ammonium persulfate, this solution is then added dropwise to the marking material in water/thiophene/p-toluene sulfonic acid dispersion. The beaker containing the marking material, thiophene, p-toluene sulfonic acid, and ammonium persulfate is then covered and left overnight under continuous stirring. The marking material dispersion is thereafter filtered and the marking material is washed twice in 600 milliliters of distilled water, filtered, and freeze dried.

It is believed that the measured average bulk conductivity of a pressed pellet of this marking material will be about $1\times10^{-2}$ Siemens per centimeter.

EXAMPLE LIII

Marking particles are prepared by aggregation of a styrene/n-butyl acrylate/acrylic acid latex using a flocculate poly(aluminum chloride) followed by particle coalescence at elevated temperature. The polymeric latex is prepared by the emulsion polymerization of styrene/n-butyl acrylate/acrylic acid (monomer ratio 82 parts by weight styrene, 18 parts by weight n-butyl acrylate, 2 parts by weight acrylic acid) in a nonionic/anionic surfactant solution (40.0 percent by weight solids) as follows: 279.6 kilograms of styrene, 61.4 kilograms of n-butyl acrylate, 6.52 kilograms of acrylic acid, 3.41 kilograms of carbon tetrabromide, and 11.2 kilograms of dodecanethiol are mixed with 461 kilograms of deionized water, to which has been added 7.67 kilograms of sodium dodecyl benzene sulfonate anionic surfactant (Neogen RK; contains 60 percent active component), 3.66 kilograms of a nonophenol ethoxy nonionic surfactant (Antarox CA-897; contains 100 percent active material), and 3.41 kilograms of ammonium persulfate polymerization initiator dissolved in 50 kilograms of deionized water. The emulsion thus formed is polymerized at 70° C. for 3 hours, followed by heating to 85° C. for an additional 1 hour. The resulting latex contains about 59.5 percent by weight water and about 40.5 percent by weight solids, which solids comprise particles of a random copolymer of poly(styrene/n-butyl acrylate/acrylic acid); the glass transition temperature of the latex dry sample is about 47.7° C., as measured on a DuPont DSC. The latex has a weight average molecular weight of 30,600 and a number average molecular weight of 4,400 as determined with a Waters gel permeation chromatograph. The particle size of the latex as measured on a Disc Centrifuge is about 278 nanometers.

375 grams of the styrene/n-butyl acrylate/acrylic acid anionic latex thus prepared is then diluted with 761.43 grams of deionized water. The diluted latex solution is blended with an acidic solution of the flocculent (3.345 grams of poly(aluminum chloride) in 7.86 grams of 1 molar nitric acid solution) using a high shear homogenizer at 4,000 to 5,000 revolutions per minutes for 2 minutes, producing a flocculation or heterocoagulation of gelled particles consisting of nanometer sized latex particles. The slurry is heated at a controlled rate of 0.25° C. per minute to 53° C., at which point the average particle size is about 5.2 microns and the particle size distribution is about 1.20. At this point the pH of the solution is adjusted to 7.2 using 4 percent sodium hydroxide solution. The mixture is then heated at a controlled rate of 0.5° C. per minute to 95° C. Once the particle slurry reacts, the pH is dropped to 5.0 using 1 Molar nitric acid, followed by maintenance of the temperature at 95° C. for 6 hours. After cooling the reaction mixture to room temperature, the particles are washed and reslurried in deionized water. The average particle size of the marking particles is about 5.6 microns and the particle size distribution is about 1.24. A total of 5 washes are performed before the particle surface is treated by the in situ polymerization of the conductive polymer.

Into a 250 milliliter beaker is added 150 grams of the pigmentless marking particle size particle slurry (average particle diameter 5.6 microns; particle size distribution GSD 1.24) thus prepared, providing a total of 25 grams of solid material in the solution. The solution is then further diluted with deionized water to create a 250 gram particle slurry. The pH of the particle slurry is about 6.24. Into this stirred solution is added 3.8 grams (0.02 mole) of the dopant para-toluene sulfonic acid (p-TSA) and the pH is about 1.22. After 15 minutes, 2.5 grams (0.02 mole) of 3,4-ethylenedioxypyrrole monomer (EDOP), which is soluble in water, is added to the solution. The molar ratio of dopant to EDOP is 1:1, and EDOP is present in an amount of 10 percent by weight of the marking particles. After 2 hours, the dissolved oxidant ammonium persulfate (4.56 grams (0.02 mole) in 10 milliliters of deionized water) is added dropwise over a 10 minute period. The molar ratio of oxidant to EDOP is 1:1. The solution is stirred overnight at room temperature and allowed to stand for 3 days. The resulting bluish marking particles (with the slight coloration being the result of the poly(3,4-ethylenedioxypyrrole) (PEDOP) particle coating) are washed 7 times with distilled water and then dried with a freeze dryer for 48 hours. The chemical oxidative polymerization of EDOP to produce PEDOP occurs on the marking particle surface, and the particle surfaces are rendered conductive by the presence of the sulfonate groups from the marking particle surfaces and by the added p-TSA. It is believed that the average bulk conductivity of a pressed pellet of this marking material will be greater than ($\sigma=3.9\times 10^{-3}$ Siemens per centimeter. The conductivity is determined by preparing a pressed pellet of the material under 1,000 to 3,000 pounds per square inch of pressure and then applying 2 DC volts across the pellet. The value of the current flowing through the pellet is recorded, the pellet is removed and its thickness measured, and the bulk conductivity for the pellet is calculated in Siemens per centimeter.

EXAMPLE LIV

Marking particles are prepared by aggregation of a styrene/n-butyl acrylate/acrylic acid latex using a flocculate poly(aluminum chloride) followed by particle coalescence at elevated temperature. The polymeric latex is prepared by the emulsion polymerization of styrene/n-butyl acrylate/acrylic acid (monomer ratio 82 parts by weight styrene, 18 parts by weight n-butyl acrylate, 2 parts by weight acrylic acid) in a nonionic/anionic surfactant solution (40.0 percent by weight solids) as follows: 279.6 kilograms of styrene, 61.4 kilograms of n-butyl acrylate, 6.52 kilograms of acrylic acid, 3.41 kilograms of carbon tetrabromide, and 11.2 kilograms of dodecanethiol are mixed with 461 kilograms of deionized water, to which has been added 7.67 kilograms of sodium dodecyl benzene sulfonate anionic surfactant (Neogen RK; contains 60 percent active component), 3.66 kilograms of a nonophenol ethoxy nonionic surfactant (Antarox CA-897; contains 100 percent active material), and 3.41 kilograms of ammonium persulfate polymerization initiator dissolved in 50 kilograms of deionized water. The emulsion thus formed is polymerized at 70° C. for 3 hours, followed by heating to 85° C. for an additional 1 hour. The resulting latex contains about 59.5 percent by weight water and about 40.5 percent by weight solids, which solids comprise particles of a random copolymer of poly(styrene/n-butyl acrylate/acrylic acid); the glass transition temperature of the latex dry sample is about 47.7° C., as measured on a DuPont DSC. The latex has a weight average molecular weight of 30,600 and a number average molecular weight of 4,400 as determined with a Waters gel permeation chromatograph. The particle size of the latex as measured on a Disc Centrifuge is about 278 nanometers.

375 grams of the styrene/n-butyl acrylate/acrylic acid anionic latex thus prepared is then diluted with 761.43 grams of deionized water. The diluted latex solution is blended with an acidic solution of the flocculent (3.345 grams of poly(aluminum chloride) in 7.86 grams of 1 molar nitric acid solution) using a high shear homogenizer at 4,000 to 5,000 revolutions per minutes for 2 minutes, producing a flocculation or heterocoagulation of gelled particles consisting of nanometer sized latex particles. The slurry is heated at a controlled rate of 0.25° C. per minute to 53° C., at which point the average particle size is about 5.2 microns and the particle size distribution is about 1.20. At this point the pH of the solution is adjusted to 7.2 using 4 percent sodium hydroxide solution. The mixture is then heated at a controlled rate of 0.5° C. per minute to 95° C. Once the particle slurry reacts, the pH is dropped to 5.0 using 1 Molar nitric acid, followed by maintenance of the temperature at 95° C. for 6 hours. After cooling the reaction mixture to room temperature, the particles are washed and reslurried in deionized water. The average particle size of the marking particles is about 5.6 microns and the particle size distribution is about 1.24. A total of 5 washes are performed before the particle surface is treated by the in situ polymerization of the conductive polymer.

Into a 250 milliliter beaker is added 150 grams of the pigmentless marking particle size particle slurry (average particle diameter 5.6 microns; particle size distribution GSD 1.24) thus prepared, providing a total of 25 grams of solid material in the solution. The solution is then further diluted with deionized water to create a 250 gram particle slurry. The pH of the particle slurry is about 6.02. Into this stirred solution is added 9.51 grams (0.05 mole) of the dopant para-toluene sulfonic acid (p-TSA) and the pH is about 0.87. After 15 minutes, 2.5 grams (0.02 mole) of 3,4-ethylenedioxypyrrole monomer (EDOP) is added to the solution. The molar ratio of dopant to EDOP is 2.5:1, and EDOP is present in an amount of 10 percent by weight of the marking particles. After 2 hours, the dissolved oxidant ammonium persulfate (5.71 grams (0.025 mole) in 10 milliliters of deionized water) is added dropwise over a 10 minute period. The molar ratio of oxidant to EDOP is 1.25:1. The solution is stirred overnight at room temperature and allowed to stand for 3 days. The resulting bluish marking particles (with the slight coloration being the result of the PEDOP particle coating) are washed 7 times with distilled water and then dried with a freeze dryer for 48 hours. The chemical oxidative polymerization of EDOP to produce PEDOP occurs on the marking particle surface, and the particle surfaces are rendered conductive by the presence of the sulfonate groups from the marking particle surfaces and by the added p-TSA. It is believed that the average bulk conductivity of a pressed pellet of this marking material will be greater than $\sigma=4.9\times10^{-3}$ Siemens per centimeter.

EXAMPLE LV

Cyan marking particles are prepared by aggregation of a styrene/n-butyl acrylate/acrylic acid latex using a flocculate poly(aluminum chloride) followed by particle coalescence at elevated temperature. The polymeric latex is prepared by the emulsion polymerization of styrene/n-butyl acrylate/acrylic acid (monomer ratio 82 parts by weight styrene, 18 parts by weight n-butyl acrylate, 2 parts by weight acrylic acid) in a nonionic/anionic surfactant solution (40.0 percent by weight solids) as follows: 279.6 kilograms of styrene, 61.4 kilograms of n-butyl acrylate, 6.52 kilograms of acrylic acid, 3.41 kilograms of carbon tetrabromide, and 11.2 kilograms of dodecanethiol are mixed with 461 kilograms of deionized water, to which has been added 7.67 kilograms of sodium dodecyl benzene sulfonate anionic surfactant (Neogen RK; contains 60 percent active component), 3.66 kilograms of a nonophenol ethoxy nonionic surfactant (Antarox CA-897; contains 100 percent active material), and 3.41 kilograms of ammonium persulfate polymerization initiator dissolved in 50 kilograms of deionized water. The emulsion thus formed is polymerized at 70° C. for 3 hours, followed by heating to 85° C. for an additional 1 hour. The resulting latex contains about 59.5 percent by weight water and about 40.5 percent by weight solids, which solids comprise particles of a random copolymer of poly(styrene/n-butyl acrylate/acrylic acid); the glass transition temperature of the latex dry sample is about 47.7° C., as measured on a DuPont DSC. The latex has a weight average molecular weight of 30,600 and a number average molecular weight of 4,400 as determined with a Waters gel permeation chromatograph. The particle size of the latex as measured on a Disc Centrifuge is about 278 nanometers.

The cyan marking particles are prepared using the latex thus prepared, wherein the marking particles consist of 70 percent by weight of the latex mixed with pigment to prepare the particle cores and 30 percent by weight of the same latex used to form shells around the pigmented cores. Into a 2 liter glass reaction kettle is added 249.4 grams of the styrene/n-butyl acrylate/acrylic acid anionic latex thus prepared and diluted with 646.05 grams of deionized water. To the diluted latex solution is added 14.6 grams of BHD 6000 pigment dispersion (commercially available from Sun Chemical, containing 51.4 percent by weight solids of pigment blue cyan 15:3) dispersed into sodium dodecyl benzene sulfonate anionic surfactant (Neogen R) solution. The pigmented latex solution is blended with an acidic solution of the flocculent (3.2 grams of poly(aluminum chloride) in 7.5 grams of 1 molar nitric acid solution) using a high shear homogenizer at 4,000 to 5,000 revolutions per minutes for 2 minutes, producing a flocculation or heterocoagulation of gelled particles consisting of nanometer sized pigmented latex particles. The slurry is heated at a controlled rate of 0.25° C. per minute to 50° C., at which point the average particle size is about 4.75 microns and the particle size distribution is about 1.20. At this point, 106.98 grams of the above latex is added to aggregate around the already marking particle sized pigmented cores to form polymeric shells. After an additional 2 hours at 50° C., the aggregated particles have an average particle size of about 5.55 microns and a particle size distribution of 1.33. At this point the pH of the solution is adjusted to 8.0 using 4 percent sodium hydroxide solution. The mixture is then heated at a controlled rate of 0.5° C. per minute to 96° C. After the particle slurry has maintained the temperature of 96° C. for 1 hour, the pH is dropped to 5.5 using 1 Molar nitric acid, followed by maintenance of the temperature at 96° C. for 6 hours. After cooling the reaction mixture to room temperature, the particles are washed and reslurried in deionized water. The average particle size of the marking particles is about 5.6 microns and the particle size distribution is about 1.24. A total of 5 washes are performed before the particle surface is treated by the in situ polymerization of the conductive polymer.

Into a 250 milliliter beaker is added 150 grams of the pigmented marking particle size particle slurry (average particle diameter 5.6 microns; particle size distribution GSD 1.24) thus prepared, providing a total of 18.7 grams of solid material in the solution. The solution is then further diluted with deionized water to create a 200 gram particle slurry. Into this stirred solution is added 2.845 grams (0.01496 mole) of the dopant para-toluene sulfonic acid (p-TSA) and the pH is about 0.87. After 15 minutes, 1.87 grams (0.01496 mole) of 3,4-ethylenedioxypyrrole monomer (EDOP), which is soluble in water, is added to the solution. The molar ratio of dopant to EDOP is 1:1, and EDOP is present in an amount of 10 percent by weight of the marking particles. After 2 hours, the dissolved oxidant ammonium persulfate (8.53 grams (0.0374 mole) in 10 milliliters of deionized water) is added dropwise over a 10 minute period. The molar ratio of oxidant to EDOP is 2.5:1. The solution is stirred overnight at room temperature. The resulting bluish marking particles (with the slight coloration being the result of the PEDOP particle coating) in a yellowish supernatant solution are washed 5 times with distilled water and then dried with a freeze dryer for 48 hours. The solution conductivity is measured on the supernatant using an Accumet Research AR20 pH/conductivity meter purchased from Fisher Scientific and it is believed that this value will be greater than $5.9\times10^{-2}$ Siemens per centimeter. The chemical oxidative polymerization of EDOP to produce PEDOP occurs on the marking particle surface, and the particle surfaces are rendered conductive by the presence of the sulfonate groups from the marking particle surfaces and by the added p-TSA, It is believed that the average bulk conductivity of a pressed pellet of this marking material will be greater than $\sigma=1.3\times10^{-7}$ Siemens per centimeter.

EXAMPLE LVI

A linear sulfonated random copolyester resin comprising 46.5 mole percent terephthalate, 3.5 mole percent sodium sulfoisophthalate, 47.5 mole percent 1,2-propanediol, and 2.5 mole percent diethylene glycol is prepared as follows. Into a 5 gallon Parr reactor equipped with a bottom drain valve, double turbine agitator, and distillation receiver with a cold water condenser are charged 3.98 kilograms of dimethylterephthalate, 451 grams of sodium dimethyl sulfoisophthalate, 3.104 kilograms of 1,2-propanediol (1 mole excess of glycol), 351 grams of diethylene glycol (1 mole excess of glycol), and 8 grams of butyltin hydroxide oxide catalyst. The reactor is then heated to 165° C. with stirring for 3 hours whereby 1.33 kilograms of distillate are collected in the distillation receiver, and which distillate comprises about 98 percent by volume methanol and 2 percent by volume 1,2-propanediol as measured by the ABBE refractometer available from American Optical Corporation. The reactor mixture is then heated to 190° C. over a one hour period, after which the pressure is slowly reduced from atmospheric pressure to about 260 Torr over a one hour period, and then reduced to 5 Torr over a two hour period with the collection of approximately 470 grams of distillate in the distillation receiver, and which distillate comprises approximately 97 percent by volume 1,2-propanediol and 3 percent by volume methanol as measured by the ABBE refractometer. The pressure is then further reduced to about 1 Torr over a 30 minute period whereby an additional 530 grams of 1,2-propanediol are collected. The reactor is then purged with nitrogen to atmospheric pressure, and the polymer product discharged through the bottom drain onto a container cooled with dry ice to yield 5.60 kilograms of 3.5 mole percent sulfonated polyester resin, sodio salt of (1,2-propylene-dipropylene-5-sulfoisophthalate)-copoly (1,2-propylene-dipropylene terephthalate). The sulfonated polyester resin glass transition temperature is about 56.6° C. (onset) measured utilizing the 910 Differential Scanning Calorimeter available from E.I. DuPont operating at a heating rate of 10° C. per minute. The number average molecular weight is about 3,250 grams per mole, and the weight average molecular weight is about 5,290 grams per mole measured using tetrahydrofuran as the solvent.

A 15 percent solids concentration of colloidal sulfonate polyester resin dissipated in aqueous media is prepared by first heating about 2 liters of deionized water to about 85° C. with stirring, and adding thereto 300 grams of the sulfonated polyester resin, followed by continued heating at about 85° C. and stirring of the mixture for a duration of from about one to about two hours, followed by cooling to about room temperature (25° C.). The colloidal solution of sodio-sulfonated polyester resin particles has a characteristic blue tinge and particle sizes in the range of from about 5 to about 150 nanometers, and typically in the range of 20 to 40 nanometers, as measured by the NiCOMP® particle sizer.

A 2 liter colloidal solution containing 15 percent by weight of the sodio sulfonated polyester resin is charged into a 4 liter kettle equipped with a mechanical stirrer. To this solution is added 42 grams of a cyan pigment dispersion containing 30 percent by weight of Pigment Blue 15:3 (available from Sun Chemicals), and the resulting mixture is heated to 56° C. with stirring at about 180 to 200 revolutions per minute. To this heated mixture is then added dropwise 760 grams of an aqueous solution containing 5 percent by weight of zinc acetate dihydrate. The dropwise addition of the zinc acetate dihydrate solution is accomplished utilizing a peristaltic pump, at a rate of addition of approximately 2.5 milliliters per minute. After the addition is complete (about 5 hours), the mixture is stirred for an additional 3 hours. The mixture is then allowed to cool to room temperature, about 25° C., overnight, about 18 hours, with stirring. The product is filtered off through a 3 micron hydrophobic membrane cloth, and the marking material cake is reslurried into about 2 liters of deionized water and stirred for about 1 hour. The marking material slurry is refiltered and dried on a freeze drier for 48 hours. The marking particles have an average particle size of 5.13 microns with a GSD of 1.16.

Approximately 10 grams of the cyan marking particles are dispersed in 52 grams of aqueous slurry (19.4 percent by weight solids pre-washed marking material) with a slurry pH of 6.0 and a slurry solution conductivity of 15 microSiemens per centimeter. To the aqueous marking material slurry is first added 2.0 grams (8.75 mmol) of the oxidant ammonium persulfate followed by stirring at room temperature for 15 minutes. About 0.4375 grams (3.5 mmol) of 3,4-ethylenedioxypyrrole monomer is pre-dispersed into 2 milliliters of a 1 percent wt/vol Neogen-RK surfactant solution, and this dispersion is transferred dropwise into the oxidant-treated marking material slurry with vigorous stirring. The molar ratio of oxidant to 3,4-ethylenedioxypyrrole monomer is 2.5 to 1.0, and the monomer concentration is 5 percent by weight of marking material solids. 30 minutes after completion of the monomer addition, a 0.6 gram (3.5 mmol, equimolar to 3,4-ethylenedioxypyrrole monomer) quantity of para-toluenesulfonic acid (external dopant) is added. The mixture is stirred for 24 hours at room temperature to afford a surface-coated cyan marking material. The marking particles are filtered from the aqueous media, washed 3 times with deionized water, and then freeze-dried for 2 days. A poly(3,4-ethylenedioxypyrrole) treated cyan 5 micron marking material is obtained. It is believed that the particle bulk conductivity will be about $2\times10^{-3}$ Siemens per centimeter.

It is believed that if the relative amount of 3,4-ethylenedioxypyrrole is increased to 10 percent by weight of the marking particles, using the above molar equivalents of dopant and oxidant, the resulting marking particles will also be highly conductive at about $2\times10^{-3}$ Siemens per centimeter and that the thickness and uniformity of the poly(3,4-ethylenedioxypyrrole) shell will be improved over the 5 weight percent poly(3,4-ethylenedioxypyrrole) conductive shell described in this example.

EXAMPLE LVII

Cyan marking particles are prepared by the method described in Example LVI. The marking particles have an average particle size of 5.13 microns with a GSD of 1.16.

The cyan marking particles are dispersed in water to give 62 grams of cyan marking particles in water (20.0 percent by weight solids loading) with a slurry pH of 6.2 and slurry solution conductivity of 66 microSiemens per centimeter. To the aqueous marking material slurry is first added 12.5 grams (54.5 mmol) of the oxidant ammonium persulfate followed by stirring at room temperature for 15 minutes. Thereafter, 3,4-ethylenedioxypyrrole monomer (2.73 grams, 21.8 mmol) is added neat and dropwise to the solution over 15 to 20 minute period with vigorous stirring. The molar ratio of oxidant to 3,4-ethylenedioxypyrrole monomer is 2.5 to 1.0, and the monomer concentration is 5 percent by weight of marking material solids. 30 minutes after completion of the monomer addition, the dopant para-toluenesulfonic acid (3.75 grams, 21.8 mmol, equimolar to 3,4-ethylenedioxypyrrole monomer) is added. The mixture is stirred for 48 hours at room temperature to afford a surface-coated cyan marking material. The marking particles are filtered from the aqueous media, washed 3 times with deionized water, and then freeze-dried for 2 days. A poly(3,4-ethylenedioxypyrrole) treated cyan 5 micron marking material is obtained. It is believed that the particle bulk conductivity will be about $2.5\times10^{-4}$ Siemens per centimeter.

It is believed that if the relative amount of 3,4-ethylenedioxypyrrole is increased to 10 percent by weight of the marking particles, using the above molar equivalents of dopant and oxidant, the resulting marking particles will also be highly conductive at about $2.5\times10^{-4}$ Siemens per centimeter and that the thickness and uniformity of the poly(3,4-ethylenedioxypyrrole) shell will be improved over the 5 weight percent poly(3,4-ethylenedioxypyrrole) conductive shell described in this example.

EXAMPLE LVIII

A colloidal solution of sodio-sulfonated polyester resin particles was prepared as described in Example LVI. A 2 liter colloidal solution containing 15 percent by weight of the sodio sulfonated polyester resin is charged into a 4 liter kettle equipped with a mechanical stirrer and heated to 56° C. with stirring at about 180 to 200 revolutions per minute. To this heated mixture is then added dropwise 760 grams of an aqueous solution containing 5 percent by weight of zinc acetate dihydrate. The dropwise addition of the zinc acetate dihydrate solution is accomplished utilizing a peristaltic pump, at a rate of addition of approximately 2.5 milliliters per minute. After the addition is complete (about 5 hours), the mixture is stirred for an additional 3 hours. The mixture is then allowed to cool to room temperature, about 25° C., overnight, about 18 hours, with stirring. The product is then filtered off through a 3 micron hydrophobic membrane cloth, and the marking material cake is reslurried into about 2 liters of deionized water and stirred for about 1 hour. The marking material slurry is refiltered and dried on a freeze drier for 48 hours. The marking particles have an average particle size of 5.0 microns with a GSD of 1.18.

Approximately 10 grams of the cyan marking particles are dispersed in 52 grams of aqueous slurry (19.4 percent by weight solids pre-washed marking material) with a slurry pH of 6.0 and a slurry solution conductivity of 15 microSiemens per centimeter. To the aqueous marking material slurry is first added 4.0 grams (17.5 mmol) of the oxidant ammonium persulfate followed by stirring at room temperature for 15 minutes. Thereafter, 3,4-ethylenedioxypyrrole monomer (0.875 gram, 7.0 mmol) is added neat and dropwise to the solution over 15 to 20 minute period with vigorous stirring. The molar ratio of oxidant to 3,4-ethylenedioxypyrrole monomer is 2.5 to 1.0, and the monomer concentration is 10 percent by weight of marking material solids. 30 minutes after completion of the monomer addition, the dopant para-toluenesulfonic acid (1.2 grams, 7.0 mmol, equimolar to 3,4-ethylenedioxypyrrole monomer) is added. The mixture is stirred for 48 hours at slightly elevated temperature (between 32° C. to 35° C.) to afford a surface-coated cyan marking material. The marking particles are filtered from the aqueous media, washed 3 times with deionized water, and then freeze-dried for 48 hours. A poly(3,4-ethylenedioxypyrrole) treated cyan 5 micron marking material is obtained. It is believed that the particle bulk conductivity will be about $3\times10^{-7}$ Siemens per centimeter.

EXAMPLE LIX

A black marking material is prepared as follows. 92 parts by weight of a styrene-n-butylmethacrylate polymer containing 58 percent by weight styrene and 42 percent by weight n-butylmethacrylate, 6 parts by weight of Regal 330® carbon black from Cabot Corporation, and 2 parts by weight of cetyl pyridinium chloride are melt blended in an extruder wherein the die is maintained at a temperature of between 130 and 145° C. and the barrel temperature ranges from about 80 to about 100° C., followed by micronization and air classification to yield marking particles of a size of 12 microns in volume average diameter.

The black marking material of 12 microns thus prepared is then resuspended in an aqueous surfactant solution and surface treated by oxidative polymerization of 3,4-ethylenedioxypyrrole monomer to render the insulative marking particle surface conductive by a shell of intrinsically conductive polymer poly(3,4-ethylenedioxypyrrole). Into a 500 milliliter beaker containing 250 grams of deionized water is dissolved 15.132 grams (0.044 mole) of a sulfonated water soluble surfactant sodium dodecylbenzene sulfonate (SDBS available from Aldrich Chemical Co., Milwaukee, Wis.). The sulfonated surfactant also functions as a dopant to rendered the PEDOP polymer conductive. To the homogeneous solution is added 25 grams of the dried 12 micron black marking particles. The slurry is stirred for two hours to allow the surfactant to wet the marking particle surface and produce a well-dispersed marking material slurry without any agglomerates of marking material. The marking particles are loaded at 10 percent by weight of the slurry. After 2 hours, 2.2 grams (0.0176 mole) of 3,4-ethylenedioxypyrrole monomer is added to the solution. The molar ratio of dopant to EDOP is 2.5:1, and EDOP is present in an amount of 10 percent by weight of the marking particles. After 2 hours, the dissolved oxidant (ammonium persulfate 5.02 grams (0.0219 mole) in 10 milliliters of deionized water) is added dropwise over a 10 minute period. The molar ratio of oxidant to EDOP is 1.25:1. The solution is stirred overnight at room temperature and then allowed to stand for 3 days. The particles are then washed and dried. It is believed that the resulting conductive black marking particles will have a bulk conductivity in the range of $10^{-4}$ to $10^{-3}$ Siemens per centimeter.

EXAMPLE LX

A red marking material is prepared as follows. 85 parts by weight of styrene butadiene, 1 part by weight of distearyl dimethyl ammonium methyl sulfate, available from Hexcel Corporation, 13.44 parts by weight of a 1:1 blend of styrene-n-butylmethacrylate and Lithol Scarlet NB3755 from BASF, and 0.56 parts by weight of Hostaperm Pink E from Hoechst Corporation are melt blended in an extruder wherein the die is maintained at a temperature of between 130 and 145° C. and the barrel temperature ranges from about 80 to about 100° C., followed by micronization and air classification to yield marking particles of a size of 11.5 microns in volume average diameter.

The red marking material thus prepared is then resuspended in an aqueous surfactant solution and surface treated by oxidative polymerization of 3,4-ethylenedioxypyrrole monomer to render the insulative marking particle surface conductive by a shell of intrinsically conductive polymer poly(3,4-ethylenedioxypyrrole) by the method described in Example LIX. It is believed that the resulting conductive red marking particles will have a bulk conductivity in the range of $10^{-4}$ to $10^{-3}$ Siemens per centimeter.

EXAMPLE LXI

A blue marking material is prepared as follows. 92 parts by weight of styrene butadiene, 1 part by weight of distearyl dimethyl ammonium methyl sulfate, available from Hexcel Corporation, and 7 parts by weight of PV Fast Blue from BASF are melt blended in an extruder wherein the die is maintained at a temperature of between 130 and 145° C. and the barrel temperature ranges from about 80 to about 100° C., followed by micronization and air classification to yield marking particles of a size of 12 microns in volume average diameter.

The blue marking material thus prepared is then resuspended in an aqueous surfactant solution and surface treated by oxidative polymerization of 3,4-ethylenedioxypyrrole monomer to render the insulative marking particle surface conductive by a shell of intrinsically conductive polymer poly(3,4-ethylenedioxypyrrole) by the method described in Example LIX. It is believed that the resulting conductive blue marking particles will have a bulk conductivity in the range of $10^{-4}$ to $10^{-3}$ Siemens per centimeter.

EXAMPLE LXII

A green marking material is prepared as follows. 89.5 parts by weight of styrene butadiene, 0.5 part by weight of distearyl dimethyl ammonium methyl sulfate, available from Hexcel Corporation, 5 parts by weight of Sudan Blue from BASF, and 5 parts by weight of Permanent FGL Yellow from E. I. Du Pont de Nemours and Company are melt blended in an extruder wherein the die is maintained at a temperature of between 130 and 145° C. and the barrel temperature ranges from about 80 to about 100° C., followed by micronization and air classification to yield marking particles of a size of 12.5 microns in volume average diameter.

The green marking material thus prepared is then resuspended in an aqueous surfactant solution and surface treated by oxidative polymerization of 3,4-ethylenedioxypyrrole monomer to render the insulative marking particle surface conductive by a shell of intrinsically conductive polymer poly(3,4-ethylenedioxypyrrole) by the method described in Example LIX. It is believed that the resulting conductive green marking particles will have a bulk conductivity in the range of $10^{-4}$ to $10^{-3}$ Siemens per centimeter.

EXAMPLE LXIII

A microencapsulated marking material is prepared using the following procedure. Into a 250 milliliter polyethylene bottle is added 39.4 grams of a styrene monomer (Polysciences Inc.), 26.3 grams of an n-butyl methacrylate monomer (Polysciences Inc.), 43.8 grams of a 52/48 ratio of styrene/n-butyl methacrylate copolymer resin, 10.5 grams of Lithol Scarlet D3700 pigment (BASF), and 5 millimeter diameter ball bearings which occupy 40 to 50 percent by volume of the total sample. This sample is ball milled for 24 to 48 hours to disperse the pigment particles into the monomer/polymer mixture. The composition thus formed comprises about 7 percent by weight of pigment, about 20 percent by weight of shell polymer, and about 73 percent by weight of the mixture of core monomers and polymers, which mixture comprises about 40 percent by weight of a styrene-n-butyl methacrylate copolymer with about 52 percent by weight of styrene and about 48 percent by weight of n-butyl methacrylate, about 35 percent by weight of styrene monomer, and about 24 percent by weight of n-butyl methacrylate monomer. After ball milling, 250 milliliters of the pigmented monomer solution is transferred into another polyethylene bottle, and into the solution is dispersed with a Brinkmann PT45/80 homogenizer and a PTA-20TS probe for 1 minute at 6,000 rpm 10.2 grams of terephthaloyl chloride (Fluka), 8.0 grams of 1,3,5-benzenetricarboxylic acid chloride, (Aldrich), 263 grams of 2,2'-azo-bis(2,4-dimethylvaleronitrile), (Polysciences Inc.), and 0.66 grams of 2,2'-azo-bis-isobutyronitrile (Polysciences Inc.). Into a stainless steel 2 liter beaker containing 500 milliliters of an about 2.0 percent by weight polyvinylalcohol solution, weight-average molecule weight 96,000, about 88 percent by weight hydrolyzed (Scientific Polymer Products), and 0.5 milliliters of 2-decanol (Aldrich), is dispersed the above pigmented monomer solution with a Brinkmann PT45/80 homogenizer and a PTA-35/4G probe at 10,000 rpm for 3 minutes. The dispersion is performed in a cold water bath at 15° C. This mixture is transferred into a 2 liter glass reactor equipped with a mechanical stirrer and an oil bath under the beaker. While stirring the solution vigorously, an aqueous solution of 8.0 grams of diethylene triamine (Aldrich), 5.0 grams of 1,6-hexanediamine (Aldrich), and 25 milliliters of distilled water is added dropwise over a 2 to 3 minute period. Simultaneously, from a separatory dropping funnel a basic solution comprising 13.0 grams of sodium carbonate (Baker) and 30 milliliters of distilled water is also added dropwise over a 10 minute period. After complete addition of the amine and base solutions, the mixture is stirred for 2 hours at room temperature. During this time the interfacial polymerization occurs to form a polyamide shell around the core material. While still stirring, the volume of the reaction mixture is increased to 1.5 liters with distilled water, and an aqueous solution containing 3.0 grams of potassium iodide (Aldrich) dissolved in 10.0 milliliters of distilled water is added. After the initial 2 hours and continuous stirring, the temperature is increased to 65° C. for 4 hours to initiate the free radical polymerization of the core. Following this 4 hour period, the temperature is increased again to 85° C. for 8 hours to complete the core polymerization and to minimize the amount of residual monomers encapsulated by the shell. The solution is then cooled to room temperature and is washed 7 times with distilled water by settling and decanting off the supernatant.

Particle size is determined by screening the particles through 425 and 250 micron sieves and then spray drying using a Yamato-Ohkawara spray dryer model DL-41. The average particle size is about 14.5 microns with a GSD of 1.7 as determined with a Coulter Counter.

While the marking particles are still suspended in water (prior to drying and measuring particle size), the particle surfaces are treated by oxidative polymerization of 3,4-ethylenedioxypyrrole monomer and doped to produce a conductive polymeric shell on top of the polyamide shell encapsulating the red marking particle core. Into a 250 milliliter beaker is added 150 grams of the red marking particle slurry thus prepared, providing a total of 25.0 grams of solid material in the solution. The solution is then further diluted with deionized water to create a 250 gram particle slurry. Into this stirred solution is added 8.37 grams (0.0440 mole) of the dopant para-toluene sulfonic acid (p-TSA). After 15 minutes, 2.2 grams (0.0176 mole) of 3,4-ethylenedioxypyrrole monomer (EDOP) is added to the solution. The molar ratio of dopant to EDOP is 2.5:1, and EDOP is present in an amount of 10 percent by weight of the marking particles. After 2 hours, the dissolved oxidant (ammonium persulfate 5.02 grams (0.0219 mole) in 10 milliliters of deionized water) is added dropwise over a 10 minute period. The molar ratio of oxidant to EDOP is 1.25:1. The solution is stirred overnight at room temperature and then allowed to stand for 3 days. The particles are washed once with distilled water and then dried with a freeze dryer for 48 hours. The chemical oxidative polymerization of EDOP to produce PEDOP occurs on the marking particle surfaces, and the particle surfaces are rendered conductive by the presence of the dopant sulfonate groups. It is believed that the average bulk conductivity of a pressed pellet of this marking material will be about $10^{-4}$ to about $10^{-3}$ Siemens per centimeter.

EXAMPLE LXIV

A microencapsulated marking material is prepared using the following procedure. Into a 250 milliliter polyethylene bottle is added 10.5 grams of Lithol Scarlet D3700 (BASF), 52.56 grams of styrene monomer (Polysciences Inc.), 35.04 grams of n-butyl methacrylate monomer (Polysciences Inc.), 21.9 grams of a 52/48 ratio of styrene/n-butyl methacrylate copolymer resin, and 5 millimeter diameter ball bearings which occupy 40 percent by volume of the total sample. This sample is ball milled overnight for approximately 17 hours to disperse the pigment particles into the monomer/polymer mixture. The composition thus formed comprises 7 percent by weight pigment, 20 percent by weight shell material, and 73 percent by weight of the mixture of core monomers and polymers, wherein the mixture comprises 20 percent polymeric resin, a 52/48 styrene/n-butyl methacrylate monomer ratio, 48 percent styrene monomer, and 32 percent n-butyl methacrylate. After ball milling, the pigmented monomer solution is transferred into another 250 milliliter polyethylene bottle, and into this is dispersed with a Brinkmann PT45/80 homogenizer and a PTA-20TS generator probe at 5,000 rpm for 30 seconds 12.0 grams of sebacoyl chloride (Aldrich), 8.0 grams of 1,35-benzenetricarboxylic acid chloride (Aldrich), 1.8055 grams of 2,2'-azo-bis(2,3-dimethylvaleronitrile), (Polysciences Inc.), and 0.5238 gram of 2,2'-azo-bis-isobutyronitrile, (Polysciences Inc.). Into a stainless steel 2 liter beaker containing 500 milliliters of 2.0 percent polyvinylalcohol solution, weight-average molecular weight 96,000, 88 percent hydrolyzed (Scientific Polymer Products), 0.3 gram of potassium iodide (Aldrich), and 0.5 milliliter of 2-decanol (Aldrich) is dispersed the above pigmented organic phase with a Brinkmann PT45/80 homogenizer and a PTA-20TS probe at 10,000 rpm for 1 minute. The dispersion is performed in a cold water bath at 15° C. This mixture is transferred into a 2 liter glass reactor equipped with a mechanical stirrer and an oil bath under the beaker. While stirring the solution vigorously, an aqueous solution of 8.0 grams of diethylene triamine (Aldrich), 5.0 grams of 1,6-hexanediamine (Aldrich), and 25 milliliters of distilled water is added dropwise over a 2 to 3 minute period. Simultaneously, from a separatory dropping funnel a basic solution comprising 13.0 grams of sodium carbonate (Baker) and 30 milliliters of distilled water is also added dropwise over a 10 minute period. After complete addition of the amine and base solutions, the mixture is stirred for 2 hours at room temperature. During this time, interfacial polymerization occurs to form a polyamide shell around the core materials. While stirring, the volume of the reaction mixture is increased to 1.5 liters with distilled water, followed by increasing the temperature to 54° C. for 12 hours to polymerize the core monomers. The solution is then cooled to room temperature and is washed 7 times with distilled water by settling the particles and decanting off the supernatant. Before spray drying, the particles are screened through 425 and 250 micron sieves and then spray dried using a Yamato-Ohkawara spray dryer model DL-41 with an inlet temperature of 120° C. and an outlet temperature of 65° C. The average particle size is about 14.5 microns with a GSD value of 1.66 as determined with a Coulter Counter.

While the marking particles are still suspended in water (prior to drying and measuring particle size), the particle surfaces are treated by oxidative polymerization of 3,4-ethylenedioxypyrrole monomer and doped to produce a conductive polymeric shell on top of the shell encapsulating the marking particle core by the method described in Example LXIII. It is believed that the average bulk conductivity of a pressed pellet of the resulting marking material will be about $10^{-4}$ to about $10^{-3}$ Siemens per centimeter.

EXAMPLE LXV

A microencapsulated marking material is prepared by the following procedure. Into a 250 milliliter polyethylene bottle is added 13.1 grams of styrene monomer (Polysciences Inc.), 52.6 grams of n-butyl methacrylate monomer (Polysciences Inc.), 33.3 grams of a 52/48 ratio of styrene/n-butyl methacrylate copolymer resin, and 21.0 grams of a mixture of Sudan Blue OS pigment (BASF) flushed into a 65/35 ratio of styrene/n-butyl methacrylate copolymer resin wherein the pigment to polymer ratio is 50/50. With the aid of a Burrell wrist shaker, the polymer and pigment are dispersed into the monomers for 24 to 48 hours. The composition thus formed comprises 7 percent by weight of pigment, 20 percent by weight shell, and 73 percent by weight of the mixture of core monomers and polymers, which mixture comprises 9.6 percent copolymer resin (65/35 ratio of styrene/n-butyl methacrylate monomers), 30.4 percent copolymer resin (52/48 ratio of styrene/n-butyl methacrylate monomers), 12 percent styrene monomer, and 48.0 percent n-butyl methacrylate monomer. Once the pigmented monomer solution is homogeneous, into this mixture is dispersed with a Brinkmann PT45/80 homogenizer and a PTA-20TS probe for 30 seconds at 5,000 rpm 20.0 grams of liquid isocyanate (tradename Isonate 143L or liquid MDI), (Upjohn Polymer Chemicals), 1.314 grams of 2,2'-azo-bis(2,4-dimethylvaleronitrile) (Polysciences Inc.), and 0.657 gram of 2,2'-azo-bis-isobutyronitrile (Polysciences Inc.). Into a stainless steel 2 liter beaker containing 600 milliliters of 1.0 percent polyvinylalcohol solution, weight-average molecular weight 96,000, 88 percent hydrolized (Scientific Polymer Products) and 0.5 milliliters of 2-decanol (Aldrich) is dispersed the above pigmented monomer solution with a Brinkmann PT45/80 homogenizer and a PTA-35/4G probe at 10,000 rpm for 1 minute. The dispersion is performed in a cold water bath at 15° C. This mixture is transferred into a 2 liter reactor equipped with a mechanical stirrer and an oil bath under the beaker. While stirring the solution vigorously, an aqueous solution of 5.0 grams of diethylene triamine (Aldrich), 5.0 grams of 1,6-hexanediamine (Aldrich), and 100 milliliters of distilled water is poured into the reactor and the mixture is stirred for 2 hours at room temperature. During this time interfacial polymerization occurs to form a polyurea shell around the core material. While still stirring, the volume of the reaction mixture is increased to 1.5 liters with 1.0 percent polyvinylalcohol solution and an aqueous solution containing 0.5 gram of potassium iodide (Aldrich) dissolved in 10.0 milliliters of distilled water is added. The pH of the solution is adjusted to pH 7 to 8 with dilute hydrochloric acid (BDH) and is then heated for 12 hours at 85° C. while still stirring. During this time, the monomeric material in the core undergoes free radical polymerization to complete formation of the core material. The solution is cooled to room temperature and is washed 7 times with distilled water. The particles are screened wet through 425 and 250 micron sieves and then spray dried using a Yamato-Ohkawara spray dryer model DL-41. The average particle size is about 164 microns with a GSD of 1.41 as determined by a Coulter Counter.

While the marking particles are still suspended in water (prior to drying and measuring particle size), the particle surfaces are treated by oxidative polymerization of 3,4-ethylenedioxypyrrole monomer and doped to produce a conductive polymeric shell on top of the shell encapsulating the marking particle core by the method described in Example LXIII. It is believed that the average bulk conductivity of a pressed pellet of the resulting marking material will be about $10^{-4}$ to about $10^{-3}$ Siemens per centimeter.

EXAMPLE LXVI

Marking particles comprising about 92 percent by weight of a poly-n-butylmethacrylate resin with an average molecular weight of about 68,000, about 6 percent by weight of Regale 330 carbon black, and about 2 percent by weight of cetyl pyridinium chloride are prepared by the extrusion process and have an average particle diameter of 11 microns.

The black marking material thus prepared is then resuspended in an aqueous surfactant solution and surface treated by oxidative polymerization of 3,4-ethylenedioxypyrrole monomer to render the insulative marking particle surface conductive by a shell of intrinsically conductive polymer poly(3,4-ethylenedioxypyrrole) by the method described in Example LIX. It is believed that the resulting conductive black marking particles will have a bulk conductivity in the range of $10^{-4}$ to $10^{-3}$ Siemens per centimeter.

EXAMPLE LXVII

A blue marking material is prepared containing 90.5 percent by weight Pliotone® resin (obtained from Goodyear), 7.0 percent by weight PV Fast Blue B2G-A pigment (obtained from Hoechst-Celanese), 2.0 percent by weight Bontron E-88 aluminum compound charge control agent (obtained from Orient Chemical, Japan), and 0.5 percent by weight cetyl pyridinium chloride charge control agent (obtained from Hexcel Corporation). The marking material components are first dry blended and then melt mixed in an extruder. The extruder strands are cooled, chopped into small pellets, ground into marking particles, and then classified to narrow the particle size distribution. The marking particles have a particle size of 12.5 microns in volume average diameter.

The blue marking material thus prepared is then resuspended in an aqueous surfactant solution and surface treated by oxidative polymerization of 3,4-ethylenedioxypyrrole monomer to render the insulative marking particle surface conductive by a shell of intrinsically conductive polymer poly(3,4-ethylenedioxypyrrole) by the method described in Example LIX. It is believed that the resulting conductive blue marking particles will have a bulk conductivity in the range of $10^{-4}$ to $10^{-3}$ Siemens per centimeter.

EXAMPLE LXVIII

A red marking material is prepared as follows. 91.72 parts by weight Pliotone® resin (obtained from Goodyear), 1 part by weight distearyl dimethyl ammonium methyl sulfate (obtained from Hexcel Corporation), 6.72 parts by weight Lithol Scarlet NB3755 pigment (obtained from BASF), and 0.56 parts by weight Magenta Predisperse (Hostaperm Pink E pigment dispersed in a polymer resin, obtained from Hoechst-Celanese) are melt blended in an extruder wherein the die is maintained at a temperature of between 130 and 145° C. and the barrel temperature ranges from about 80 to about 100° C., followed by micronization and air classification to yield marking particles of a size of 12.5 microns in volume average diameter.

The red marking material thus prepared is then resuspended in an aqueous surfactant solution and surface treated by oxidative polymerization of 3,4-ethylenedioxypyrrole monomer to render the insulative marking particle surface conductive by a shell of intrinsically conductive polymer poly(3,4-ethylenedioxypyrrole) by the method described in Example LIX. It is believed that the resulting conductive red marking particles will have a bulk conductivity in the range of $10^{-4}$ to $10^{-3}$ Siemens per centimeter.

EXAMPLE LXIX

Unpigmented marking particles are prepared by aggregation of a styrene/n-butyl acrylate/acrylic acid latex using a flocculent (poly(aluminum chloride)) followed by particle coalescence at elevated temperature. The polymeric latex is prepared by the emulsion polymerization of styrene/n-butyl acrylate/acrylic acid (monomer ratio 82 parts by weight styrene, 18 parts by weight n-butyl acrylate, 2 parts by weight acrylic acid) in a nonionic/anionic surfactant solution (40.0 percent by weight solids) as follows; 279.6 kilograms of styrene, 61.4 kilograms of n-butyl acrylate, 6.52 kilograms of acrylic acid, 3.41 kilograms of carbon tetrabromide, and 11.2 kilograms of dodecanethiol are mixed with 461 kilograms of deionized water in which has been dissolved 7.67 kilograms of sodium dodecyl benzene sulfonate anionic surfactant (Neogen RK; contains 60 percent active component), 3.66 kilograms of a nonophenol ethoxy nonionic surfactant (Antarox CA-897, 100 percent active material), and 3.41 kilograms of ammonium persulfate polymerization initiator dissolved in 50 kilograms of deionized water. The emulsion thus formed is polymerized at 70° C. for 3 hours, followed by heating to 85° C. for an additional 1 hour. The resulting latex contains 59.5 percent by weight water and 40.5 percent by weight solids, which solids comprise particles of a random copolymer of poly (styrene/n-butyl acrylate/acrylic acid).

Thereafter, 375 grams of the styrene/n-butyl acrylate/acrylic acid anionic latex thus prepared is diluted with 761.43 grams of deionized water. The diluted latex solution is blended with an acidic solution of the flocculent (3.35 grams of poly(aluminum chloride) in 7.86 grams of 1 molar nitric acid solution) using a high shear homogenizer at 4,000 to 5,000 revolutions per minute for 2 minutes, producing a flocculation or heterocoagulation of gelled particles consisting of nanometer sized latex particles. The slurry is heated at a controlled rate of 0.25° C. per minute to 50° C. At this point the pH of the solution is adjusted to 7.0 using 4 percent sodium hydroxide solution. The mixture is then heated at a controlled rate of 0.5° C. per minute to 95° C. Once the particle slurry reacts at the reaction temperature of 95° C., the pH is dropped to 5.0 using 1 molar nitric acid, followed by maintenance of this temperature for 6 hours. The particles are then cooled to room temperature. From this marking material slurry 150 grams is removed and washed 6 times by filtration and resuspension in deionized water. The particles are then dried with a freeze dryer for 48 hours.

Into a 250 milliliter beaker is added 150 grams of a pigmentless marking particle size particle slurry providing a total of 11.25 grams of solid material in the solution. The pH of the solution is then adjusted by adding the dopant, para-toluene sulfonic acid (pTSA) until the pH is 2.73. Into this stirred solution is dissolved the oxidant ammonium persulfate (1.81 grams; 7.93 mmole). After 15 minutes, 0.4 grams (3.17 mmole) of 3,4-ethylenedioxypyrrole monomer (EDOP) is added to the solution. The molar ratio of oxidant to EDOP is 2.5:1, and EDOP is present in an amount of 4 percent by weight of the marking particles. The reaction is stirred overnight at room temperature. The resulting greyish marking particles (with the slight coloration being the result of the PEDOP particle coating) are washed 6 times with distilled water and then dried with a freeze dryer for 48 hours. The chemical oxidative polymerization of EDOP to produce PEDOP occurs on the marking particle surface, and the particle surfaces are rendered slightly conductive by the presence of the sulfonate groups from the marking particle surfaces and by the added pTSA. It is believed that the bulk conductivity of this sample when pressed into a pellet will be about $3\times10^{-13}$ Siemens per centimeter.

EXAMPLE LXX

Unpigmented marking particles are prepared by the method described in Example LXIX. Into a 250 milliliter beaker is added 150 grams of a pigmentless marking particle size particle slurry (average particle diameter 5.7 microns; particle size distribution GSD 1.24) providing a total of 20.0 grams of solid material in the solution. The pH of the solution is not adjusted before the oxidant is added. Into this stirred solution is dissolved the oxidant ammonium persulfate (3.7 grams; 0.0162 mole). After 15 minutes, 1.76 grams (0.0141 mole) of 3,4-ethylenedioxypyrrole monomer (EDOP) is added to the solution. The molar ratio of oxidant to EDOP is 1.1:1, and EDOP is present in an amount of 10 percent by weight of the marking particles. The reaction is stirred overnight at room temperature. The resulting greyish marking particles (with the slight coloration being the result of the PEDOP particle coating) are washed 6 times with distilled water and then dried with a freeze dryer for 48 hours, The chemical oxidative polymerization of EDOP to produce PEDOP occurs on the marking particle surfaces, and the particle surfaces are rendered slightly conductive by the presence of the sulfonate groups from the marking particle surfaces, It is believed that the bulk conductivity of this sample when pressed into a pellet will be about $4'10^{-13}$ Siemens per centimeter.

EXAMPLE LXXI

Marking particles are prepared by aggregation of a styrene/n-butyl acrylate/styrene sulfonate sodium salt/acrylic acid latex using a flocculent (poly(aluminum chloride)) followed by particle coalescence at elevated temperature. The polymeric latex is prepared by the emulsion polymerization of styrene/n-butyl acrylate/styrene sulfonate sodium salt/acrylic acid (monomer ratio 81.5 parts by weight styrene, 18 parts by weight n-butyl acrylate, 0.5 parts by weight of styrene sulfonate sodium salt, 2 parts by weight acrylic acid) without a nonionic surfactant and without an anionic surfactant. The solution consists of 40.0 percent by weight solids as follows; 277.92 kilograms of styrene, 61.38 kilograms of n-butyl acrylate, 1.7 kilograms of styrene sulfonate sodium salt, 6.52 kilograms of acrylic acid, 3.41 kilograms of carbon tetrabromide, and 11.2 kilograms of dodecanethiol are mixed with 461 kilograms of deionized water and 3.41 kilograms of ammonium persulfate polymerization initiator dissolved in 50 kilograms of deionized water. The emulsion thus formed is polymerized at 70° C. for 3 hours, followed by heating to 85° C. for an additional 1 hour. The resulting self stabilized latex contains 59.5 percent by weight water and 40.5 percent by weight solids, which solids comprise particles of a random copolymer.

From the latex thus prepared 50 grams is diluted with 100 milliliters of water in a 250 milliliter beaker for a solids loading of 20 grams. The pH of the slurry is not adjusted. Into this stirred solution is dissolved the oxidant ammonium persulfate (3.7 grams; 0.0162 mole). After 15 minutes, 1.76 grams (0.0141 mole) of 3,4-ethylenedioxypyrrole monomer (EDOP) diluted in 5 milliliters of acetonitrile is added to the solution. The molar ratio of oxidant to EDOP is 1.1:1, and EDOP is present in an amount of 10 percent by weight of the marking particles. The reaction is stirred overnight at room temperature. The particles are then dried with a freeze dryer for 48 hours. It is believed that the bulk conductivity of this sample when pressed into a pellet will be about $1\times10^{-7}$ Siemens per centimeter.

EXAMPLE LXXII

Unpigmented marking particles are prepared by the method described in Example LXIX. Into a 250 milliliter beaker is added 150 grams of a pigmentless marking particle size particle slurry (average particle diameter 5.7 microns; particle size distribution GSD 1.24) providing a total of 11.25 grams of solid material in the solution. The pH of the solution is then adjusted by adding the dopant para-toluene sulfonic acid (pTSA) until the pH is 2.73. Into this stirred solution is dissolved the oxidant ferric chloride (1.3 grams; 8.0 mmole). After 15 minutes, 0.4 grams (3.17 mmole) of 3,4-ethylenedioxypyrrole monomer (EDOP) is added to the solution. The molar ratio of oxidant to EDOP is 2.5:1, and EDOP is present in an amount of 4 percent by weight of the marking particles. The reaction is stirred overnight at room temperature. The resulting greyish marking particles (with the slight coloration being the result of the PEDOP particle coating) are washed 6 times with distilled water and then dried with a freeze dryer for 48 hours. The chemical oxidative polymerization of EDOP to produce PEDOP occurs on the marking particle surfaces, and the particle surfaces are rendered slightly conductive by the presence of the sulfonate groups from the marking particle surfaces and by the added pTSA. It is believed that the bulk conductivity of this sample when pressed into a pellet will be about $2\times10^{-13}$ Siemens per centimeter.

EXAMPLE LXXIII

Marking particles are prepared by aggregation of a styrene/n-butyl acrylate/styrene sulfonate sodium salt/acrylic acid latex using a flocculent (poly(aluminum chloride)) followed by particle coalescence at elevated temperature. The polymeric latex is prepared by the emulsion polymerization of styrene/n-butyl acrylate/styrene sulfonate sodium salt/acrylic acid (monomer ratio 81.5 parts by weight styrene, 18 parts by weight n-butyl acrylate, 0.5 parts by weight of styrene sulfonate sodium salt, 2 parts by weight acrylic acid) without a nonionic surfactant and without an anionic surfactant, The solution consists of 40.0 percent by weight solids as follows; 277.92 kilograms of styrene, 61.38 kilograms of n-butyl acrylate, 1.7 kilograms of styrene sulfonate sodium salt, 6.52 kilograms of acrylic acid, 3.41 kilograms of carbon tetrabromide, and 11.2 kilograms of dodecanethiol are mixed with 461 kilograms of deionized water and 3.41 kilograms of ammonium persulfate polymerization initiator dissolved in 50 kilograms of deionized water. The emulsion thus formed is polymerized at 70° C. for 3 hours, followed by heating to 85° C. for an additional 1 hour. The resulting self stabilized latex contains 59.5 percent by weight water and 40.5 percent by weight solids, which solids comprise particles of a random copolymer.

From the latex thus prepared 50 grams is diluted with 100 milliliters of water in a 250 milliliter beaker for a solids loading of 20 grams. The pH of the slurry is not adjusted. Into this stirred solution is dissolved the oxidant ferric chloride (5.7 grams; 0.0352 mole). After 30 minutes, 1.76 grams (0.0141 mole) of 3,4-ethylenedioxypyrrole monomer (EDOP) is added to the solution. The molar ratio of oxidant to EDOP is 2.5:1, and EDOP is present in an amount of 10 percent by weight of the marking particles. The reaction is stirred overnight at room temperature. The particles are then dried with a freeze dryer for 48 hours. It is believed that the bulk conductivity of this sample when pressed into a pellet will be about $3.5\times10^{-9}$ Siemens per centimeter.

EXAMPLE LXXIV

Marking particles are prepared by aggregation of a styrene/n-butyl acrylate/styrene sulfonate sodium salt/acrylic acid latex using a flocculent (poly(aluminum chloride)) followed by particle coalescence at elevated temperature. The polymeric latex is prepared by the emulsion polymerization of styrene/n-butyl acrylate/styrene sulfonate sodium salt/acrylic acid (monomer ratio 81.5 parts by weight styrene, 18 parts by weight n-butyl acrylate, 0.5 parts by weight of styrene sulfonate sodium salt, 2 parts by weight acrylic acid) without a nonionic surfactant and without an anionic surfactant. The solution consists of 40.0 percent by weight solids as follows; 277.92 kilograms of styrene, 61.38 kilograms of n-butyl acrylate, 1.7 kilograms of styrene sulfonate sodium salt, 6.52 kilograms of acrylic acid, 3.41 kilograms of carbon tetrabromide, and 11.2 kilograms of dodecanethiol are mixed with 461 kilograms of deionized water and 3.41 kilograms of ammonium persulfate polymerization initiator dissolved in 50 kilograms of deionized water. The emulsion thus formed is polymerized at 70° C. for 3 hours, followed by heating to 85° C. for an additional 1 hour. The resulting self stabilized latex contains 59.5 percent by weight water and 40.5 percent by weight solids, which solids comprise particles of a random copolymer.

From the latex thus prepared 50 grams is diluted with 100 milliliters of water in a 250 milliliter beaker for a solids loading of 20 grams. The pH of the slurry is not adjusted. Into this stirred solution is dissolved the oxidant ferric chloride (1.15 grams; 7.09 mmole). After 15 minutes, 1.76 grams (0.0141 mole) of 3,4-ethylenedioxypyrrole monomer (EDOP) is added to the solution. The molar ratio of oxidant to EDOP is 0.5:1, and EDOP is present in an amount of 10 percent by weight of the marking particles. The reaction is stirred overnight at room temperature. The particles are then dried with a freeze dryer for 48 hours. It is believed that the bulk conductivity of this sample when pressed into a pellet will be about $1.5\times10^{-7}$ Siemens per centimeter.

Other embodiments and modifications of the present invention may occur to those of ordinary skill in the art subsequent to a review of the information presented herein; these embodiments and modifications, as well as equivalents thereof, are also included within the scope of this invention.

The recited order of processing elements or sequences, or the use of numbers, letters, or other designations therefor, is not intended to limit a claimed process to any order except as specified in the claim itself.

What is claimed is:

1. An apparatus for depositing a particulate marking material onto a substrate, comprising (a) a printhead having defined therein at least one channel, each channel having an inner surface and an exit orifice with a width no larger than about 250 microns, the inner surface of each channel having thereon a conductive polymer coating; (b) a propellant source connected to each channel such that propellant provided by the propellant source can flow through each channel to form propellant streams therein, said propellant streams having kinetic energy, each channel directing the propellant stream through the exit orifice toward the substrate; and (c) a marking material reservoir having an inner surface, said inner surface having thereon the conductive polymer coating, said reservoir containing particles of a particulate marking material, said reservoir being communicatively connected to each channel such that the particulate marking material from the reservoir can be controllably introduced into the propellant stream in each channel so that the kinetic energy of the propellant stream can cause the particulate marking material to impact the substrate.

2. An apparatus according to claim 1 wherein the conductive polymer is a polythiophene.

3. An apparatus according to claim 1 wherein the conductive polymer is a polythiophene is of the formula

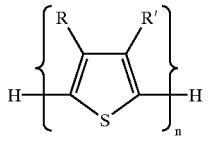

wherein R and R' each, independently of the other, is a hydrogen atom, an alkyl group, an alkoxy group, an aryl group, an aryloxy group, an arylalkyl group, an alkylaryl group, an arylalkyloxy group, an alkylaryloxy group, a heterocyclic group, or mixtures thereof and n is an integer representing the number of repeat monomer units.

4. An apparatus according to claim 1 wherein the conductive polymer is a poly(3,4-ethylenedioxythiophene).

5. An apparatus according to claim 4 wherein the poly(3,4-ethylenedioxythiophene) is formed from monomers of the formula

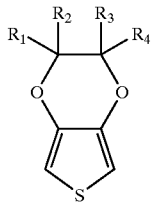

wherein each of $R_1$, $R_2$, $R_3$, and $R_4$, independently of the others, is a hydrogen atom, an alkyl group, an alkoxy group, an aryl group, an aryloxy group, an arylalkyl group, an alkylaryl group, an arylalkyloxy group, an alkylaryloxy group, or a heterocyclic group.

6. An apparatus according to claim 5 wherein $R_1$ and $R_3$ are hydrogen atoms and $R_2$ and $R_4$ are (a) $R_2$=H, $R_4$=H; (b) $R_2=(CH_2)_nCH_3$ wherein n=0–14, $R_4$=H; (c) $R_2=(CH_2)_nCH_3$ wherein n=0–14, $R_4=(CH_2)_nCH_3$ wherein n=0–14; (d) $R_2=(CH_2)_nSO_3^-Na^+$ wherein n=1–6, $R_4$=H; (e) $R_2=(CH_2)_nSO_3^-Na^+$ wherein n=1–6, $R_4=(CH_2)_nSO_3^-Na^+$ wherein n=1–6; (f) $R_2=(CH_2)_nOR_6$ wherein n=0–4 and $R_6$=(i) H or (ii) $(CH_2)_mCH_3$ wherein m=0–4, $R_4$=H; or (g) $R_2=(CH_2)_nOR_6$ wherein n=0–4 and $R_6$=(i) H or (ii) $(CH_2)_mCH_3$ wherein m=0–4, $R_4=(CH_2)_nOR_6$ wherein n=0–4 and $R_6$=(i) H or (ii) $(CH_2)_mCH_3$ wherein m=0–4.

7. An apparatus according to claim 4 wherein the poly(3,4-ethylenedioxythiophene) is of the formula

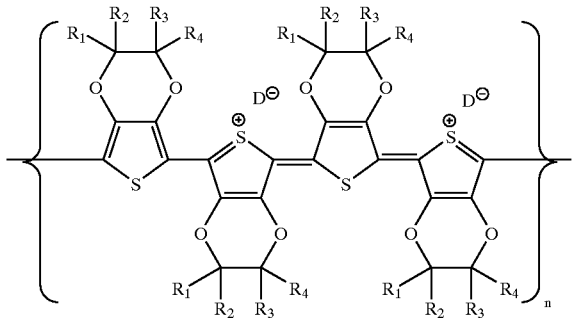

wherein each of $R_1$, $R_2$, $R_3$, and $R_4$, independently of the others, is a hydrogen atom, an alkyl group, an alkoxy group, an aryl group, an aryloxy group, an arylalkyl group, an alkylaryl group, an arylalkyloxy group, an alkylaryloxy group, or a heterocyclic group, $D^-$ is a dopant moiety, and n is an integer representing the number of repeat monomer units.

8. An apparatus according to claim 1 wherein the conductive polymer is a polypyrrole.

9. An apparatus according to claim 1 wherein the conductive polymer is a polypyrrole of the formula

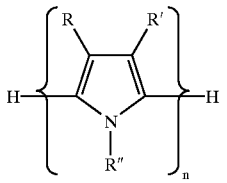

wherein R, R', and R" each, independently of the other, is a hydrogen atom, an alkyl group, an alkoxy group, an aryl group, an aryloxy group, an arylalkyl group, an alkylaryl group, an arylalkyloxy group, an alkylaryloxy group, a heterocyclic group, or mixtures thereof, wherein R" can further be an oligoether group, and n is an integer representing the number of repeat monomer units.

10. An apparatus according to claim 1 wherein the conductive polymer is a poly(3,4-ethylenedioxypyrrole).

11. An apparatus according to claim 10 wherein poly(3,4-ethylenedioxypyrrole) is formed from monomers of the formula

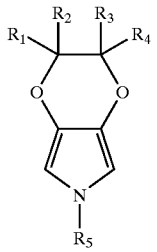

wherein each of $R_1$, $R_2$, $R_3$, $R_4$, $R_5$, independently of the others, is a hydrogen atom, an alkyl group, an alkoxy group, an aryl group, an aryloxy group, an arylalkyl group, an alkylaryl group, an arylalkyloxy group, an alkylaryloxy group, or a heterocyclic group, wherein $R_5$ can further be an oligoether group of the formula $(C_xH_{2x}O)_yR_1$, wherein x is an integer of from 1 to 6 and y is an integer representing the number of repeat monomer units.

12. An apparatus according to claim 11 wherein $R_1$ and $R_3$ are hydrogen atoms and $R_2$ and $R_4$ are (a) $R_2$=H, $R_4$=H; (b) $R_2=(CH_2)_nCH_3$ wherein n=0–14, $R_4$=H; (c) $R_2=(CH_2)_nCH_3$ wherein n=0–14, $R_4=(CH_2)_nCH_3$ wherein n=0–14; (d) $R_2=(CH_2)_nSO_3^-Na^+$ wherein n=1–6, $R_4$=H; (e) $R_2=(CH_2)_nSO_3^-Na^+$ wherein n=1–6, $R_4=(CH_2)_nSO_3^-Na^+$ wherein n=1–6; (f) $R_2=(CH_2)_nOR_6$ wherein n=0–4 and $R_6$=(i) H or (ii) $(CH_2)_mCH_3$ wherein m=0–4, $R_4$=H; or (g) $R_2(CH_2)_nOR_6$ wherein n=0–4 and $R_6$=(i) H or (ii) $(CH_2)_mCH_3$ wherein m=0–4, $R_4=(CH_2)_nOR_6$ wherein n=0–4 and $R_6$=(i) H or (ii) $(CH_2)_mCH_3$ wherein m=0–4.

13. An apparatus according to claim 10 wherein poly(3,4-ethylenedioxypyrrole) is of the formula

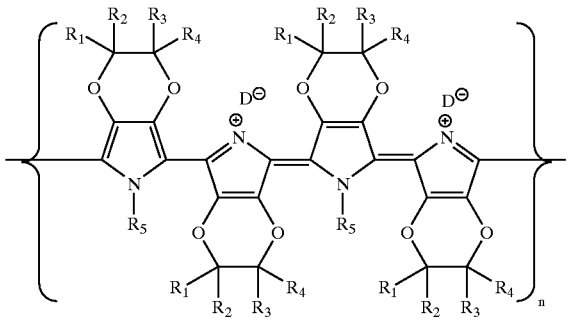

wherein each of $R_1$, $R_2$, $R_3$, $R_4$, and $R_5$, independently of the others, is a hydrogen atom, an alkyl group, an alkoxy group, an aryl group, an aryloxy group, an arylalkyl group, an alkylaryl group, an arylalkyloxy group, an alkylaryloxy group, or a heterocyclic group, wherein R5 can further be an oligoether group of the formula $(C_xH_{2x}O)_yR_1$, wherein x is an integer of from 1 to about 6 and y is an integer representing the number of repeat monomer units, $D^-$ is a dopant moiety, and n is an integer representing the number of repeat monomer units.

14. An apparatus according to claim 1 wherein the conductive polymer is doped with iodine, molecules containing sulfonate groups, molecules containing phosphate groups, molecules containing phosphonate groups, or mixtures thereof.

15. An apparatus according to claim 1 wherein the conductive polymer is doped with a dopant present in an amount of at least about 0.25 molar equivalent of dopant per molar equivalent of monomer and present in an amount of no more than about 4 molar equivalents of dopant per molar equivalent of monomer.

* * * * *